US010799772B2

(12) United States Patent
Boggs et al.

(10) Patent No.: US 10,799,772 B2
(45) Date of Patent: Oct. 13, 2020

(54) GOLF CLUB HEAD OR OTHER BALL STRIKING DEVICE HAVING IMPACT-INFLUENCING BODY FEATURES

(71) Applicant: NIKE, INC., Beaverton, OR (US)

(72) Inventors: Joshua M. Boggs, Aledo, TX (US); Kevin Harper, Fort Worth, TX (US); Eric A. Larson, Arlington, TX (US); Michael T. Prichard, Portland, OR (US); Hiromitsu Akiyama, Tokyo (JP); Yoshimasa Fujita, Ping-Tung Hsien (TW)

(73) Assignee: Karsten Manufacturing Corporation, Phoenix, AZ (US)

( * ) Notice: Subject to any disclaimer, the term of this patent is extended or adjusted under 35 U.S.C. 154(b) by 572 days.

(21) Appl. No.: 14/968,504

(22) Filed: Dec. 14, 2015

(65) Prior Publication Data

US 2016/0096084 A1 Apr. 7, 2016

Related U.S. Application Data

(63) Continuation-in-part of application No. 14/725,966, filed on May 29, 2015, and a continuation-in-part of application No. 14/593,752, filed on Jan. 9, 2015, now Pat. No. 9,776,050.

(60) Provisional application No. 62/217,503, filed on Sep. 11, 2015, provisional application No. 62/015,237, filed on Jun. 20, 2014.

(51) Int. Cl.
*A63B 53/04* (2015.01)
*A63B 60/00* (2015.01)

(52) U.S. Cl.
CPC ..... *A63B 53/0466* (2013.01); *A63B 53/04* (2013.01); *A63B 2053/045* (2013.01); *A63B 2053/0433* (2013.01); *A63B 2053/0491* (2013.01); *A63B 2060/002* (2015.10); *A63B 2209/00* (2013.01)

(58) Field of Classification Search
CPC ..... A63B 53/04; A63B 2053/0433; A63B 2053/045; A63B 53/0466
See application file for complete search history.

(56) References Cited

U.S. PATENT DOCUMENTS

| | | | |
|---|---|---|---|
| 1,916,792 | A | 7/1933 | James |
| 2,346,617 | A | 4/1944 | Schaffer |
| 4,535,990 | A | 8/1985 | Yamada |
| 5,176,383 | A | 1/1993 | Duclos |
| 5,464,211 | A | 11/1995 | Atkins, Sr. |
| 5,776,009 | A | 7/1998 | McAtee |
| 5,873,791 | A | 2/1999 | Allen |
| 5,888,148 | A | 3/1999 | Allen |
| 6,354,961 | B1 | 3/2002 | Allen |
| 6,551,199 | B2 | 4/2003 | Viera |
| 7,294,064 | B2 | 11/2007 | Tsurumaki et al. |
| 7,419,441 | B2 | 9/2008 | Hoffman et al. |

(Continued)

*Primary Examiner* — William M Pierce

(57) ABSTRACT

A ball striking device, such as a golf club head, has a face with a striking surface configured for striking a ball and a channel extending across a portion of the sole. The channel may be recessed from adjacent surfaces of the sole and have a depth of recession from the adjacent surfaces of the sole. A pair of ribs are positioned within the channel. The ribs may diverge away from one another and may have a first rib located in a toe portion of the channel and a second rib located in the heel portion of the channel.

12 Claims, 36 Drawing Sheets

(56) References Cited

U.S. PATENT DOCUMENTS 7,641,568 B2 1/2010 Hoffman et al.
RE42,544 E * 7/2011 Chao ..... A63B 53/0466 473/329
8,235,841 B2 8/2012 Stites et al.
8,403,771 B1 * 3/2013 Rice ..... A63B 53/04 473/328
8,696,491 B1 * 4/2014 Myers ..... A63B 53/0466 473/334
8,834,289 B2 9/2014 De La Cruz et al.
8,858,360 B2 * 10/2014 Rice ..... A63B 53/04 473/329
9,168,435 B1 * 10/2015 Boggs ..... A63B 53/04
9,278,265 B2 * 3/2016 Oldknow ..... A63B 53/04
9,526,956 B2 12/2016 Murphy et al.
9,636,559 B2 * 5/2017 de la Cruz ..... A63B 60/54
9,643,064 B2 * 5/2017 Boggs ..... A63B 53/04
9,675,850 B2 * 6/2017 Bennett ..... A63B 53/0466
9,707,457 B2 * 7/2017 Mata ..... A63B 53/06
9,744,412 B2 * 8/2017 Boggs ..... A63B 53/04
9,776,057 B2 * 10/2017 Rice ..... A63B 53/0466
9,839,820 B2 12/2017 Bennett et al.
9,889,346 B2 * 2/2018 Boggs ..... A63B 53/04
9,908,012 B2 * 3/2018 Larson ..... A63B 53/0466
9,914,025 B2 * 3/2018 Larson ..... A63B 53/0466
9,937,390 B2 * 4/2018 Luttrell ..... A63B 53/0466
9,950,219 B2 * 4/2018 Larson ..... A63B 53/0466
2002/0169035 A1 11/2002 Liu
2002/0183134 A1 12/2002 Allen et al.
2004/0192463 A1 9/2004 Tsurumaki et al.
2007/0117648 A1 5/2007 Masatoshi Yakota
2008/0132355 A1 6/2008 Hoffman et al.
2008/0146374 A1 6/2008 Beach et al.
2010/0048324 A1 2/2010 Wada et al.
2010/0273565 A1 10/2010 Stites et al.
2011/0207551 A1 * 8/2011 Breier ..... A63B 53/047 473/332
2011/0207552 A1 8/2011 Finn et al.
2012/0040772 A1 * 2/2012 Potter ..... A63B 53/04 473/328
2012/0049360 A1 * 3/2012 Lai ..... H01L 21/568 257/738
2012/0064991 A1 3/2012 Evans
2012/0289360 A1 * 11/2012 Breier ..... A63B 53/047 473/335
2012/0289361 A1 11/2012 Beach et al.
2013/0130834 A1 * 5/2013 Stites ..... A63B 53/0466 473/346
2013/0165252 A1 * 6/2013 Rice ..... A63B 53/04 473/329
2013/0165254 A1 * 6/2013 Rice ..... A63B 53/0466 473/329
2013/0324295 A1 * 12/2013 Oldknow ..... A63B 53/0466 473/327
2014/0080623 A1 * 3/2014 de la Cruz ..... A63B 53/0466 473/329
2014/0080624 A1 * 3/2014 Galvan ..... A63B 53/0466 473/329
2014/0080627 A1 * 3/2014 Bennett ..... A63B 53/06 473/332
2014/0080634 A1 * 3/2014 Golden ..... A63B 53/06 473/345
2015/0094164 A1 * 4/2015 Galvan ..... A63B 53/06 473/329
2015/0217167 A1 * 8/2015 Frame ..... A63B 53/0466 473/329
2015/0238826 A1 8/2015 Llewellyn et al.
2015/0367195 A1 12/2015 Boggs et al.
2016/0059093 A1 * 3/2016 Nielson ..... A63B 53/02 473/338
2016/0067560 A1 3/2016 Golden et al.
2016/0067563 A1 3/2016 Murphy et al.
2016/0096084 A1 * 4/2016 Boggs ..... A63B 53/04 473/349
2017/0050093 A1 * 2/2017 Mizutani ..... A63B 60/52
2018/0001170 A1 * 1/2018 Mizutani ..... A63B 60/52

* cited by examiner

GOLF CLUB HEAD OR OTHER BALL STRIKING DEVICE HAVING IMPACT-INFLUENCING BODY FEATURES

CROSS REFERENCE TO RELATED APPLICATIONS

This application claims priority to Provisional Application, U.S. Ser. No. 62/217,503 filed Sep. 11, 2015, and is a continuation-in-part to Non-Provisional Application, U.S. Ser. No. 14/725,966 filed May 29, 2015, and Non-Provisional application U.S. Ser. No. 14/593,752 filed Jan. 9, 2015, which claims priority to Provisional Application, U.S. Ser. No. 62/015,237, filed Jun. 20, 2014. The above-identified U.S. applications are herein incorporated by reference in their entirety.

TECHNICAL FIELD

The invention relates generally to golf club heads and other ball striking devices that include impact influencing body features. Certain aspects of this invention relate to golf club heads and other ball striking devices that have one or more of a compression channel extending across at least a portion of the sole, a void within the sole, and internal and/or external ribs.

BACKGROUND

Golf clubs and many other ball striking devices may have various face and body features, as well as other characteristics that can influence the use and performance of the device. For example, users may wish to have improved impact properties, such as increased coefficient of restitution (COR) in the face, increased size of the area of greatest response or COR (also known as the "hot zone") of the face, and/or improved efficiency of the golf ball on impact. A significant portion of the energy loss during an impact of a golf club head with a golf ball is a result of energy loss in the deformation of the golf ball, and reducing deformation of the golf ball during impact may increase energy transfer and velocity of the golf ball after impact. The present devices and methods are provided to address at least some of these problems and other problems, and to provide advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this disclosure relate to a golf club head comprising: a face having a striking surface configured for striking a ball; a body connected to the face and extending rearward from the face, the body having a crown, a sole, a heel, and a toe; a channel extending across a portion of the sole in a heel to toe direction, and a first rib positioned in the toe portion of the channel connected to the rear wall of the channel, wherein the first rib may be free of connection to the front edge of the channel. The channel may be recessed from adjacent surfaces of the sole and has a depth of recession from the adjacent surfaces of the sole, and the channel may have a rear wall, a front wall, a front edge, a rear edge, and a width defined between the front and rear edges. The channel further comprises a center portion extending across a center of the sole, a heel portion extending from a heel end of the center portion toward the heel, and a toe portion extending from a toe end of the center portion toward the toe.

Additional aspects relate to a second rib positioned in the heel portion of the channel connected to the rear wall of the channel, wherein the second rib may be free of connection to the front edge of the channel. The first rib and the second rib may diverge away from one another in a rear to front direction. Also the first rib may be positioned in the toe portion of the channel extends at an angle between 45 degrees and 85 degrees to the striking surface, and the second rib may be positioned in heel portion of the channel extends at an angle between 45 degrees and 85 degrees to the striking surface.

Further aspects relate to the first rib in the channel having a width in a range of 4 mm to 14 mm and having a hollow portion. The first rib further comprises an upper portion, a lower portion, a front portion, a rear portion, and a center portion, and wherein the rear portion has a height larger than the front portion. The first rib may be positioned aft of the rear edge of the center portion of the channel. The rear portion of each rib may have a first height and the front portion of each rib may have a second height, wherein the first height may be greater than the second height.

According to another aspect, each channel rib may be free of connection to a front edge of the channel have an upper portion of each rib forming a convex curved shape. The front and rear edges of the channel may be angled away from each other at the heel portion and the toe portion, such that the width of the channel at the heel and toe portions increases from the heel end of the center portion toward the heel and from the toe end of the center portion toward the toe, and the depth of recession of the channel may be greater at the heel and toe portions than at the center portion.

According to a further aspect, the golf club head of claim may comprise a void defined on the sole of the body and a cover defining a top of the void; and a first external rib and a second external rib wherein each external rib may be connected to the cover and extend downward from the cover, such that the first and second external ribs are positioned within the void; a third external rib and a fourth external rib positioned within the channel, wherein the third and fourth external ribs are connected to a rear wall of the channel. Each of the ribs may further comprise an upper portion, a lower portion, a front portion, a rear portion, and a center portion. The third external rib may be located in the toe portion of the channel and the fourth external rib may be located in the heel portion of the channel. The first external rib and second external rib diverge away from one another in a rear to front direction, and the third external rib and fourth external rib diverge away from one another in a front to rear direction.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
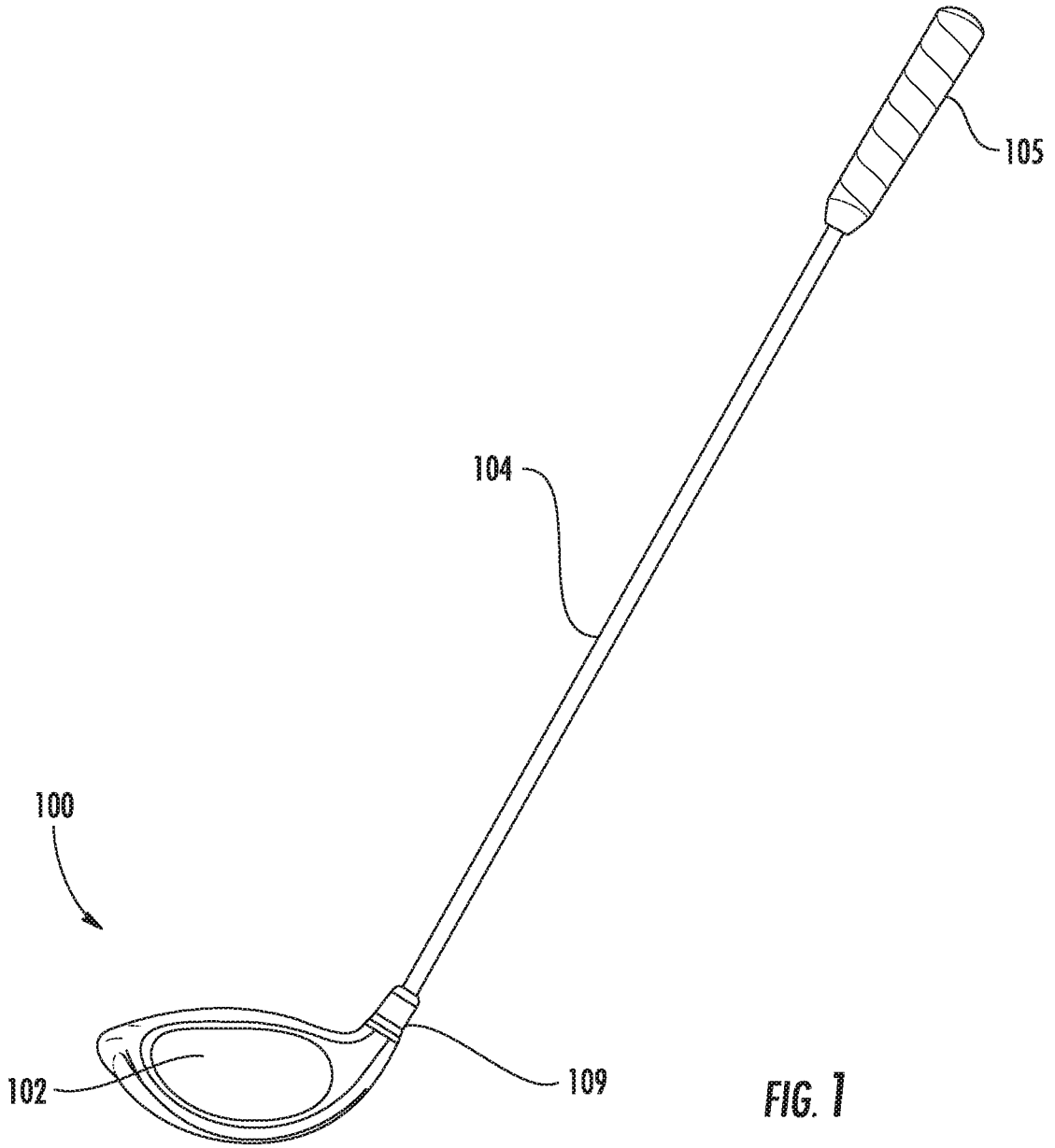
FIG. 1 is a front view of one embodiment of a golf club with a golf club head according to aspects of the disclosure, in the form of a golf driver.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The terms "shaft" or "handle" include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, aspects of this invention relate to ball striking devices, such as golf club heads, golf clubs, and the like. Such ball striking devices, according to at least some examples of the invention, may include a ball striking head with a ball striking surface. In the case of a golf club, the ball striking surface is a substantially flat surface on one face of the ball striking head. Some more specific aspects of this invention relate to wood-type golf clubs and golf club heads, including drivers, fairway woods, hybrid clubs, and the like, although aspects of this invention also may be practiced in connection with iron-type clubs, putters, and other club types as well.

According to various aspects and embodiments, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys, metal matrix composites, and other metallic materials). It is understood that the head may contain components made of several different materials, including carbon-fiber composites, polymer materials, and other components. Additionally, the components may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, fairway woods and hybrid clubs, as well as other types of wood-type clubs. Such devices may include a one-piece construction or a multiple-piece construction. Example structures of ball striking devices according to this invention will be described in detail below in conjunction with FIGS. 1-17 which illustrate one illustrative embodiment of a ball striking device 100 in the form of a wood-type golf club (e.g. a driver). It is understood that similar configurations may be used for other wood-type clubs, including a fairway wood (e.g., a 3-wood, 5-wood, 7-wood, etc.), as illustrated in FIGS. 18-26, or a hybrid club, as illustrated in FIGS. 27-33. As mentioned previously, aspects of this disclosure may alternately be used in connection with long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters.

The golf club 100 shown in FIGS. 1-17 includes a golf club head or a ball striking head 102 configured to strike a ball in use and a shaft 104 connected to the ball striking head 102 and extending therefrom. FIGS. 1-17 illustrate one embodiment of a ball striking head in the form of a golf club head 102 that has a face 112 connected to a body 108, with a hosel 109 extending therefrom and a shaft 104 connected to the hosel 109. For reference, the head 102 generally has a top or crown 116, a bottom or sole 118, a heel 120 proximate the hosel 109, a toe 122 distal from the hosel 109, a front 124, and a back or rear 126, as shown in FIGS. 1-13. The shape and design of the head 102 may be partially dictated by the intended use of the golf club 100. For example, it is understood that the sole 118 is configured to face the playing surface in use. With clubs that are configured to be capable of hitting a ball resting directly on the playing surface, such as a fairway wood, hybrid, iron, etc., the sole 118 may contact the playing surface in use, and features of the club may be designed accordingly.

In the club 100 shown in FIGS. 1-15, the head 102 has an enclosed volume, measured per "USGA PROCEDURE FOR MEASURING THE CLUB HEAD SIZE OF WOOD CLUBS", TPX-3003, REVISION 1.0.0 dated Nov. 21, 2003, as the club 100 is a wood-type club designed for use as a driver, intended to hit the ball long distances. In this procedure, the volume of the club head is determined using the displaced water weight method. According to the procedure, any large concavities must be filled with clay or dough and covered with tape so as to produce a smooth contour prior to measuring volume. Club head volume may additionally or alternately be calculated from three-dimensional computer aided design (CAD) modeling of the golf club head. In other applications, such as for a different type of golf club, the head 102 may be designed to have different dimensions and configurations. For example, when configured as a driver, the club head 102 may have a volume of at least 400 cc, and in some structures, at least 450 cc, or even at least 470 cc. The head 102 illustrated in the form of a driver in FIGS. 1-17 has a volume of approximately 460 cc, or within a range of 410 cc to 470 cc. If instead configured as a fairway wood (e.g., FIGS. 18-26), the head may have a volume of 120 cc to 250 cc, and if configured as a hybrid club (e.g., FIGS. 27-33), the head may have a volume of 85 cc to 170 cc. Other appropriate sizes for other club heads may be readily determined by those skilled in the art. The loft angle of the club head 102 also may vary, e.g., depending on the shot distance desired for the club head 102. For example, a driver golf club head may have a loft angle range of 7 degrees to 16 degrees, a fairway wood golf club head may have a loft angle range of 12 to 25 degrees, and a hybrid golf club head may have a loft angle range of 16 to 28 degrees.

The body 108 of the head 102 can have various different shapes, including a rounded shape, as in the head 102 shown in FIGS. 1-17, a generally square or rectangular shape, or any other of a variety of other shapes. It is understood that such shapes may be configured to distribute weight in any desired, manner, e.g., away from the face 112 and/or the geometric/volumetric center of the head 102, in order to create a lower center of gravity and/or a higher moment of inertia.

In the illustrative embodiment illustrated in FIGS. 1-17, the head 102 has a hollow structure defining an inner cavity 106 (e.g., defined by the face 112 and the body 108) with a plurality of inner surfaces defined therein. In one embodiment, the inner cavity 106 may be filled with air. However, in other embodiments, the inner cavity 106 could be filled or partially filled with another material, such as foam. In still further embodiments, the solid materials of the head may occupy a greater proportion of the volume, and the head may have a smaller cavity or no inner cavity 106 at all. It is understood that the inner cavity 106 may not be completely enclosed in some embodiments.

Figure 2:
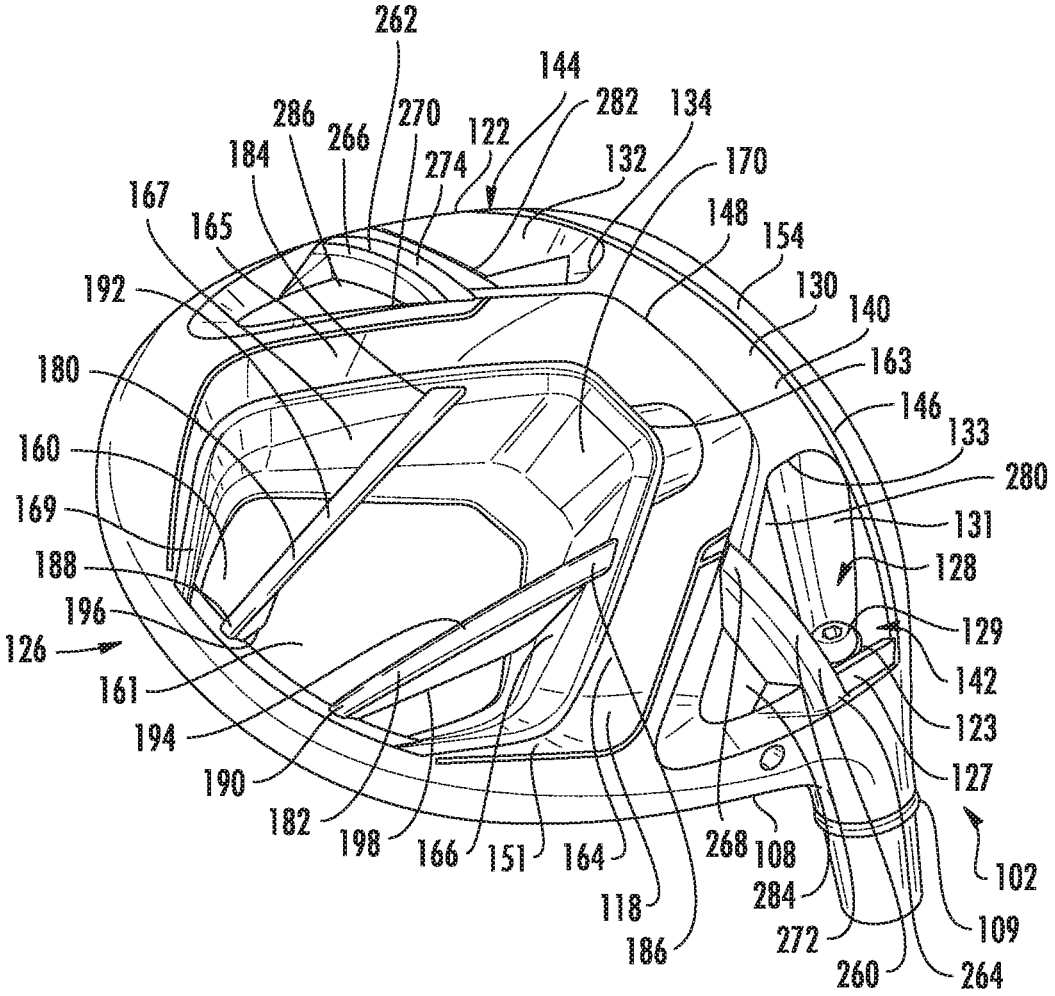
FIG. 2 is a bottom right rear perspective view of the golf club head of FIG. 1.
Figure 3:
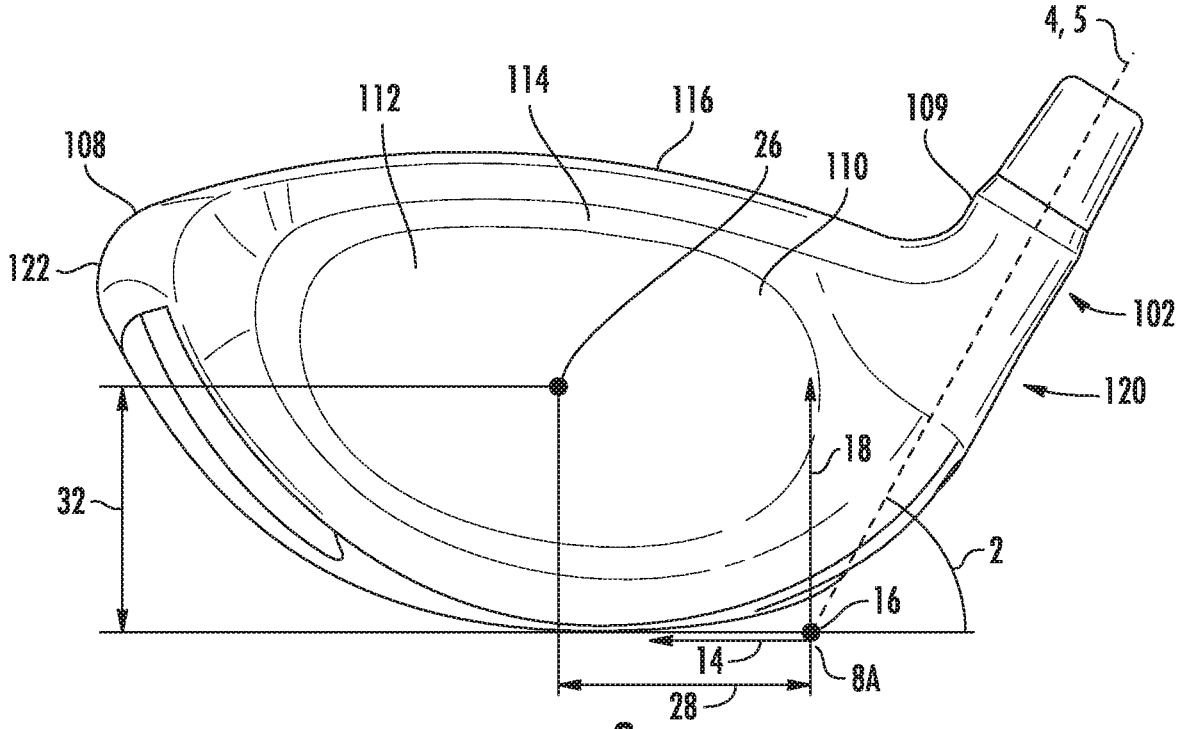
FIG. 3 is a front view of the club head of FIG. 1, showing a ground plane origin point.

The face 112 is located at the front 124 of the head 102 and has a ball striking surface (or striking surface) 110 located thereon and an inner surface 111 opposite the ball striking surface 110, as illustrated in FIG. 3. The ball striking surface 110 is typically an outer surface of the face 112 configured to face a ball in use and is adapted to strike the ball when the golf club 100 is set in motion, such as by swinging. As shown, the ball striking surface 110 is relatively flat, occupying at least a majority of the face 112. The face 112 has an outer periphery formed of a plurality of outer or peripheral edges 114. The edges of the face 112 may be defined as the boundaries of an area of the face 112 that is specifically designed to contact the ball in use, and may be recognized as the boundaries of an area of the face 112 that is intentionally shaped and configured to be suited for ball contact. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. Generally, the ball striking surface 110 is inclined with respect to the ground or contact surface (i.e., at a loft angle), to give the ball a desired trajectory and spin when struck, and it is understood that different club heads 102 may have different loft angles. Additionally, the face 112 may have a variable thickness and also may have one or more internal or external inserts and/or supports in some embodiments. In one embodiment, the face 112 of the head 102 in FIGS. 1-15 may be made from titanium (e.g., Ti-6Al-4V alloy or other alloy); however, the face 112 may be made from other materials in other embodiments.

It is understood that the face 112, the body 108, and/or the hosel 109 can be formed as a single piece or as separate pieces that are joined together. The face 112 may be formed as a face member with the body 108 being partially or wholly formed by one or more separate pieces connected to the face member. Such a face member may be in the form of, e.g., a face plate member or face insert, or a partial or complete cup-face member having a wall or walls extending rearward from the edges of the face 112. These pieces may be connected by an integral joining technique, such as welding, cementing, or adhesively joining. Other known techniques for joining these parts can be used as well, including many mechanical joining techniques, including releasable mechanical engagement techniques. As one example, a body member formed of a single, integral, cast piece may be connected to a face member to define the entire club head. The head 102 in FIGS. 1-15 may be constructed using this technique, in one embodiment. As yet another example, a first piece including the face 112 and a portion of the body 108 may be connected to one or more additional pieces to further define the body 108. For example, the first piece may have an opening on the top and/or bottom sides, with a separate piece or pieces connected to form part or all of the crown 116 and/or the sole 118. Further different forming techniques may be used in other embodiments.

The golf club 100 may include a shaft 104 connected to or otherwise engaged with the ball striking head 102 as shown in FIG. 1. The shaft 104 is adapted to be gripped by a user to swing the golf club 100 to strike the ball. The shaft 104 can be formed as a separate piece connected to the head 102, such as by connecting to the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Pat. No. 9,050,507, filed on Oct. 31, 2012, and U.S. Pat. No. 8,533,060, issued Sep. 10, 2013, all of which are incorporated herein by reference in their entireties and made parts hereof. The head 102 may have an opening or other access 128 for the adjustable hosel 109 connecting structure that extends through the sole 118, as seen in FIG. 2. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp the golf club shaft 104, as seen in FIG. 1. The grip element may be attached to the shaft 104 in any desired manner, including in conventional manners known and used in the art (e.g., via adhesives or cements, threads or other mechanical connectors, swedging/swaging, etc.).

The various embodiments of golf clubs 100 and/or golf club heads 102 described herein may include components that have sizes, shapes, locations, orientations, etc., that are described with reference to one or more properties and/or reference points. Several of such properties and reference points are described in the following paragraphs, with reference to FIGS. 3-7.

As illustrated in FIG. 3, a lie angle 2 is defined as the angle formed between the hosel axis 4 or a shaft axis 5 and a horizontal plane contacting the sole 118, i.e., the ground plane 6. It is noted that the hosel axis 4 and the shaft axis 5 are central axes along which the hosel 109 and shaft 104 extend.

Figure 4:
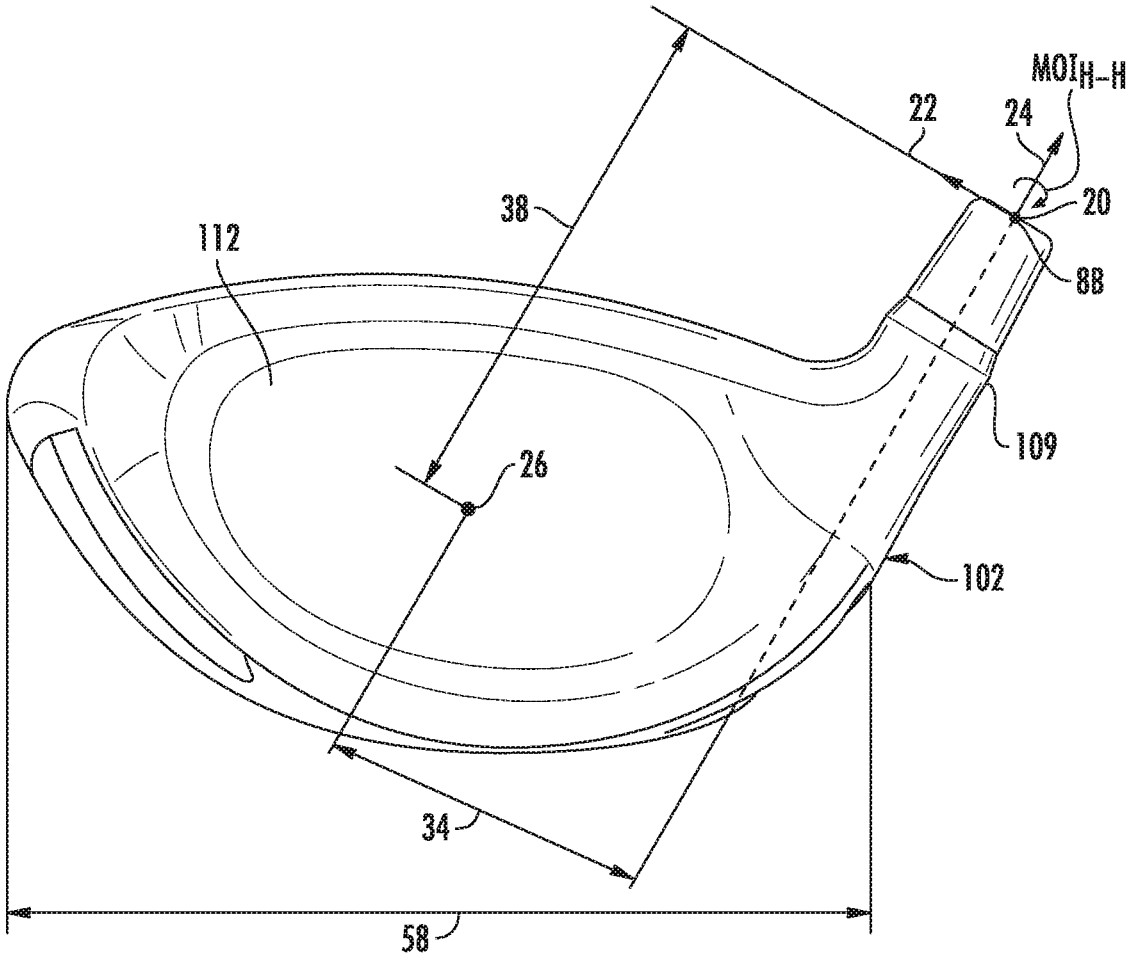
FIG. 4 is a front view of the club head of FIG. 1, showing a hosel origin point.

One or more origin points 8 (e.g., 8A, 8B) may be defined in relation to certain elements of the golf club 100 or golf club head 102. Various other points, such as a center of gravity, a sole contact, and a face center, may be described and/or measured in relation to one or more of such origin points 8. FIGS. 3 and 4 illustrate two different examples of such origin points 8, including their locations and definitions. A first origin point location, referred to as a ground plane origin point 8A is generally located at the ground plane 6. The ground plane origin point 8A is defined as the point at which the ground plane 6 and the hosel axis 4 intersect. A second origin point location, referred to as a hosel origin point 8B, is generally located on the hosel 109. The hosel origin point 8B is defined on the hosel axis 4 and coincident with the uppermost edge of the hosel 109. Either location for the origin point 8, as well as other origin points 8, may be utilized for reference without departing from this invention. It is understood that references to the ground plane origin point 8A and hosel origin point 8B are used herein consistent with the definitions in this paragraph, unless explicitly noted otherwise. Throughout the remainder of this application, the ground plane origin point 8A will be utilized for all reference locations, tolerances, calculations, etc., unless explicitly noted otherwise.

As illustrated in FIG. 3, a coordinate system may be defined with an origin located at the ground plane origin point 8A, referred to herein as a ground plane coordinate system. In other words, this coordinate system has an X-axis 14, a Y-axis 16, and a Z-axis 18 that all pass through the ground plane origin point 8A. The X-axis in this system is parallel to the ground plane and generally parallel to the striking surface 110 of the golf club head 102. The Y-axis 16 in this system is perpendicular to the X-axis 14 and parallel to the ground plane 6, and extends towards the rear 126 of the golf club head 102, i.e., perpendicular to the plane of the drawing sheet in FIG. 3. The Z-axis 18 in this system is perpendicular to the ground plane 6, and may be considered to extend vertically. Throughout the remainder of this application, the ground plane coordinate system will be utilized for all reference locations, tolerances, calculations, etc., unless explicitly noted otherwise.

Figure 5:
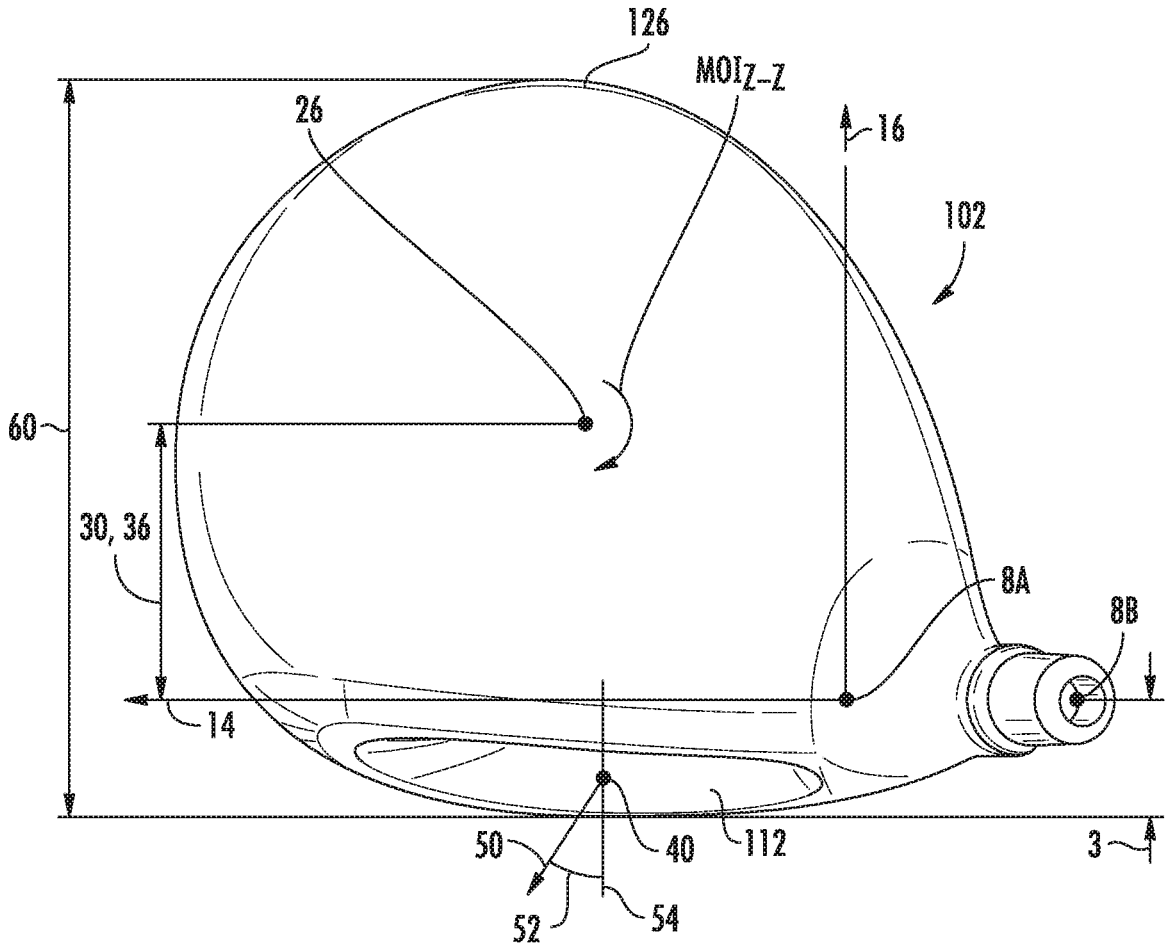
FIG. 5 is a top view of the club head of FIG. 1.

FIGS. 3 and 5 illustrate an example of a center of gravity location 26 as a specified parameter of the golf club head 102, using the ground plane coordinate system. The center of gravity of the golf club head 102 may be determined using various methods and procedures known and used in the art. The golf club head 102 center of gravity location 26 is provided with reference to its position from the ground plane origin point 8A. As illustrated in FIGS. 3 and 5, the center of gravity location 26 is defined by a distance CGX 28 from the ground plane origin point 8A along the X-axis 14, a distance CGY 30 from the ground plane origin point 8A along the Y-axis 16, and a distance CGZ 32 from the ground plane origin point 8A along the Z-axis 18.

Additionally as illustrated in FIG. 3, another coordinate system may be defined with an origin located at the hosel origin point 8B, referred to herein as a hosel axis coordinate system. In other words, this coordinate system has an X' axis 22, a Y' axis 20, and a Z' axis 24 that all pass through the hosel origin point 8B. The Z' axis 24 in this coordinate system extends along the direction of the shaft axis 5 (and/or the hosel axis 4). The X' axis 22 in this system extends parallel with the vertical plane and normal to the Z' axis 24. The Y' axis 20 in this system extends perpendicular to the X' axis 22 and the Z' axis 24 and extends toward the rear 126 of the golf club head 102, i.e., the same direction as the Y-axis 16 of the ground plane coordinate system.

FIG. 4 illustrates an example of a center of gravity location 26 as a specified parameter of the golf club head 102, using the hosel axis coordinate system. The center of gravity of the golf club head 102 may be determined using various methods and procedures known and used in the art. The golf club head 102 center of gravity location 26 is provided with reference to its position from the hosel origin point 8B. As illustrated in FIG. 3, the center of gravity location 26 is defined by a distance ΔX 34 from the hosel origin point 8B along the X' axis 22, a distance ΔY (not shown) from the hosel origin point 8B along the Y' axis 20, and a distance ΔZ 38 from the hosel origin point 8B along the Z' axis 24.

Figure 6:
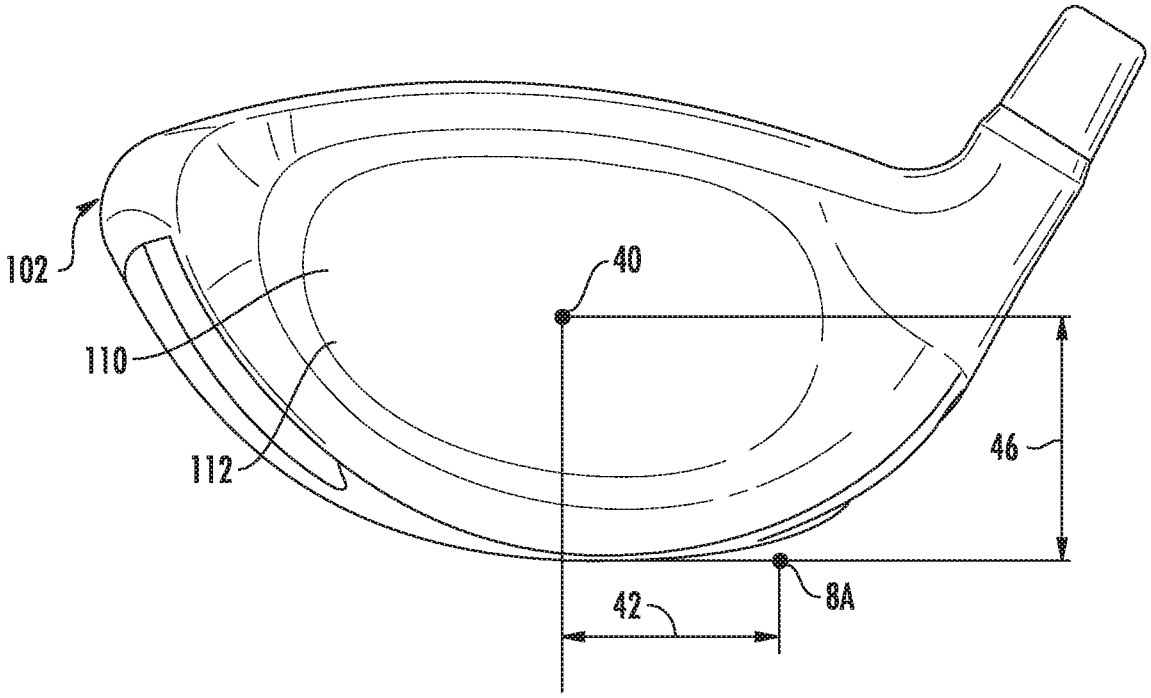
FIG. 6 is a front view of the club head of FIG. 1.

FIGS. 5 and 6 illustrate the face center (FC) location 40 on a golf club head 102. The face center location 40 illustrated in FIGS. 4 and 5 is determined using United States Golf Association (USGA) standard measuring procedures from the "Procedure for Measuring the Flexibility of a Golf Clubhead", USGA TPX-3004, Revision 2.0, Mar. 25, 2005. Using this USGA procedure, a template is used to locate the FC location 40 from both a heel 120 to toe 122 location and a crown 116 to sole 118 location. For measuring the FC location 40 from the heel to toe location, the template should be placed on the striking surface 110 until the measurements at the edges of the striking surface 110 on both the heel 120 and toe 122 are equal. This marks the FC location 40 from a heel to toe direction. To find the face center from a crown to sole dimension, the template is placed on the striking surface 110 and the FC location 40 from crown to sole is the location where the measurements from the crown 116 to sole 118 are equal. The FC location 40 is the point on the striking surface 110 where the crown-to-sole measurements on the template are equidistant, and the heel to toe measurements are equidistant.

As illustrated in FIG. 6, the FC location 40 can be defined from the ground plane origin coordinate system, such that a distance CFX 42 is defined from the ground plane origin point 8A along the X-axis 14, a distance CFY 44 is defined from the ground plane origin point 8A along the Y-axis 16, and a distance CFZ 46 is defined from the ground plane origin point 8A along the Z-axis 18. It is understood that the FC location 40 may similarly be defined using the hosel origin system, if desired. The face progression (FP) 31 may be determined as the distance from the center axis of the hosel or origin point 8A to the forward most edge of the head 102 along the Y-Axis 16.

Figure 7:
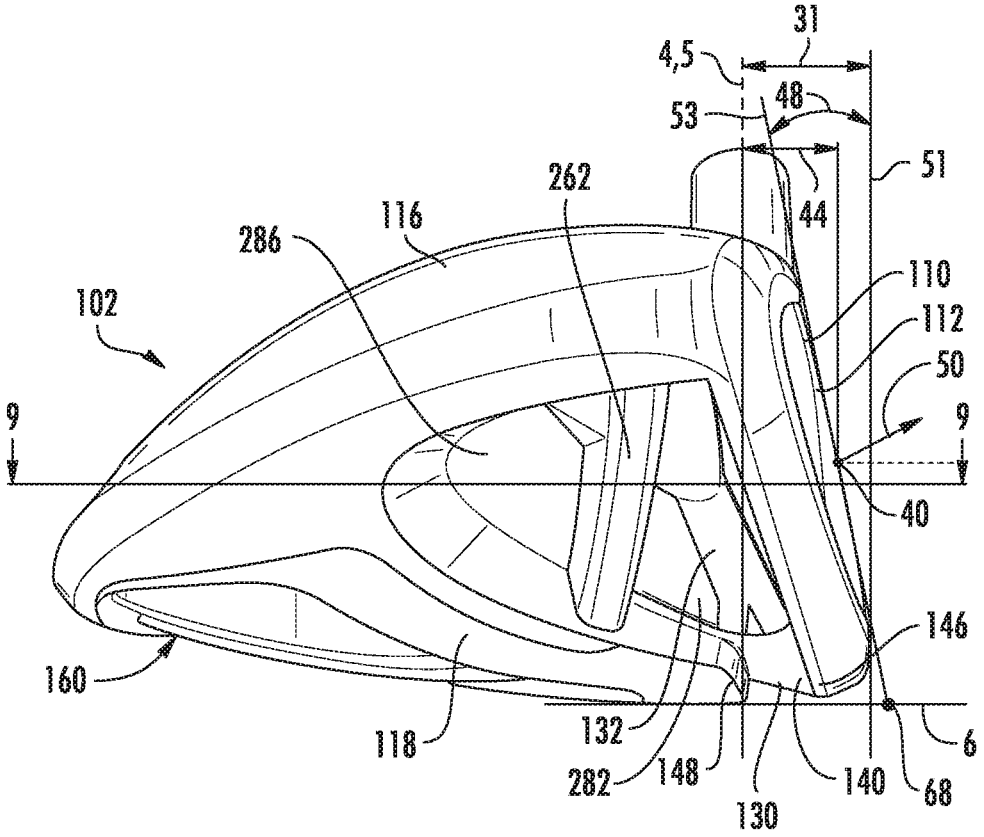
FIG. 7 is a side view of the club head of FIG. 1.

FIG. 7 illustrates an example of a loft angle 48 of the golf club head 102. The loft angle 48 can be defined as the angle between a plane 53 that is tangential to the striking surface 110 at the FC location 40 and a plane 51 normal or perpendicular to the ground plane 6. Alternately, the loft angle 48 can be defined as the angle between an axis 50 normal or perpendicular to the striking surface 110 at the FC location 40, called a face center axis 50, and the ground plane 6. It is understood that each of these definitions of the loft angle 48 may yield the substantially the same loft angle measurement. Additionally, a sole-face intersection point 68 may be defined as the point where plane 53 intersects the ground plane 6 at a plane parallel to the Z-axis through the FC location 40.

FIG. 5 illustrates an example of a face angle 52 of a golf club head 102. As illustrated in FIG. 5, the face angle 52 is defined as the angle between the face center axis 50 and a plane 54 perpendicular to the X-axis 14 and the ground plane 6.

FIG. 3 illustrates a golf club head 102 oriented in a reference position. In the reference position, the hosel axis 4 or shaft axis 5 lies in a vertical plane, as shown in FIG. 7. As illustrated in FIG. 3, the hosel axis 4 may be oriented at the lie angle 2. The lie angle 2 selected for the reference position may be the golf club 100 manufacturer's specified lie angle. If a specified lie angle is not available from the manufacturer, a lie angle of 60 degrees can be used. Furthermore, for the reference position, the striking surface 110 may, in some circumstances, be oriented at a face angle 54 of 0 degrees. The measurement setup for establishing the reference position can be found determined using the "Procedure for Measuring the Club Head Size of Wood Clubs", TPX-3003, Revision 1.0.0, dated Nov. 21, 2003.

As golf clubs have evolved in recent years, many have incorporated head/shaft interconnection structures connecting the shaft 104 and club head 102. These interconnection structures are used to allow a golfer to easily change shafts for different flex, weight, length or other desired properties. Many of these interconnection structures have features whereby the shaft 104 is connected to the interconnection structure at a different angle than the hosel axis 4 of the golf club head, including the interconnection structures discussed elsewhere herein. This feature allows these interconnection structures to be rotated in various configurations to potentially adjust some of the relationships between the club head 102 and the shaft 104 either individually or in combination, such as the lie angle, the loft angle, or the face angle. As such, if a golf club 100 includes an interconnection structure, it shall be attached to the golf club head when addressing any measurements on the golf club head 102. For example, when positioning the golf club head 102 in the reference position, the interconnection structures should be attached to the structure. Since this structure can influence the lie angle, face angle, and loft angle of the golf club head, the interconnection member shall be set to its most neutral position. Additionally, these interconnection members have a weight that can affect the golf club heads mass properties, e.g. center of gravity (CG) and moment of inertia (MOI) properties. Thus, any mass property measurements on the golf club head should be measured with the interconnection member attached to the golf club head.

The moment of inertia is a property of the club head 102, the importance of which is known to those skilled in the art. There are three moment of inertia properties referenced herein. The moment of inertia with respect to an axis parallel to the X-axis 14 of the ground plane coordinate system, extending through the center of gravity 26 of the club head 102, is referenced as the MOI x-x, as illustrated in FIG. 7. The moment of inertia with respect to an axis parallel to the Z-axis 18 of the ground plane coordinate system, extending through the center of gravity 26 of the club head 102, is referenced as the MOI z-z, as illustrated in FIG. 5. The moment of inertia with respect to the Z' axis 24 of the hosel axis coordinate system is referenced as the MOI h-h, as illustrated in FIG. 4. The MOI h-h can be utilized in determining how the club head 102 may resist the golfer's ability to close the clubface during the swing.

Figure 9:
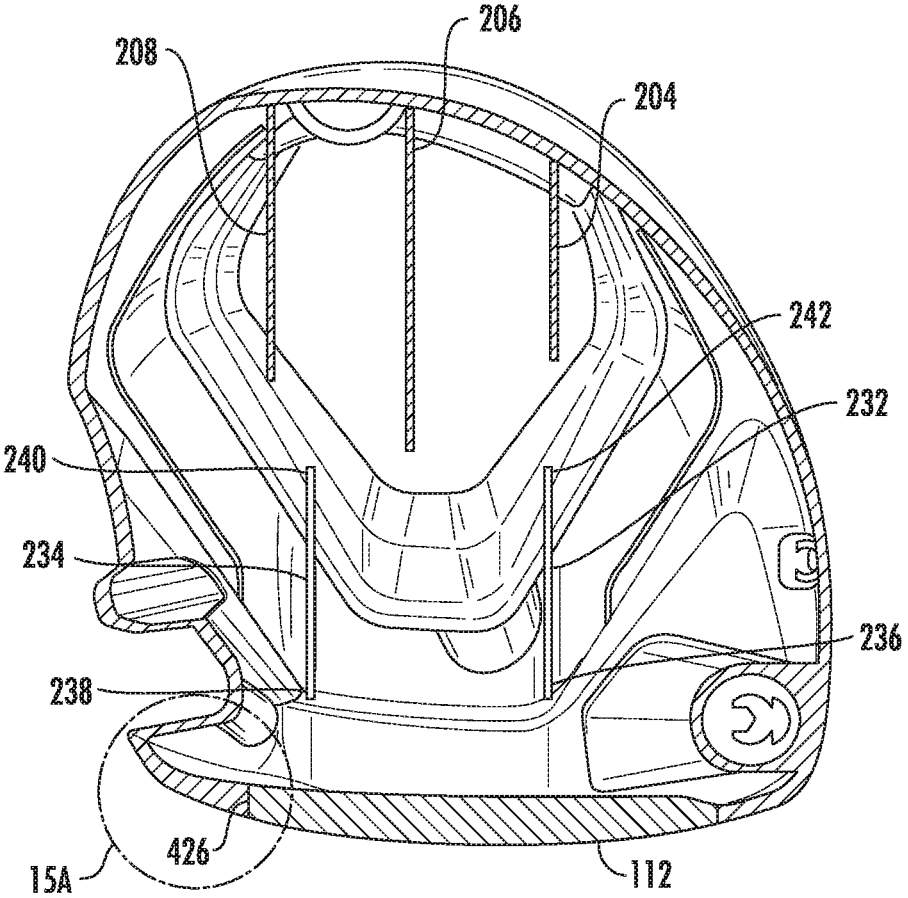
FIG. 9 is a cross-section view taken along line 9-9 of FIG. 7.
Figure 10:
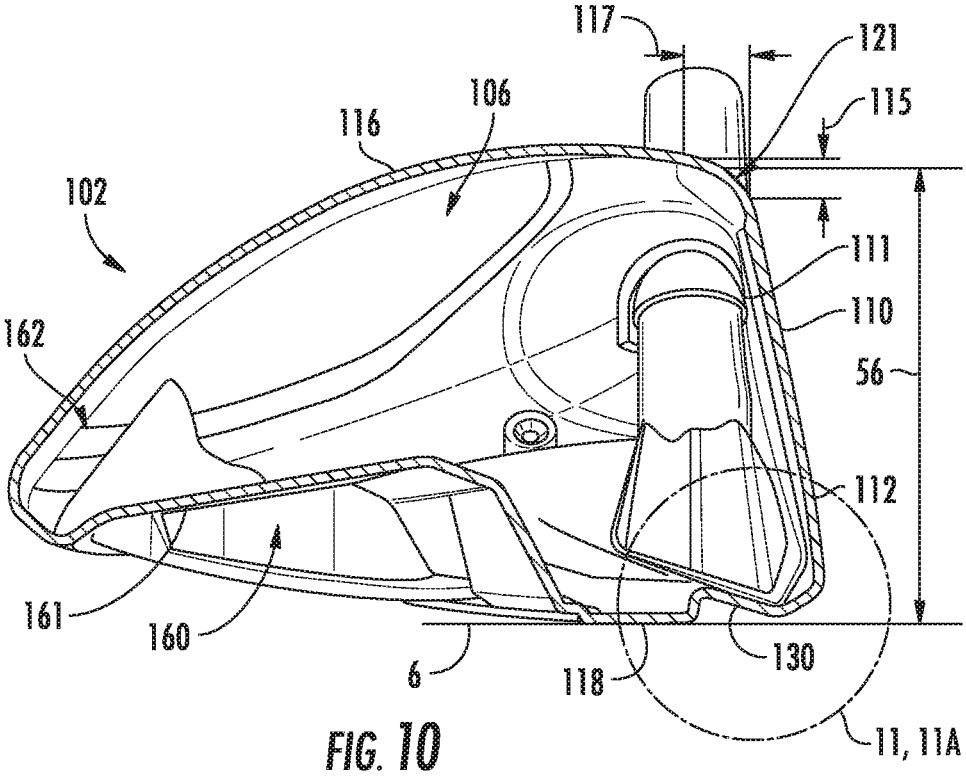
FIG. 10 is a cross-section view taken along line 10-10 of FIG. 8.

The ball striking face height (FH) 56 is a measurement taken along a plane normal to the ground plane and defined by the dimension CFX 42 through the face center 40, of the distance between the ground plane 6 and a point represented by a midpoint of a radius between the crown 116 and the face 112. An example of the measurement of the face height 56 of a head 102 is illustrated in FIG. 10. The face height 56 in one embodiment of the club head 102 of FIGS. 1-15 may be 50-72 mm, or may be approximately 60 mm+/−2 mm in another embodiment. It is understood that the club heads 102 described herein may be produced with multiple different loft angles, and that different loft angles may have some effect on face height 56.

The head length 58 and head breadth 60 measurements can be determined by using the USGA "Procedure for Measuring the Club Head Size of Wood Clubs," USGA-TPX 3003, Revision 1.0.0, dated Nov. 21, 2003. Examples of the measurement of the head length 58 and head breadth 60 of a head 102 are illustrated in FIGS. 4 and 5.

Geometry and Mass Properties of Club Heads

In the golf club 100 shown in FIGS. 1-15, the head 102 has dimensional characteristics that define its geometry and also has specific mass properties that can define the performance of the golf club as it relates to the ball flight that it imparts onto a golf ball during the golf swing or the impact event itself. This illustrative embodiment and other embodiments are described in greater detail below.

The head 102 as shown in FIGS. 1-15 illustrates a driver golf club head. The head 102 may have a head weight of 198 to 210 grams. The head may have a center of gravity CGX in the range of 20 to 24 mm, CGY in the range of 16 to 20 mm, and CGZ in the range of 30 to 34 mm. Correspondingly from the hosel coordinate system, the ΔX may be in the range of 34 to 38 mm, the ΔY may be in the range of 16 to 20 mm, and the ΔZ may be in the range of 68 to 72 mm. The head 102 may have a corresponding MOI x-x of approximately 2500 to 2800 $g*cm^2$ or 2200 to 3000 $g*cm^2$. The head 102 may have a corresponding MOI z-z of approximately 4400 to 4800 $g*cm^2$ or 4200 to 5200 $g*cm^2$. The head 102 may have a corresponding MOI h-h of approximately 6700 to 7100 $g*cm^2$. The head 102 generally may have a head length ranging from 115 to 122 mm and a head breadth ranging from 114 to 119 mm. Additionally, the head may have a face center location 40 defined by a CFX between (where between is defined herein as inclusive) 21 to 25 mm, a CFY between 13 to 17 mm, and a CFZ between 31 to 35 mm.

The head 102 as shown in FIGS. 18-26 illustrates a fairway wood golf club head. This head generally may have a head weight of 208 to 224 grams. The head may have a center of gravity CGX in the range of 21 to 26 mm, CGY in the range of 13 to 19 mm, and CGZ in the range of 15 to 19 mm. Correspondingly from the hosel coordinate system, the ΔX may be in the range of 27 to 32 mm, the ΔY may be in the range of 13 to 19 mm, and the ΔZ may be in the range of 57 to 64 mm. The head 102 may have a corresponding MOI x-x of approximately 1250 to 1550 $g*cm^2$, an MOI z-z of approximately 2400 to 2800 $g*cm^2$, and an MOI h-h of approximately 4400 to 5000 $g*cm^2$. The head 102 generally may have a head length ranging from 101 to 105 mm and a head breadth ranging from 86 to 90 mm. Additionally, the head may have a face center location 40 defined by a CFX between 21 to 25 mm, a CFY between 8 to 13 mm, and a CFZ between 18 to 22 mm.

The head 102 as shown in FIGS. 27-33 illustrates a hybrid golf club head. This head generally may have a head weight of 222 to 250 grams. The head may have a center of gravity CGX in the range of 22 to 26 mm, CGY in the range of 8 to 13 mm, and CGZ in the range of 13 to 17 mm. Correspondingly, from the hosel coordinate system, the ΔX may be in the range of 27 to 32 mm, the ΔY may be in the range of 8 to 13 mm, and the ΔZ may be in the range of 60 to 65 mm. The head 102 may have a corresponding MOI x-x of approximately 800 to 1200 $g*cm^2$, an MOI z-z of approximately 2000 to 2400 $g*cm^2$, and an MOI h-h of approximately 3600 to 4000 $g*cm^2$. The head 102 generally may have a head length ranging from 97 to 102 mm and a head breadth ranging from 64 to 71 mm. Additionally, the head may have a face center 40 defined by a CFX between 22 to 26 mm, a CFY between 6 to 12 mm, and a CFZ between 17 to 21 mm.

Channel Structure of Club Head

In general, the ball striking heads 102 according to the present invention include features on the body 108 that influence the impact of a ball on the face 112, such as one or more compression channels 140 positioned on the body 108 of the head 102 that allow at least a portion of the body 108 to flex, produce a reactive force, and/or change the behavior or motion of the face 112, during impact of a ball on the face 112. In the golf club 100 shown in FIGS. 1-15, the head 102 includes a single channel 140 located on the sole 118 of the head 102. As described below, this channel 140 permits compression and flexing of the body 108 during impact on the face 112, which can influence the impact properties of the club head. This illustrative embodiment and other embodiments are described in greater detail below.

Figure 8:
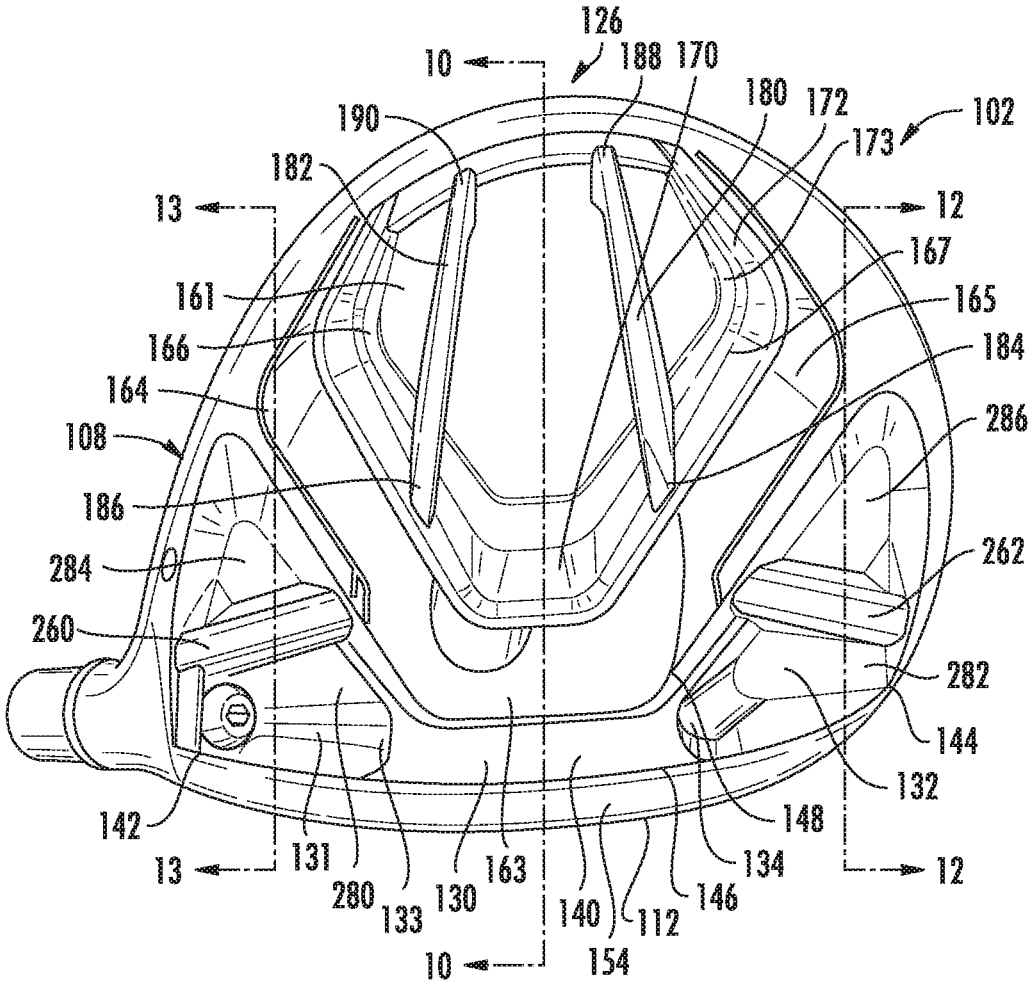
FIG. 8 is bottom view of the club head of FIG. 1.

The golf club head 102 shown in FIGS. 1-15 includes a compression channel 140 positioned on the sole 118 of the head 102, and which may extend continuously across at least a portion of the sole 118. In other embodiments, the head 102 may have a channel 140 positioned differently, such as on the crown 116, the heel 120, and/or the toe 122. It is also understood that the head 102 may have more than one channel 140, or may have an annular channel extending around the entire or substantially the entire head 102. As illustrated in FIGS. 2 and 8, the channel 140 of this example structure is elongated, extending between a first end 142 located proximate the heel 120 of the head 102 and a second end 144 located proximate the toe 122 of the head 102. The channel 140 has a boundary that is defined by a first or front edge 146 and a second or rear edge 148 that extend between the ends 142, 144. In this embodiment, the channel 140 extends across the sole, adjacent to and along the bottom edge 114 of the face 112, and further extends proximate the heel 120 and toe 122 areas of the head 102. The channel 140 is recessed inwardly with respect to the immediately adjacent surfaces of the head 102 that extend from and/or are in contact with the edges 146, 148 of the channel 140, as shown in FIGS. 2 and 7-15. It is understood that, with a head 102 having a thin-wall construction (e.g., the embodiment of FIGS. 1-17), the recessed nature of the channel 140 creates corresponding raised portions on the inner surfaces of the body 108.

Figure 11:
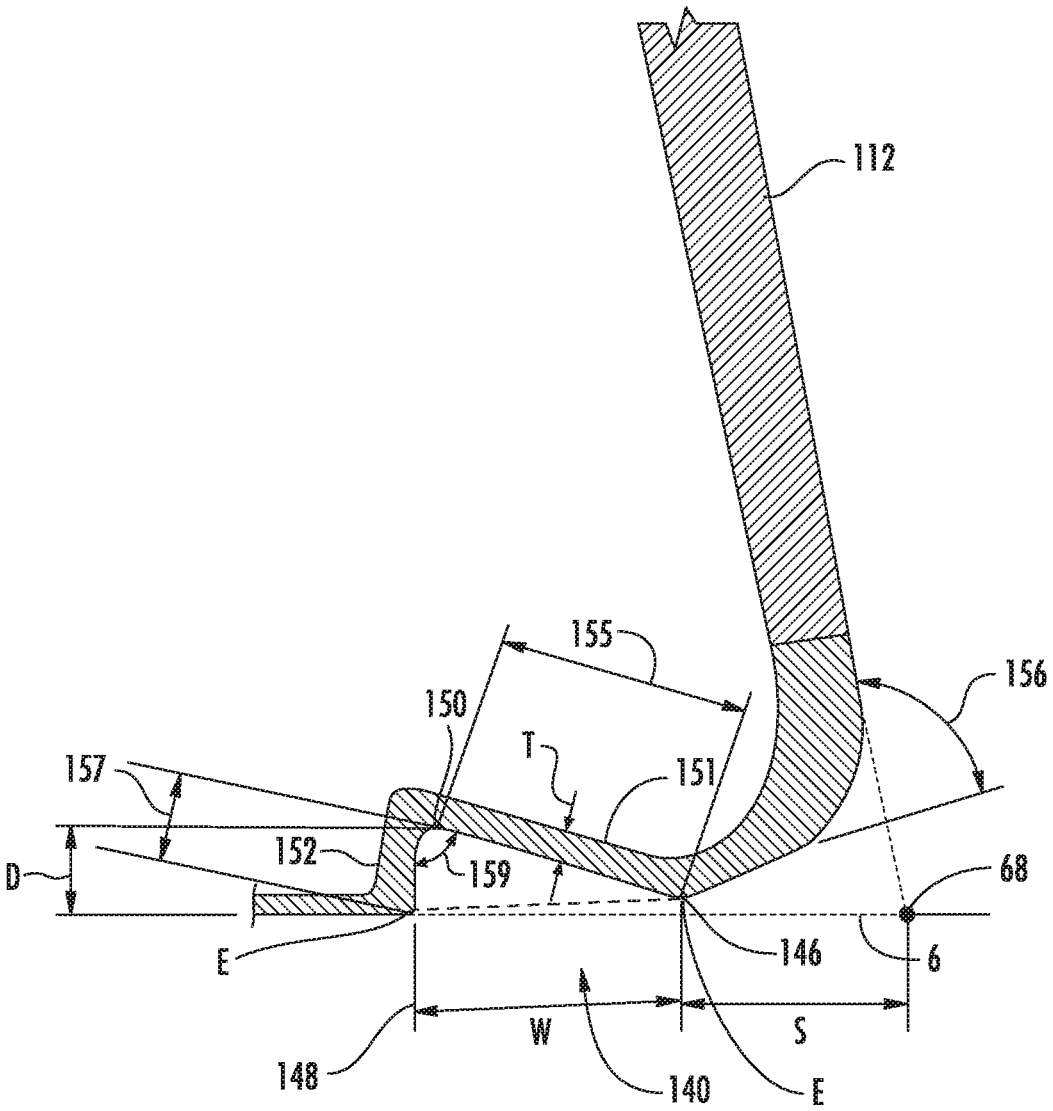
FIG. 11 is a magnified view of FIG. 10 showing a portion of the club head of FIG. 1.
Figure 11A:
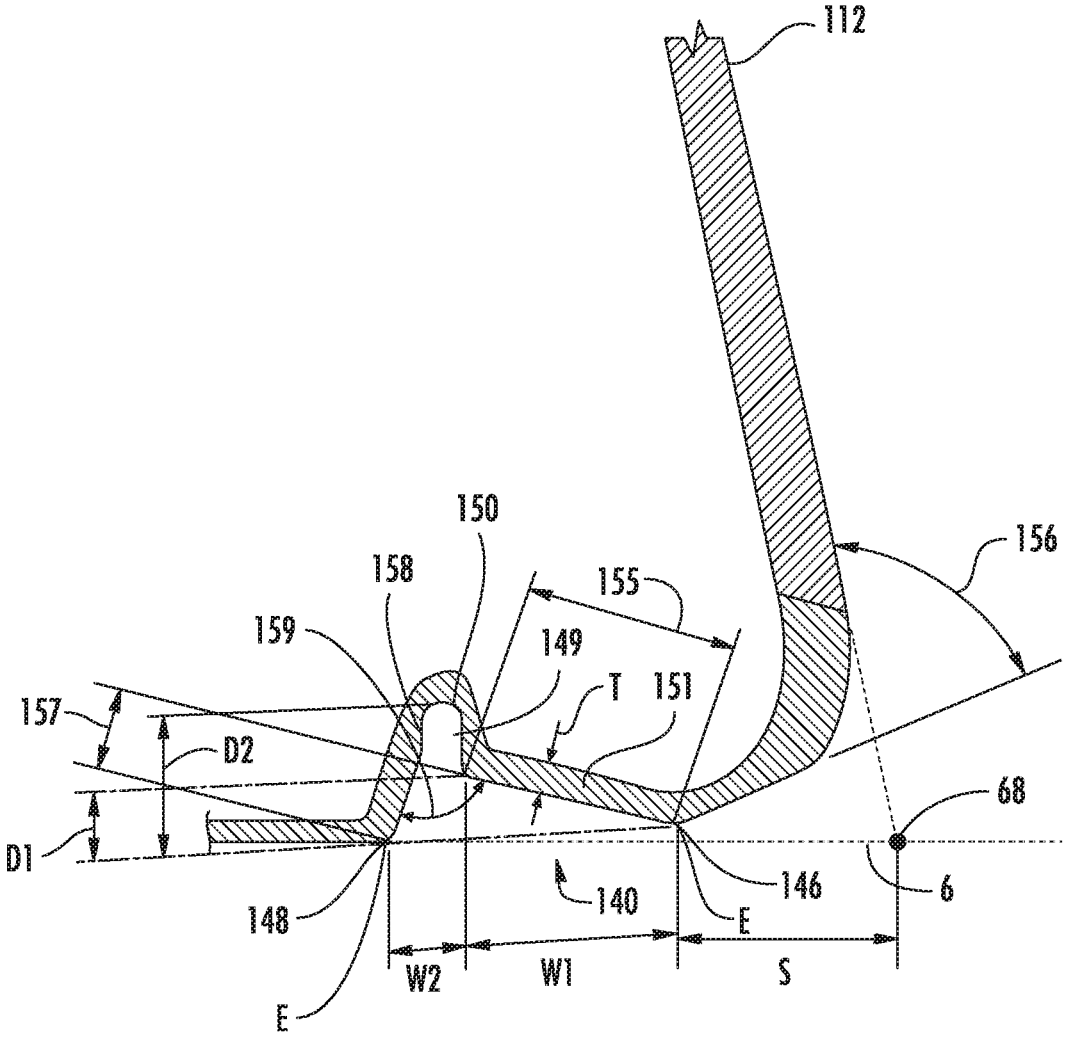
FIG. 11A is a magnified view of FIG. 10 showing a portion of an alternate embodiment of the club head of FIG. 1.

As illustrated in FIG. 11, the channel 140 has a width W and a depth D that may vary in different portions of the channel 140. The width W and depth D of the channel 140 may be measured with respect to different reference points. For example, the width W of the channel 140 may be measured between radius end points (see points E in FIG. 11), which represent the end points of the radii or fillets of the front edge 146 and the rear edge 148 of the channel 140, or in other words, the points where the recession of the channel 140 from the body 108 begins. This measurement can be made by using a straight virtual line segment that is tangent to the end points of the radii or fillets as the channel 140 begins to be recessed into the body 108. This may be considered to be a comparison between the geometry of the body 108 with the channel 140 and the geometry of an otherwise identical body that does not have the channel 140. The depth D of the channel 140 may also be measured normal to an imaginary line extending between the radius end points. As further illustrated in FIGS. 11 and 11A, a rearward spacing S of the channel 140 may be defined using the radius end point of the front edge 146 of the channel 140, measured rearwardly (in the Y-Axis direction) from the sole-face intersection point 68. As illustrated in FIGS. 11 and 11A, the rearward spacing S of the channel 140 location relative to the front of the head 102 may be defined for any cross-section taken in a plane perpendicular to the X-Axis 14 and Z-Axis 18 at any location along the X-Axis 14 by the dimension S from the forward most edge of the face dimension at the cross-section to the radius of the end point of the channel (shown as point E in FIG. 11). This may be considered to be a comparison between the geometry of the body 108 with the channel 140 and the geometry of an otherwise identical body that does not have the channel 140. If the reference points for measurement of the width W and/or depth D of the channel 140 are not explicitly described herein with respect to a particular example or embodiment, the radius end points may be considered the reference points for both width W and/or depth D measurement. Properties such as width W, depth D, and rearward spacing S, etc., in other embodiments (e.g., as shown in FIGS. 17-33) may be measured or expressed in the same manner described herein with respect to FIGS. 1-15.

An alternate embodiment of the center portion 130 of channel 140 is shown in FIG. 11A, which may further change or enhance the performance of the channel. Like the embodiment shown in FIG. 11, the center portion 130 of channel 140 has an asymmetric cross-sectional profile. The front wall 151 and rear wall 152 do not physically intersect, but have a projection that intersects within an expanded trough 150. The expanded trough 150 may have a first wall 149 connected to the front wall 151 and a second wall 158 connected to the rear wall 152 with the expanded trough 150 positioned between the first wall 149 and the second wall 158.

Similar to the embodiment of FIG. 11, the width W and depth D of the channel 140 may be measured with respect to different reference points. For example, the width W of the channel 140 may be measured between radius end points (see points E in FIG. 11A), which represent the end points of the radii or fillets of the front edge 146 and the rear edge 148 of the channel 140, or in other words, the points where the recession of the channel 140 from the body 108 begins. This measurement can be made by using a straight virtual line segment that is tangent to the end points of the radii or fillets as the channel 140 begins to be recessed into the body 108. The channel 140 may have a depth $D_2$ measured to the bottom of the expanded trough 150 and a depth $D_1$ measured to the intersection of the front wall 151 and the first wall 149.

The head 102 in the embodiment illustrated in FIGS. 1-15 has a channel 140 that generally has a center portion 130 that has a relatively constant width W (front to rear) and depth D of recession and heel and toe portions 131, 132 that have greater widths W and greater depths D of recession from adjacent surfaces of the sole 118. In this configuration, the front edge 146 and the rear edge 148 are both generally parallel to the bottom edge of the face 112 and/or generally parallel to each other along the entire length of the center portion 130, i.e., between opposed ends 133, 134 of the center portion 130. In this configuration, the front and rear edges 146, 148 may generally follow the curvature of the bulge radius of the face 112. In other embodiments, the front edge 146 and/or the rear edge 146 at the center portion 130 may be angled, curved, etc. with respect to each other and/or with respect to the adjacent edges of the face 112. The front and rear edges 146, 148 at the heel portion 131 and the toe portion 132 are angled away from each other, such that the widths W of the heel and toe portions 131, 132 gradually increase toward the heel 120 and the toe 122, respectively. The depths D of the heel and toe portions 131, 132 of the channel 140 also increase from the center portion 130 toward the heel 120 and toe 122, respectively. In this configuration, the narrowest portions of the heel and toe portions 131, 132 are immediately adjacent the ends 133, 134 of the center portion 130. Additionally, in this configuration, the portions of the heel and toe portions 131, 132 are immediately adjacent the ends 133, 134 of the center portion 130 are shallower than other locations more proximate the heel 120 and toe 122, respectively.

Further, in the embodiment shown in FIGS. 2, 3, and 8, the front edge 146 at the heel and toe portions 131, 132 is generally parallel to the adjacent edges 114 of the face 112, while the rear edge 148 angles or otherwise diverges away from the edges 114 of the face 112 at the heel and toe portions 131, 132. In one embodiment, the access 128 for the adjustable hosel 109 connecting structure 129 may be in communication with and/or may intersect the channel 140, such as in the head 102 illustrated in FIGS. 2 and 8, in which the access 128 is in communication with and intersects the heel portion 131 of the channel 140. The access 128 in this embodiment includes an opening 123 within the channel 140 that receives a part of the hosel interconnection structure 129, and a wall 127 is formed adjacent the access 128 to at least partially surround the opening 123. In one embodiment, the wall 127 extends completely across the heel portion 131 of the channel 140, and the wall 127 is positioned between the opening 123 and the heel 120 and/or the heel end 142 of the channel 140. In the embodiment illustrated in FIGS. 2, 3, and 8, the wall 127 extends rearwardly from the front edge 146 of the channel 140 and then jogs away from the heel 120 to intersect with the rear edge 148 of the channel 140. The wall 127 may have a different configuration in other embodiments, such as extending only partially across the channel 140 and/or completely surrounding the opening 123. In other embodiments, the channel 140 may be oriented and/or positioned differently. For example, the channel 140 may be oriented adjacent to a different portion of edge 114 of the face 112, and at least a portion of the channel 140 may be parallel or generally parallel to one or more of the edges of the face 112. The size and shape of the compression channel 140 also may vary widely without departing from this invention.

The channel 140 is substantially symmetrically positioned on the head 102 in the embodiment illustrated in FIGS. 1-15, such that the center portion 130 is generally symmetrical with respect to a vertical plane passing through the geometric centerline of the sole 118 and/or the body 108, and the midpoint of the center portion 130 may also be coincident with such a plane. For example, the midpoint of the center portion 130 may be offset towards a toe side of the head 122 compared to the face center 40, such that the midpoint of the center portion 130 may be offset approximately 7 mm or within a range of 4 mm to 10 mm. However, in another embodiment, the center portion 130 may additionally or alternately be symmetrical with respect to a vertical plane (generally normal to the face 112) passing through the face center 40 (which may or may not be aligned the geometric center of the sole 118 and/or the body 108), and the midpoint of the center portion 130 may also be coincident with such a plane. This arrangement and alignment may be different in other embodiments, depending at least in part on the degree of geometry and symmetry of the body 108 and the face 112. For example, in another embodiment, the center portion 130 may be asymmetrical with respect to one or more of the planes discussed above, and the midpoint may not coincide with such plane(s). This configuration can be used to vary the effects achieved for impacts on desired portions of the face 112 and/or to compensate for the effects of surrounding structural features on the impact properties of the face 112.

The center portion 130 of the channel 140 in this embodiment has an asymmetric cross-sectional shape or profile to help manage the stresses and flexing of the channel, with a trough 150 and an inward sloping depending front wall 151 and an inward sloping depending rear wall 152 extending from the trough 150 to the respective edges 146, 148 of the channel 140. The trough 150 forms the deepest (i.e. most inwardly-recessed) portion of the channel 140 in this embodiment. It is understood that the center portion 130 may have a different cross-sectional shape or profile, such as having a sharper and/or more polygonal (e.g. rectangular) shape in another embodiment. Additionally, the front wall 151 may have a length 155 measured from the front edge 146 to a center point of the trough 150. Similarly, the rear wall 152 may have a length 157 measured from the rear edge 148 to a center point of the trough 150. The length 155 of the front wall 151 may be greater than the length 157 of the rear wall 152 and may have a ratio of the length 155 of the front wall 151 to the length 157 to the rear wall 152 of approximately 3.3:1 or within a range of 2.5:1 to 4.0:1, or within a range of 1.5:1 to 5.0:1. Alternatively, the length 157 of the rear wall 152 may be greater than the length 155 of the front wall 151 and may have a ratio of the length 157 of the rear wall 152 to the length 155 to the front wall 151 of approximately 3.3:1 or within a range of 2.5:1 to 4.0:1, or within a range of 1.5:1 to 5.0:1.

The front wall 151 and rear wall 152 form an angle 159. Angle 159 may be an acute angle or alternatively may be an obtuse angle. Angle 159 may be approximately 85 degrees or may be within a range of 75 degrees to 90 degrees or within a range of 90 to 120.

Additionally, as described above, the center portion 130 of the channel 140 may have a generally constant depth across the entire length, i.e., between the ends 133, 134 of the center portion 130. In another embodiment, the center portion 130 of the channel 140 may generally increase in depth D so that the trough 150 has a greater depth at and around the midpoint of the center portion 130 and is shallower more proximate the ends 133, 134.

Further, in one embodiment, the wall thickness T of the channel 140 may be increased, as compared to the thickness at other locations of the body 108, to handle the stresses at the channel 140. In one embodiment, the wall thickness(es) T in the channel 140 (or different portions thereof) may be from 0.3 mm to 2.0 mm, or from 0.6 mm to 1.8 mm in another embodiment.

The wall thickness T may also vary at different locations within the channel 140. For example, in one embodiment, the wall thickness T is slightly greater at the center portion 130 of the channel 140 with a thickness of approximately 1.2 mm than at the heel and toe portions 131, 132 having a thickness of approximately 0.9 mm. A ratio of the thickness at the center portion 130 of the channel 140 to the thickness of the heel and toe portions 131, 132 may be within a range of 1.2:1 and 1.5:1. In a different embodiment, the wall thickness may be smaller at the center portion 130, as compared to the heel and toe portions 131, 132. The wall thickness T in either of these embodiments may gradually increase or decrease to create these differences in wall thickness in one embodiment. The wall thickness T in the channel 140 may have one or more "steps" in wall thickness to create these differences in wall thickness in another embodiment, or the channel 140 may have a combination of gradual and step changes in wall thickness. In a further embodiment, the entire channel 140, or at least the majority of the channel 140, may have a consistent wall thickness T. It is understood that any of the embodiments in FIGS. 1-33 may have any of these wall thickness T configurations.

Figure 12:
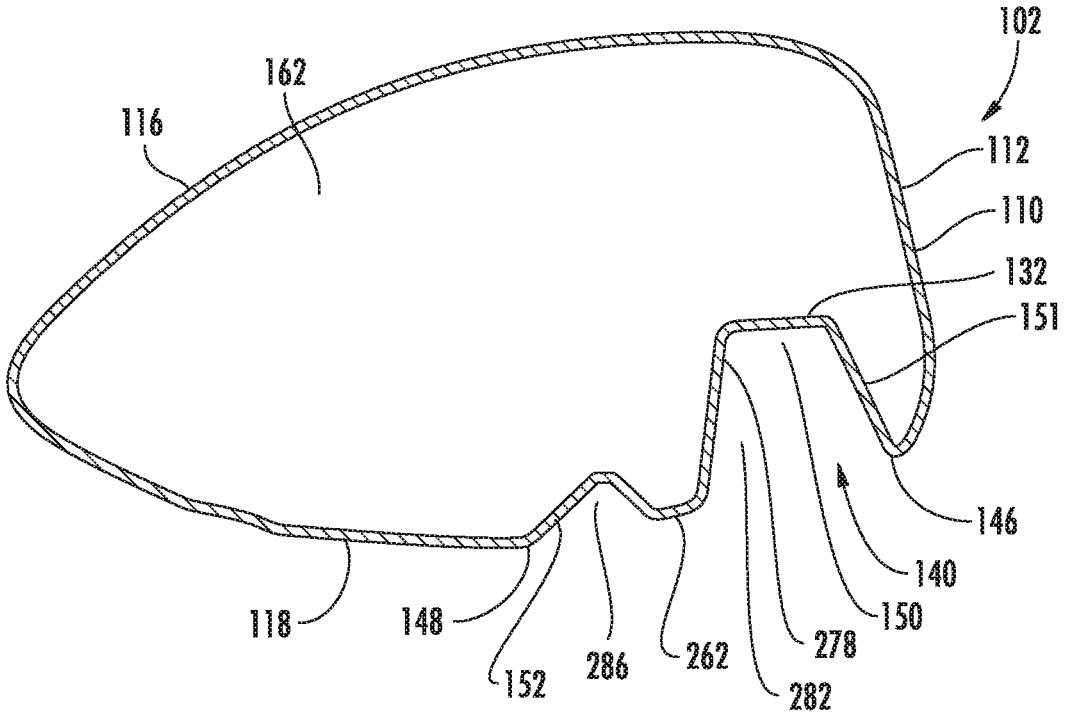
FIG. 12 is a cross-section view taken along line 12-12 of FIG. 8.
Figure 13:
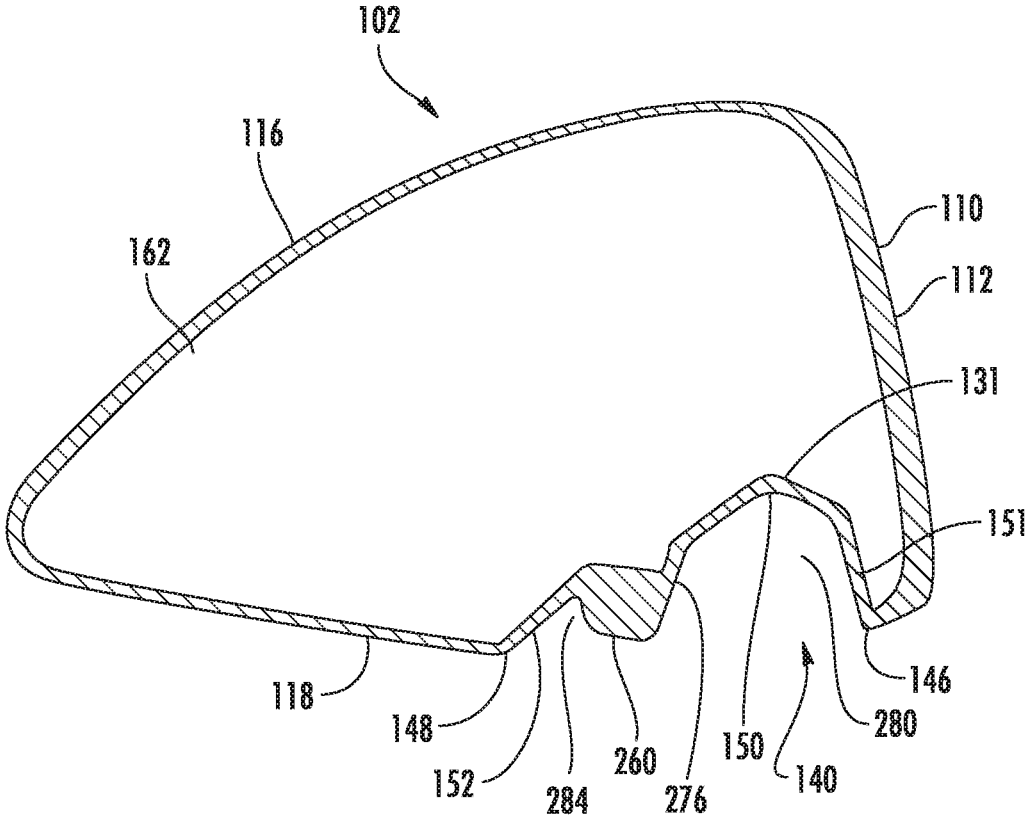
FIG. 13 is a cross-section view taken along line 13-13 of FIG. 8.

The heel and toe portions 131, 132 of the channel 140 may have different cross-sectional shapes and/or profiles than the center portion 130. For example, as seen in FIGS. 12 and 13, the heel and toe portions 131, 132 have a more angular and trapezoidal cross-sectional shape as compared to the center portion 130, which has an asymmetric triangular, semicircular or other curvilinear cross-sectional shape. In other embodiments, the center portion 130 may also be angularly shaped, such as by having a rectangular or trapezoidal cross section, and/or the heel and toe portions 131, 132 may have a more smoothly-curved and/or semi-circular cross-sectional shape.

Channel Ribs/Heel and Toe Design

In addition, the heel and toe portions 131, 132 of the channel 140 may have a plurality of ribs 260, 262 positioned within heel and toe portions of the channel 140. The ribs 260, 262 may provide an area of localized stiffness or resistance within the channel to improve the ability of the heel and toe portions 131, 132 to flex during golf ball impacts. The ribs 260, 262 may be connected to the rear wall 152 of the heel and toe portions 131, 132. The ribs may extend into the channel and connect to the front wall 151. The ribs 260, 262 may additionally connect to the rear edge 148, but may be free of any connection to the front edge 146. The plurality of ribs 260, 262 may separate the trough 150 of the channel on the heel and toe portions 131, 132 into forward portions 280, 282 and rear portions 284, 286 with each respective forward portion 280, 282 having a different depth, D, than each rear respective portion 284, 286 as shown in FIGS. 2 and 12-15. Conversely, each respective forward portion 280, 282 may have the same depth, D, of each rear respective portion 284, 286.

Each of the ribs 260, 262 have front portions 264, 266 towards the front 124 of the body 108 extending which may connect to the exterior of the front wall 151 of the channel 140. Each of the ribs 260, 262 also has rear portions 268, 270 which may connect to either the rear edge 148 or the rear wall 152 of the channel 140. The ribs 260, 262 may also include upper portions 272, 274 extending to the edge of the rib and lower portions 276, 278 extending to the edge of the rib. As shown in FIG. 2, the upper portions 272, 274 of ribs 260, 262 may be curved, generally forming a convex curved shape. In other embodiments the upper portions 272, 274 may have a concave curved shape, straight shape, or any other shape. The lower portions 276, 278 of the ribs may connect to the channel 140.

Each rib 260, 262 also has a first side and a second side and a rib width defined there between. The width of the rib can affect the strength and weight of the golf club. The ribs 260, 262 may have a variable width where the width at the upper portion 272, 274 is less than the lower portion 276, 278 such that the width tapers getting smaller as it transitions from the lower portion to the upper portion. The width of the rib may be in the range of approximately 4.0 mm to 14.0 mm. Alternatively, the width of the rib may be substantially constant. In addition, the ribs 260, 262 may have a hollow portion to or may be solid, or may be a configuration where one rib for example rib 262 has a hollow portion and rib 260 may be solid. Additionally, in other embodiments, the ribs 260, 262 may have a thinner width portion throughout the majority or a center portion of the rib and a thicker width portion. The thicker width portion can be near the front portions 264, 266, rear portions 268, 270, upper portions 272, 274, or lower portions 276, 278, or any other part of the rib. The thickness of the thicker width portion can be approximately 2 to 3 times the width of the thinner portion.

Each rib 260, 262 may also have a maximum height measured from the upper portion 272, 274 to the connection of the rib 260, 262 to the channel 140 along the rib in the Z-axis 18 direction. If the heel and toe portions 131, 132 of the channel 140 have a forward trough 280, 282 and a rear trough 284, 286 of different depths, the maximum height may be measured on the side of the forward trough 280, 282. The maximum height of ribs 260,262 may be approximately 10 mm and may be in the range of approximately 3 mm to 16 mm. Each rib 260, 262 may have a height at the rear portion 268, 270 greater than a height at the front portion 264, 266. Additionally, each rib 260, 262 may also have a maximum length, measured along the length of the rib at its longest length. The maximum length of ribs 260, 262 may be in the range of approximately 10 mm to 30 mm.

While only two ribs 260, 262 are shown, any number of ribs may be included on the golf club. It is understood that the ribs may extend at different lengths, widths, heights, and angles and have different shapes to achieve different weight distribution and performance characteristics of the golf club head.

The ribs 260, 262 may be formed of a single, integrally formed piece, e.g., by casting with the sole 118. Such an integral piece may further include other components of the body 108, such as the entire sole 118 (including the channel 140) or the entire club head body 108. In other embodiments the ribs 260, 262 may be connected to the channel 140 by welding or other integral joining technique to form a single piece.

In this configuration, the ribs 260, 262 diverge away from one another. As shown in FIG. 8, the angle of the ribs 260, 262 measured perpendicular to the striking face 112 (or from the Y-axis direction 16) may be approximately 75 degrees, or may be in the range of 45 degrees to 85 degrees. In other configurations, the ribs 260, 262 may converge toward one another or may be substantially straight in the Y-axis 16 direction.

The ribs 260, 262 may be located anywhere in the channel and may be equally or unequally spaced. While only two ribs 260, 262 are shown, any number of ribs can be included on the golf club. It is understood that the ribs may extend at different lengths, widths, heights, and angles and have different shapes to achieve different weight distribution and performance characteristics.

In the driver embodiment shown in FIGS. 1-17, the channel 140 is spaced from the bottom edge 114 of the face 112, with a spacing portion 154 defined between the front edge 146 of the channel 140 and the bottom edge 114. The spacing portion 154 is located immediately adjacent the channel 140 and junctures with one of the side walls 152 of the channel 140 along the front edge 146 of the channel 140, as shown in FIGS. 2 and 7-13. In this embodiment, the spacing portion 154 is oriented at an angle 156 to the loft angle 48 of ball striking surface 110 and extends rearward from the bottom edge 114 of the face 112 to the channel 140. In various embodiments, the spacing portion 154 may be oriented with respect to the ball striking surface 110 at an acute (i.e. <90 degrees), obtuse (i.e. >90 degrees), or right angle. For example, angle 156 may be approximately 85 degrees, and may be within a range of 80 degrees to 90 degrees, or 70 degrees to 120 degrees. In other embodiments, the spacing portion 154 may be oriented at a right angle or an obtuse angle to the ball striking surface 110. Force from an impact on the face 112 can be transferred to the channel 140 through the spacing portion 154.

The front edge 146 of the channel 140 may be positioned at a distance S as illustrated in FIGS. 11 and 11A. The front edge 146 may have a different distance S than shown in FIGS. 2 and 11. The distance S may be larger when measured in the direction of the Y-axis 16 at the center portion of the channel 140 than on the heel and toe portions 131, 132 or the spacing S may be the same dimension to the center, heel and toe portions 131, 132. Alternatively, the spacing S may be smaller when measured in the direction of the Y-axis 16 at the center portion of the channel 140 than on the heel and toe portions 131, 132.

In one embodiment, part or the entire channel 140 may have surface texturing or another surface treatment, or another type of treatment that affects the properties of the channel 140. For example, certain surface treatments, such as peening, coating, etc., may increase the stiffness of the channel and reduce flexing. As another example, other surface treatments may be used to create greater flexibility in the channel 140. As a further example, surface treatments may increase the smoothness of the channel 140 and/or the smoothness of transitions (e.g. the edges 146, 148) of the channel 140, which can influence aerodynamics, interaction with playing surfaces, visual appearance, etc. Further surface texturing or other surface treatments may be used as well. Examples of such treatments that may affect the properties of the channel 140 include heat treatment, which may be performed on the entire head 102 (or the body 108 without the face 112), or which may be performed in a localized manner, such as heat treating of only the channel 140 or at least a portion thereof. Cryogenic treatment or surface treatments may be performed in a bulk or localized manner as well. Surface treatments may be performed on either or both of the inner and outer surfaces of the head 102 as well.

The compression channel 140 of the head 102 shown in FIGS. 1-17 can influence the impact of a ball (not shown) on the face 112 of the head 102. In one embodiment, the channel 140 can influence the impact by flexing and/or compressing in response to the impact on the face 112, which may influence the stiffness/flexibility of the impact response of the face 112. For example, when the ball impacts the face 112, the face 112 flexes inwardly. Additionally, some of the impact force is transferred through the spacing portion 154 to the channel 140, causing the sole 118 to flex at the channel 140. This flexing of the channel 140 may assist in achieving greater impact efficiency and greater ball speed at impact. The more gradual impact created by the flexing also creates a longer impact time, which can also result in greater energy and velocity transfer to the ball during impact. Further, because the channel 140 extends into the heel 120 and toe 122, the head 102 higher ball speed for impacts that are away from the center or traditional "sweet spot" of the face 112. It is understood that one or more channels 140 may be additionally or alternately incorporated into the crown 116 and/or sides 120, 122 of the body 108 in order to produce similar effects. For example, in one embodiment, the head 102 may have one or more channels 140 extending completely or substantially completely around the periphery of the body 108, such as shown in U.S. patent application Ser. No. 13/308,036, filed Nov. 30, 2011, which is incorporated by reference herein in its entirety.

In one embodiment, the center portion 130 of the channel 140 may have different stiffness than other areas of the channel 140 and the sole 118 in general, and contributes to the properties of the face 112 at impact in one embodiment. For example, in the embodiment of FIGS. 1-15, the center portion 130 of the channel 140 is less flexible than the heel and toe portions 131, 132, due to differences in geometry, wall thickness, etc., as discussed elsewhere herein. The portions of the face 112 around the center 40 are generally the most flexible, and thus, less flexibility from the channel 140 is needed for impacts proximate the face center 40. The portions of the face 112 more proximate the heel 120 and toe 122 are generally less flexible, and thus, the heel and/or toe portions 131, 132 of the channel 140 are more flexible to compensate for the reduced flexibility of the face 112 for impacts near the heel 120 and the toe 122. The reduced flexibility of the face 112 for impacts near the heel 120 and the toe 122 permits the club head 102 to transfer more impact energy to the ball and/or increase ball speed on off-center hits, such as by reducing energy loss due to ball deformation. In another embodiment, the center portion 130 of the channel 140 may be more flexible than the heel and toe portions 131, 132, to achieve different effects. The flexibility of various portions of the channel 140 may be configured to be complementary to the flexibility and/or dimensions (e.g., height, thickness, etc.) of adjacent portions of the face 112, and vice versa. It is understood that certain features of the head 102 (e.g. the access 128) may influence the flexibility of the channel 140. It is also understood that various structural features of the channel 140 and/or the center portion 130 thereof may influence the impact properties achieved by the club head 102, as well as the impact response of the face 112, as described elsewhere herein. For example, smaller width W, smaller depth D, and larger wall thickness T can create a less flexible channel 140 (or portion thereof), and greater width W, greater depth D, and smaller wall thickness T can create a more flexible channel 140 (or portion thereof). Use of different structural materials and/or use of filler materials in different portions of the head 102 or different portions of the channel 140 can also create different flexibilities. It is understood that other structural features on the head 102 other than the channel 140 may influence the flexibility of the channel 140, such as the thickness of the sole 118 and/or the various structural ribs described elsewhere herein.

The relative dimensions of portions of the channel 140, the face 112, and the adjacent areas of the body 108 may influence the overall response of the head 102 upon impacts on the face 112, including ball speed, twisting of the club head 102 on off-center hits, spin imparted to the ball, etc. For example, a wider width W channel 140, a deeper depth D channel 140, a smaller wall thickness T at the channel 140, a smaller space S between the channel 140 and the face 112, and/or a greater face height 56 of the face 112 can create a more flexible impact response on the face 112. Conversely, a narrower width W channel 140, a shallower depth D channel 140, a greater wall thickness T at the channel 140, a larger space S between the channel 140 and the face 112, and/or a smaller face height 56 of the face 112 can create a more rigid impact response on the face 112. The length of the channel 140 and/or the center portion 130 thereof can also influence the impact properties of the face 112 on off-center hits, and the dimensions of these other structures relative to the length of the channel may indicate that the club head has a more rigid or flexible impact response at the heel and toe areas of the face 112. Thus, the relative dimensions of these structures can be important in providing performance characteristics for impact on the face 112, and some or all of such relative dimensions may be critical in achieving desired performance. Some of such relative dimensions are described in greater detail below. In one embodiment of a club head 102 as shown in FIGS. 1-15, the length (heel to toe) of the center portion 130 is approximately 40.0 mm. It is understood that the properties described below with respect to the center portion 130 of the channel 140 (e.g., length, width W, depth D, wall thickness T) correspond to the dimension that is measured on a vertical plane extending through the face center FC 40, and that the center portion 130 of the channel 140 may extend farther toward the heel 120 and the toe 122 with these same or similar dimensions, as described above. It is also understood that other structures and characteristics may also affect the impact properties of the face 112, including the thickness of the face 112, the materials from which the face 112, channel 140, or other portions of the head 102 are made, the stiffness or flexibility of the portions of the body 108 behind the channel 140, any internal or external rib structures, etc.

The channel 140 may have a center portion 130 and heel and toe portions 131, 132 on opposed sides of the center portion 130, as described above. In one embodiment, the center portion 130 has a substantially constant width (front to rear), or in other words, may have a width that varies no more than +/−10% across the entire length (measured along the heel 120 to toe 122 direction) of the center portion 130. The ends 133, 134 of the center portion 130 may be considered to be at the locations where the width begins to increase and/or the point where the width exceeds +/−10% difference from the width W along a vertical plane passing through the face center FC. In another embodiment, the width W of the center portion 130 may vary no more than +/−5%, and the ends 133, 134 may be considered to be at the locations where the width exceeds +/−5% difference from the width W along a vertical plane passing through the geometric centerline of the sole 118 and/or the body 108. The center portion 130 may also have a depth D and/or wall thickness T that substantially constant and/or varies no more than +/−5% or 10% along the entire length of the center portion 130. The embodiments shown in FIGS. 17-33 and described elsewhere herein may have channels 140 with center portions 130 that are defined in the same manner(s) as described herein with respect to the embodiment of FIGS. 1-15.

Figure 17:
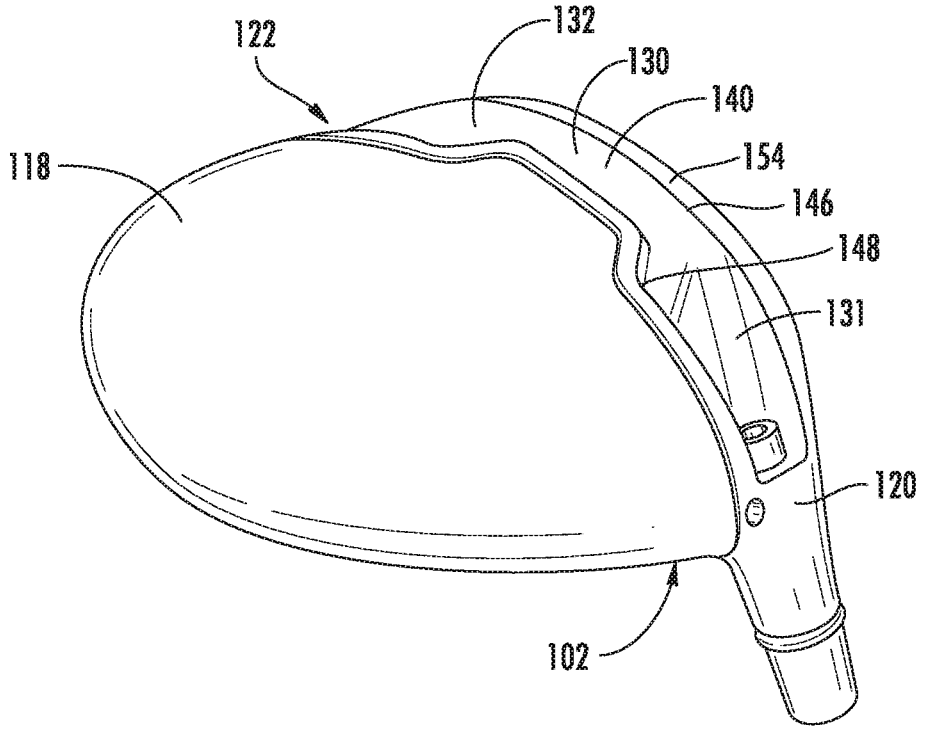
FIG. 17 is a bottom right rear perspective view of an another embodiment of a golf club head according to aspects of this disclosure, in the form of a golf driver.

In one embodiment of a club head 102 as shown in FIGS. 1-15, the depth D of the center portion 130 of the channel may be approximately 3.0 mm, or may be in the range of 2.5 to 3.5 mm, or may be within a range of 2.0 to 5.0 mm in another embodiment. Additionally, in one embodiment of a club head 102 as shown in FIGS. 1-15, the width W of the center portion 130 of the channel 140 may be approximately 10 mm, or may be in the range of 8.0 to 12.0 mm in another embodiment. In one embodiment of a club head 102 as shown in FIGS. 1-15, the rearward spacing S of the center portion 130 of the channel 140 from the face 112 may be approximately 8 mm. In these embodiments, the depth D, the width W, and the spacing S do not vary more than +/−5% or +/−10% over the entire length of the center portion 130. The club head 102 as shown in FIG. 17 may have a channel 140 with a center portion 130 having similar width W, depth D, and spacing S in one embodiment. It is understood that the channel 140 may have a different configuration in another embodiment.

The club head 102 in any of the embodiments described herein may have a wall thickness T in the channel 140 that is different from the wall thickness T at other locations on the body 108 and/or may have different wall thicknesses at different portions of the channel 140. The wall thickness T at any point on the club head 102 can be measured as the minimum distance between the inner and outer surfaces, and this measurement technique is considered to be implied herein, unless explicitly described otherwise. Wall thicknesses T in other embodiments (e.g., as shown in FIGS. 17-33) may be measured using these same techniques. In the embodiment illustrated in FIGS. 1-15, the wall thickness T is greater at the center portion 130 of the channel 140 than at the heel and toe portions 131, 132. This smaller wall thickness T at the toe portion 132 helps to compensate for the smaller face height 56 toward the toe 122, in order to increase the response of the face 112. In general, the wall thickness T is a constant thickness and is approximately 1.25 to 1.75 times thicker, or approximately 1.5 times thicker, in the center portion 130 as compared to the toe portion 132. In the embodiment of FIGS. 1-15, the wall thickness in the center portion 130 of the channel 140 may be approximately 1.2 mm or 1.0 to 1.4 mm, and the wall thickness T in the toe portion 132 (or at least a portion thereof) may be approximately 0.9 mm or 0.7 to 1.0 mm.

Alternatively, areas of the center portion 130 may have a variable thickness. The variable thicknesses may be approximately 1.5 to 3.25 times thicker than the toe portion 132. The front edge 146 of the center portion 130 of the channel may have a wall thickness T that is approximately 1.8 mm or 1.7 to 1.9 mm, and the wall thickness T may decrease to approximately 1.1 mm at the trough 150. The wall thickness T may be generally constant between the trough 150 and the rear edge 148.

The wall thickness T in the embodiment in FIGS. 1-15 is greater in at least some areas of the heel portion 131, as compared to the center portion 130, in order to provide increased structural strength for the hosel interconnection structure that extends through the sole 118 of the head 102. For example, the wall thickness T of the heel portion 131 may be greater in the areas surrounding the access 128. Other areas of the heel portion 131 may have a wall thickness T similar to that of the center portion 130 or the toe portion 132. In one embodiment, the wall thickness T in the heel portion 131 is greatest at the trough 150 and is smaller (e.g., similar to that of the toe portion 132) at the rear wall 152 that extends from the trough 150 to the rear edge 148. The wall thickness T at the center portion 130 is also greater than the wall thickness in at least some other portions of the sole 118. It is understood that "wall thickness" T as referred to herein may be considered to be a target or average wall thickness at a specified area.

The various dimensions of the center portion 130 of the channel 140 of the club head 102 in FIGS. 1-16 may have relative dimensions with respect to each other that may be expressed by ratios. In one embodiment, the channel 140 has a width W and a wall thickness T in the center portion 130 that are in a ratio of approximately 7.5:1 to 9.5:1 (width/thickness). In one embodiment, the channel 140 has a width W and a depth D in the center portion 130 that are in a ratio of approximately 2.5:1 to 4.5:1 (width/depth). In one embodiment, the channel 140 has a depth D and a wall thickness T in the center portion 130 that are in a ratio of approximately 2.0:1 to 3.0:1 (depth/thickness). In one embodiment, the center portion 130 of the channel 140 has a length and a width W that are in a ratio of approximately 3:1 to 5:1 (length/width). In one embodiment, the face 112 has a face width (heel to toe) and the center portion 130 of the channel 140 has a length (heel to toe) that are in a ratio of 2.5:1 to 3.5:1 (face width/channel length). The edges of the striking surface 110 for measuring face width may be located in the same manner used in connection with United States Golf Association (USGA) standard measuring procedures from the "Procedure for Measuring the Flexibility of a Golf Clubhead", USGA TPX-3004, Revision 2.0, Mar. 25, 2005. In other embodiments, the channel 140 may have structure with different relative dimensions.

Void Structure of Club Head

The club head 102 may utilize a geometric weighting feature in some embodiments, which can provide for reduced head weight and/or redistributed weight to achieve desired performance. For example, in the embodiment of FIGS. 1-15, the head 102 has a void 160 defined in the body 108, and may be considered to have a portion removed from the body 108 to define the void 160. In one embodiment, as shown in FIGS. 2 and 8, the sole 118 of the body 108 has a base member 163 and a first leg 164 and a second leg 165 extending rearward from the base member 163 on opposite sides of the void 160. The base member 163 generally defines at least a central portion of the sole 118, such that the channel 140 extends across the base member 163. The base member 163 may be considered to extend to the bottom edge 114 of the face 112 in one embodiment. As shown in FIGS. 2 and 8, the first leg 164 and the second leg 165 extend away from the base member 163 and away from the ball striking face 112. The first leg 164 and the second leg 165 in this embodiment extend respectively towards the rear 126 of the club at the heel 120 and toe 122 of the club head 102. Additionally, in the embodiment of FIGS. 2 and 8, an interface area 168 is defined at the location where the legs 164, 165 meet, and the legs 164, 165 extend continuously from the interface area 168 outwardly towards the heel 120 and toe 122 of the club head 102. It is understood that the legs 164, 165 may extend at different lengths to achieve different weight distribution and performance characteristics. The width of the base member 163 between the channel 140 and the interface area 168 may contribute to the response of the channel through impact. This base member width can be approximately 18 mm, or may be in a range of 11 to 25 mm.

In one embodiment the void 160 is generally V-shaped, as illustrated in FIGS. 1A and 8. In this configuration, the legs 164, 165 converge towards one another and generally meet at the interface area 168 to define this V-shape. The void 160 has a wider dimension at the rear 126 of the club head 102 and a more narrow dimension proximate a central region of the club head 102 generally at the interface area 168. The void 160 opens to the rear 126 of the club head 102 and to the bottom in this configuration. As shown in FIGS. 2 and 7-10, the void 160 is defined between the legs 164, 165, and has a cover 161 defining the top of the void 160. The cover 161 in this embodiment connects to the crown 116 around the rear 126 of the club head 102 and extends such that a space 162 is defined between the cover 161 and the crown 116. This space 162 is positioned over the void 160 and may form a portion of the inner cavity 106 of the club head 102 in one embodiment. The inner cavity 106 in this configuration may extend the entire distance from the face 112 to the rear 126 of the club head 102. In another embodiment, at least some of the space 162 between the cover 161 and the crown 116 may be filled or absent, such that the inner cavity 106 does not extend to the rear 126 of the club head 102. The cover 161 in the embodiment of FIGS. 2 and 7-10 also extends between the legs 164, 165 and forms the top surface of the void 160. In a further embodiment, the void 160 may be at least partially open and/or in communication with the inner cavity 106 of the club head 102, such that the inner cavity 106 is not fully enclosed.

In one exemplary embodiment, the base support wall 170 has a height defined between the cover 161 and the sole 118, and is positioned proximate a central portion or region of the body 108 and has a surface that faces into the void 160. The base support wall 170 extends from the cover 161 to the sole 118 in one embodiment. In the embodiment of FIGS. 2 and 8, the first leg 164 defines a first wall 166, and the second leg 165 defines a second wall 167. A proximal end of the first wall 166 connects to one side of the base support wall 170, and a proximal end of the second wall 167 connects to the opposite side of the base support wall 170. The walls 166, 167 may be connected to the base support wall 170, as shown in FIGS. 2 and 8. It is understood that the legs 164, 165 and walls 166, 167 can vary in length and can also be different lengths from each other in other embodiments. External surfaces of the walls 166, 167 face into the void 160 and may be considered to form a portion of an exterior of the golf club head 102.

The walls 166, 167 in the embodiment of FIGS. 2 and 8 are angled or otherwise divergent away from each other, extending outwardly toward the heel 120 and toe 122 from the interface area 168. The walls 166, 167 may further be angled with respect to a vertical plane relative to each other as well. Each of the walls 166, 167 has a distal end portion 169 at the rear 126 of the body 108. In one embodiment, the distal end portions 169 are angled with respect to the majority portion of each wall 166, 167. The distal end portions 169 may be angled inwardly with respect to the majority portions of the walls 166, 167, as shown in the embodiment shown in FIGS. 2 and 8, or the distal end portions 169 may be angled outwardly or not angled at all with respect to the majority portions of the walls 166, 167 in another embodiment. The legs 164, 165 may have similarly angled distal end portions. In the embodiment of FIGS. 2 and 8, the walls 166, 167 (including the distal end portions 169) have angled surfaces 172 proximate the sole 118, that angle farther outwardly with respect to the upper portions 173 of each wall 166, 167 proximate the cover 161. In this configuration, the upper portions 173 of each wall 166, 167 are closer to vertical (and may be substantially vertical), and the angled surfaces 172 angle outwardly to increase the periphery of the void 160 proximate the sole 118. The base support wall 170 in this embodiment has a similar configuration, being closer to vertical with an angled surface 174 angled farther outwardly proximate the sole 118. This configuration of the walls 166, 167 and the base support wall 170 may provide increased strength relative to a completely flat surface. In a configuration such as shown in FIGS. 2 and 8, where the walls 166, 167 and/or the base support wall 170 are angled outwardly, the void 160 may have an upper perimeter defined at the cover 161 and a lower perimeter defined at the sole 118 that is larger than the upper perimeter. In another embodiment, the walls 166, 167 and/or the base support wall 170 may have different configurations. Additionally, the respective heights of the walls 166, 167, and the distal end portions 169 thereof, are greatest proximate the base support wall 170 and decrease towards the rear 126 of the club head 102 in the embodiment shown in FIGS. 2 and 8. This configuration may also be different in other embodiments.

In one embodiment, the walls 166, 167, the base support wall 170, and/or the cover 161 may each have a thin wall construction, such that each of these components has inner surfaces facing into the inner cavity 106 of the club head 102. In another embodiment, one or more of these components may have a thicker wall construction, such that a portion of the body 108 is solid. Additionally, the walls 166, 167, the base support wall 170, and the cover 161 may all be integrally connected to the adjacent components of the body 108, such as the base member 163 and the legs 164, 165. For example, at least a portion of the body 108 including the walls 166, 167, the base support wall 170, the cover 161, the base member 163, and the legs 164, 165 may be formed of a single, integrally formed piece, e.g., by casting. Such an integral piece may further include other components of the body 108, such as the entire sole 118 (including the channel 140) or the entire club head body 108. As another example, the walls 166, 167, the base support wall 170, and/or the cover 161 may be connected to the sole 118 by welding or other integral joining technique to form a single piece. In another embodiment, the walls 166, 167, the base support wall 170, and/or the cover 161 may be formed of separate pieces.

An angle may be defined between the legs 164, 165 in one embodiment, which angle can vary in degree, and may be, e.g., a right angle, acute angle or obtuse angle. For example, the angle can be in the general range of 30 degrees to 110 degrees, and more specifically 45 degrees to 90 degrees. The angle between the legs 164, 165 may be relatively constant at the sole 118 and at the cover 161 in one embodiment. In another embodiment, this angle may be different at a location proximate the sole 118 compared to a location proximate the cover 161, as the walls 166, 167 may angle or otherwise diverge away from each other. Additionally, in other embodiments, the void 160 may be asymmetrical, offset, rotated, etc., with respect to the configuration shown in FIGS. 1-15, and the angle between the legs 164, 165 in such a configuration may not be measured symmetrically with respect to the vertical plane passing through the center(s) of the face 112 and/or the body 108 of the club head 102. It is understood that the void 160 may have a different shape in other embodiments, and may not have a V-shape and/or a definable "angle" between the legs 164, 165.

In another embodiment, the walls 166, 167 may be connected to the underside of the crown 116 of the body 108, such that the legs 164, 165 depend from the underside of the crown 116. In other words, the cover 161 may be considered to be defined by the underside of the crown 116. In this manner, the crown 116 may be tied or connected to the sole 118 by these structures in one embodiment. It is understood that the space 162 between the cover 161 and the underside of the crown 116 in this embodiment may be partially or completely nonexistent.

Fairway Wood-Channel Parameters

FIGS. 18-26 illustrate an additional embodiment of a golf club head 102 in the form of a fairway wood golf club head. The heads 102 of FIGS. 18-26 include many features similar to the head 102 of FIGS. 1-15, and such common features are identified with similar reference numbers. For example, the head 102 of FIGS. 18-26 has a channel 140 that is similar to the channels 140 in the embodiments of FIGS. 1-17, having a center portion 130 with a generally constant width W and depth D and heel and toe portions 131, 132 with increased width and/or depth. Generally, the center portions 130 of the channels 140 in the heads 102 of these embodiments are deeper and more recessed from the adjacent surfaces of the body 108, as compared to the channels 140 in the embodiments of FIGS. 1-17. In this embodiment, the head 102 has a face that has a smaller height than the faces 112 of the heads 102 in FIGS. 1-17, which tends to reduce the amount of flexibility of the face 112. In one embodiment, the face height 56 of the heads 102 in FIGS. 18-26 may range from 28 to 40 mm. The deeper recess of the center portion 130 of the channel 140 in this embodiment results in increased flexibility of the channel 140, which helps to offset the reduced flexibility of the face 112 due to the lower face height compared to a driver embodiment. Conversely, the heel and toe portions 131, 132 of the channel 140 in the embodiment of FIGS. 18-26 are shallower in depth D than the heel and toe portions 131, 132 of the embodiments of FIGS. 1-17, and may have equal or even smaller depth D than the center portion 130. The heel and toe portions 131, 132 in this embodiment may have greater flexibility than the center portion 130, e.g., due to smaller wall thickness T, greater width W, and/or greater depth D at the heel and toe portions 131, 132 of the channel. This assists in creating a more flexible impact response on the off-center areas of the face 112 toward the heel 120 and toe 122, as described above. Other features may further be used to increase or decrease overall flexibility of the face 112, as described above. The face 112 of the head 102 in FIGS. 18-26 may be made of steel, which has higher strength and higher modulus of elasticity than titanium, but with a lower face thickness to offset the reduced flexibility resulting from the higher strength material. As another example, the club head 102 of FIGS. 18-24 includes a void 160 defined between two legs 164, 165, with a cover 161 defining the top of the void 160, similar to the embodiment of FIGS. 1-15.

In one embodiment of a club head 102 as shown in FIGS. 18-26, the depth D of the center portion 130 of the channel may be approximately 9.0 mm, or may be in the range of 8.0 to 10.0 mm in another embodiment. Additionally, in one embodiment of a club head 102 as shown in FIGS. 18-26, the width W of the center portion 130 of the channel 140 may be approximately 9.0 mm, or may be in the range of 8.0 to 10.0 mm in another embodiment. In one embodiment of a club head 102 as shown in FIGS. 18-26, the rearward spacing S of the center portion 130 of the channel 140 from the face 112 may be approximately 8.0 mm, or may be approximately 10.0 mm in another embodiment. In these embodiments, the depth D, the width W, and the spacing S do not vary more than +/−5% or +/−10% over the entire length of the center portion 130. It is understood that the channel 140 may have a different configuration in another embodiment.

In the embodiment illustrated in FIGS. 18-26, the wall thickness T is greater at the center portion 130 of the channel 140 than at the heel and toe portion 131, 132. This smaller wall thickness T at the heel and toe portions 131, 132 helps to compensate for the smaller face height 56 toward the heel and toe 120, 122, in order to increase the response of the face 112. In general, the wall thickness T in this embodiment is approximately 1.25 to 2.25 times thicker in the center portion 130 as compared to the toe portion 132, or approximately 1.7 times thicker in one embodiment. In one example, the wall thickness T in the center portion 130 of the channel 140 may be approximately 1.6 mm or 1.5 to 1.7 mm, and the wall thickness T in the heel and toe portions 131, 132 may be approximately 0.95 mm or 0.85 to 1.05 mm. These wall thicknesses T are generally constant throughout the center portion 130 and the heel and toe portions 131, 132, in one embodiment. The wall thickness T at the center portion 130 in the embodiment of FIGS. 18-26 is also greater than the wall thickness T in at least some other portions of the sole 118 in one embodiment, including the areas of the sole 118 located immediately adjacent to the rear edge 148 of the center portion 130.

The various dimensions of the center portion 130 of the channel 140 of the club head 102 in FIGS. 18-26 may have relative dimensions with respect to each other that may be expressed by ratios. In one embodiment, the channel 140 has a width D and a wall thickness T in the center portion 130 that are in a ratio of approximately 5:1 to 6.5:1 (width/thickness). In one embodiment, the channel 140 has a width W and a depth D in the center portion 130 that are in a ratio of approximately 0.8:1 to 1.2:1 (width/depth). In one embodiment, the channel 140 has a depth D and a wall thickness T in the center portion 130 that are in a ratio of approximately 5:1 to 6.5:1 (depth/thickness). In one embodiment, the center portion of the channel 140 has a length and a width W that are in a ratio of approximately 4:1 to 4.5:1 (length/width). In one embodiment, the face 112 has a face width (heel to toe) and the center portion 130 of the channel 140 has a length (heel to toe) that are in a ratio of 1.5:1 to 2.5:1 (face width/channel length). In other embodiments, the channel 140 may have structure with different relative dimensions.

Hybrid Club Head-Channel Parameters

FIGS. 27-33 illustrate an additional embodiment of a golf club head 102 in the form of a hybrid golf club head. The head 102 of FIGS. 27-33 includes many features similar to the heads 102 of FIGS. 1-26, and such common features are identified with similar reference numbers. For example, the head 102 of FIGS. 27-33 has a channel 140 that similar to the channels 140 in the embodiments of FIGS. 1-26, having a center portion 130 with a generally constant width W and depth D and heel and toe portions 131, 132 with increased width W and/or depth D. Generally, the center portion 130 of the channel 140 in the head 102 of this embodiment is deeper and more recessed from the adjacent surfaces of the body 108, as compared to the channels 140 in the embodiments of FIGS. 1-17. In this embodiment, the head 102 has a face that has a smaller height than the faces 112 of the heads 102 in FIGS. 1-17, which tends to reduce the amount of flexibility of the face 112. In one embodiment, the face height 56 of the head 102 in FIGS. 27-33 may range from 28-40 mm. The deeper recess of the center portion 130 of the channel 140 in this embodiment results in increased flexibility of the channel 140, which helps to offset the reduced flexibility of the face 112. Conversely, the heel and toe portions 131, 132 of the channel 140 in the embodiment of FIGS. 27-33 are shallower in depth D than the heel and toe portions 131, 132 of the embodiments of FIGS. 1-17, and may have equal or even smaller depth D than the center portion 130. The heel and toe portions 131, 132 in this embodiment have greater flexibility than the center portion 130, e.g., due to smaller wall thickness T, greater width W, and/or greater depth D at the heel and toe portions 131, 132 of the channel. This assists in creating a more flexible impact response on the off-center areas of the face 112 toward the heel 120 and toe 122, as described above. Other features may further be used to increase or decrease overall flexibility of the face 112, as described above. The face 112 of the head 102 in FIGS. 27-33 may be made of steel, which has higher strength and higher modulus of elasticity than titanium, but with lower face thickness to offset the reduced flexibility resulting from the higher strength material.

In one embodiment of a club head 102 as shown in FIGS. 27-33, the depth D of the center portion 130 of the channel may be approximately 9.0 mm, or may be in the range of 7.0 to 10.0 mm in another embodiment. Additionally, in another embodiment of a club head 102 the width W of the center portion 130 of the channel 140 may be approximately 8.0 mm, or may be in the range of 7.0 to 9.0 mm in another embodiment. In one embodiment of a club head 102 as shown in FIGS. 27-33, the rearward spacing S of the center portion 130 of the channel 140 from the face 112 may be approximately 9.0 mm, or may be approximately 7.0 mm in another embodiment. In these embodiments, the depth D, the width W, and the spacing S do not vary more than +/−5% or +/−10% over the entire length of the center portion 130. It is understood that the channel 140 may have a different configuration in another embodiment.

In the embodiment illustrated in FIGS. 27-33, the wall thickness T is greater at the center portion 130 of the channel 140 than at the heel and toe portion 131, 132. This smaller wall thickness T at the heel and toe portions 131, 132 helps to compensate for the smaller face height 56 toward the heel and toe 120, 122, in order to increase response of the face 112. In general, the wall thickness T in this embodiment is approximately 1.25 to 2.25 times thicker in the center portion 130 as compared to the toe portion 132, or approximately 1.6 times thicker in one embodiment. In one example, the wall thickness T in the center portion 130 of the channel 140 may be approximately 1.6 mm or 1.5 to 1.7 mm, and the wall thickness T in the heel and toe portions 131, 132 may be approximately 1.0 mm or 0.9 to 1.1 mm. These wall thicknesses T are generally constant throughout the center portion 130 and the heel and toe portions 131, 132, in one embodiment. The wall thickness T at the center portion 130 in the embodiment of FIGS. 27-33 is also greater than the wall thickness T in at least some other portions of the sole 118 in one embodiment. The sole 118 may have a thickened portion 125 located immediately adjacent to the rear edge 148 of the channel 140 (at least behind the center portion 130) that has a significantly greater wall thickness T than the channel 140, which adds sole weight to the head 102 to lower the CG.

The various dimensions of the center portion 130 of the channel 140 of the club head 102 in FIGS. 27-33 may have relative dimensions with respect to each other that may be expressed by ratios. In one embodiment, the channel 140 has a width W and a wall thickness T in the center portion 130 that are in a ratio of approximately 4.5:1 to 5.5:1 (width/thickness). In one embodiment, the channel 140 has a width W and a depth D in the center portion 130 that are in a ratio of approximately 0.8:1 to 1.2:1 (width/depth). In one embodiment, the channel 140 has a depth D and a wall thickness T in the center portion 130 that are in a ratio of approximately 4.5:1 to 5.5:1 (depth/thickness). In one embodiment, the center portion of the channel 140 has a length and a width W that are in a ratio of approximately 4.5:1 to 5:1 (length/width). In one embodiment, the face 112 has a face width (heel to toe) and the center portion 130 of the channel 140 has a length (heel to toe) that are in a ratio of 1.5:1 to 2.5:1 (face width/channel length). In other embodiments, the channel 140 may have structure with different relative dimensions.

Channel Dimensional Relationships

The relationships between the dimensions and properties of the face 112 and various features of the body 108 (e.g., the channel 140 and/or ribs 204, 206, 208, 232, 234,) can influence the overall response of the head 102 upon impacts on the face 112, including ball speed, twisting of the club head 102 on off-center hits, spin imparted to the ball, etc. Many of these relationships between the dimensions and properties of the face 112 and various features of the body 108 and channel 140 and/or ribs is shown in Tables 1 and 2 below.

The various dimensions of the center portion 130 of the channel 140 of the club head 102 in FIGS. 1-17 may have relative dimensions with respect to the face height 56 of the head 102 that may be expressed by ratios. In one embodiment, the face height 56 and the width W in the center portion 130 of the channel 140 are in a ratio of approximately 6:1 to 7.5:1 (height/width). In one embodiment, the face height 56 and the depth D in the center portion 130 of the channel 140 are in a ratio of approximately 23:1 to 25:1 (height/depth). In one embodiment, the face height 56 and the wall thickness T in the center portion 130 of the channel 140 are in a ratio of approximately 52:1 to 57:1 (height/thickness). The face height 56 may be inversely related to the width W and depth D of the channel 140 in the heel and toe portions 131, 132 in one embodiment, such that the width W and/or depth D of the channel 140 increases as the face height 56 decreases toward the heel 120 and toe 122. In one embodiment, the heel and toe portions 131, 132 of the channel 140 may have a width W that varies with the face height 56 in a substantially linear manner, with a slope (width/height) of −1.75 to −1.0. In one embodiment, the heel and toe portions 131, 132 of the channel 140 may have a depth D that varies with the face height 56 in a substantially linear manner, with a slope (depth/height) of −1.5 to −0.75. In other embodiments, the channel 140 and/or the face 112 may have structure with different relative dimensions.

The face height 56 in the embodiment of FIGS. 18-26 may vary based on the loft angle. For example, for a 14-degree or 16-degree loft angle, the club head 102 may have a face height 56 of approximately 35 to 38 mm. As another example, for a 19-degree loft angle, the club head 102 may have a face height 56 of approximately 34 to 40 mm. Other loft angles may result in different embodiments having similar or different face heights.

The face height 56 in the embodiment of FIGS. 27-33 may vary based on the loft angle. For example, for a 17-degree to 18-degree loft angle, the club head 102 may have a face height 56 of approximately 33 to 38 mm. As another example, for a 19-degree to 20-degree loft angle, the club head 102 may have a face height 56 of approximately 32 to 36 mm. As another example, for a 23-degree or 26-degree loft angle, the club head 102 may have a face height 56 of approximately 32 to 36 mm. Other loft angles may result in different embodiments having similar or different face heights.

The various dimensions of the center portion 130 of the channel 140 of the club head 102 in FIGS. 18-26 may have relative dimensions with respect to the face height 56 of the head 102 that may be expressed by ratios. In one embodiment, the face height 56 and the width W in the center portion 130 of the channel 140 are in a ratio of approximately 3.5:1 to 5:1 (height/width). In one embodiment, the face height 56 and the depth D in the center portion 130 of the channel 140 are in a ratio of approximately 3.5:1 to 5:1 (height/depth). In one embodiment, the face height 56 and the wall thickness T in the center portion 130 of the channel 140 are in a ratio of approximately 20:1 to 25:1 (height/thickness). The face height 56 may be inversely related to the width W and/or depth D of the channel 140 in the heel and toe portions 131, 132 in one embodiment, such that the width W and/or depth D of the channel 140 increases as the face height 56 decreases toward the heel 120 and toe 122. In one embodiment, the heel and toe portions 131, 132 of the channel 140 may have a width W that varies with the face height 56 in a substantially linear manner, with a slope (width/height) of −0.9 to −1.6. In other embodiments, the channel 140 and/or the face 112 may have structure with different relative dimensions.

The various dimensions of the center portion 130 of the channel 140 of the club head 102 in FIGS. 27-33 may have relative dimensions with respect to the face height 56 of the head 102 that may be expressed by ratios. In one embodiment, the face height 56 and the width W in the center portion 130 of the channel 140 are in a ratio of approximately 3.5:1 to 4.5:1 (height/width). In one embodiment, the face height 56 and the depth D in the center portion 130 of the channel 140 are in a ratio of approximately 3.5:1 to 4.5:1 (height/depth). In one embodiment, the face height 56 and the wall thickness T in the center portion 130 of the channel 140 are in a ratio of approximately 20:1 to 25:1 (height/thickness). The face height 56 may be inversely related to the width W and/or depth D of the channel 140 in the heel and toe portions 131, 132 in one embodiment, such that the width W and/or depth D of the channel 140 increases as the face height 56 decreases toward the heel 120 and toe 122. In one embodiment, the heel and toe portions 131, 132 of the channel 140 may have a width W that varies with the face height 56 in a substantially linear manner, with a slope (width/height) of −0.8 to −1.7. In other embodiments, the channel 140 and/or the face 112 may have structure with different relative dimensions.

The various dimensions of the center portion 130 of the channel 140 and the face 112 of the club head 102 in FIGS. 1-16 may have relative dimensions with respect to the rearward spacing of the center portion 130 from the face 112 that may be expressed by ratios. In one embodiment, the face height 56 and the rearward spacing S between the face 112 and the front edge 146 of the center portion 130 of the channel 140 are in a ratio of approximately 6.5:1 to 8.5:1 (height/spacing). In one embodiment, the center portion 130 of the channel 140 of the club head 102 has a rearward spacing S between the face 112 and the front edge 146 and a width W that are in a ratio of approximately 0.5:1 to 1:1 (spacing/width). In one embodiment, the center portion 130 of the channel 140 of the club head 102 has a rearward spacing S between the face 112 and the front edge 146 and a depth D that are in a ratio of approximately 2:1 to 3:1 (spacing/depth). In one embodiment, the center portion 130 of the channel 140 of the club head 102 has a rearward spacing S between the face 112 and the front edge 146 and a wall thickness T that are in a ratio of approximately 7.5:1 to 8:1 (spacing/thickness). In other embodiments, the channel 140 and the face 112 may have structure with different relative dimensions.

The various dimensions of the center portion 130 of the channel 140 and the face 112 of the club head 102 in FIGS. 18-26 may have relative dimensions with respect to the rearward spacing S of the center portion 130 from the face 112 that may be expressed by ratios. In one embodiment, the face height 56 and the rearward spacing S between the face 112 and the front edge 146 of the center portion 130 of the channel 140 are in a ratio of approximately 3.5:1 to 5.5:1 (height/spacing). In other embodiments, the height/spacing ratio may be 4.5:1 to 5.5:1 or 3.5:1 to 4.5:1. In one embodiment, the center portion 130 of the channel 140 of the club head 102 has a rearward spacing S between the face 112 and the front edge 146 and a width W that are in a ratio of approximately 0.6:1 to 1.15:1 (spacing/width). In other embodiments, the spacing/width ratio may be 0.6:1 to 0.9:1 or 0.85:1 to 1.15:1. In one embodiment, the center portion 130 of the channel 140 of the club head 102 has a rearward spacing S between the face 112 and the front edge 146 and a depth D that are in a ratio of approximately 0.7:1 to 1:1 (spacing/depth). In other embodiments, the spacing/depth ratio may be 0.6:1 to 0.9:1 or 0.85:1 to 1.15:1. In one embodiment, the center portion 130 of the channel 140 of the club head 102 has a rearward spacing S between the face 112 and the front edge 146 and a wall thickness T that are in a ratio of approximately 4.25:1 to 5.75:1 (spacing/thickness). In other embodiments, the spacing/thickness ratio may be 4:1 to 4.5:1 or 5.5:1 to 6:1. In further embodiments, the channel 140 and the face 112 may have structure with different relative dimensions.

The various dimensions of the center portion 130 of the channel 140 and the face 112 of the club head 102 in FIGS. 27-33 may have relative dimensions with respect to the rearward spacing S of the center portion 130 from the face 112 that may be expressed by ratios. In one embodiment, the face height 56 and the rearward spacing S between the face 112 and the front edge 146 of the center portion 130 of the channel 140 are in a ratio of approximately 4:1 to 6:1 (height/spacing). In other embodiments, the height/spacing ratio may be 3.5:1 to 4.5:1 or 5:1 to 6:1. In one embodiment, the center portion 130 of the channel 140 of the club head 102 has a rearward spacing S between the face 112 and the front edge 146 and a width W that are in a ratio of approximately 0.5:1 to 1.25:1 (spacing/width). In other embodiments, the spacing/width ratio may be 0.8:1 to 1.2:1 or 0.5:1 to 0.9:1. In one embodiment, the center portion 130 of the channel 140 of the club head 102 has a rearward spacing S between the face 112 and the front edge 146 and a depth D that are in a ratio of approximately 0.5:1 to 1.25:1 (spacing/depth). In other embodiments, the spacing/width ratio may be 0.8:1 to 1.2:1 or 0.5:1 to 0.9:1. In one embodiment, the center portion 130 of the channel 140 of the club head 102 has a rearward spacing S between the face 112 and the front edge 146 and a wall thickness T that are in a ratio of approximately 3.5:1 to 5.5:1 (spacing/thickness). In other embodiments, the spacing/thickness ratio may be 4.75:1 to 5.25:1 or 3.5:1 to 4:1. In further embodiments, the channel 140 and the face 112 may have structure with different relative dimensions.

Face Design

Figure 14:
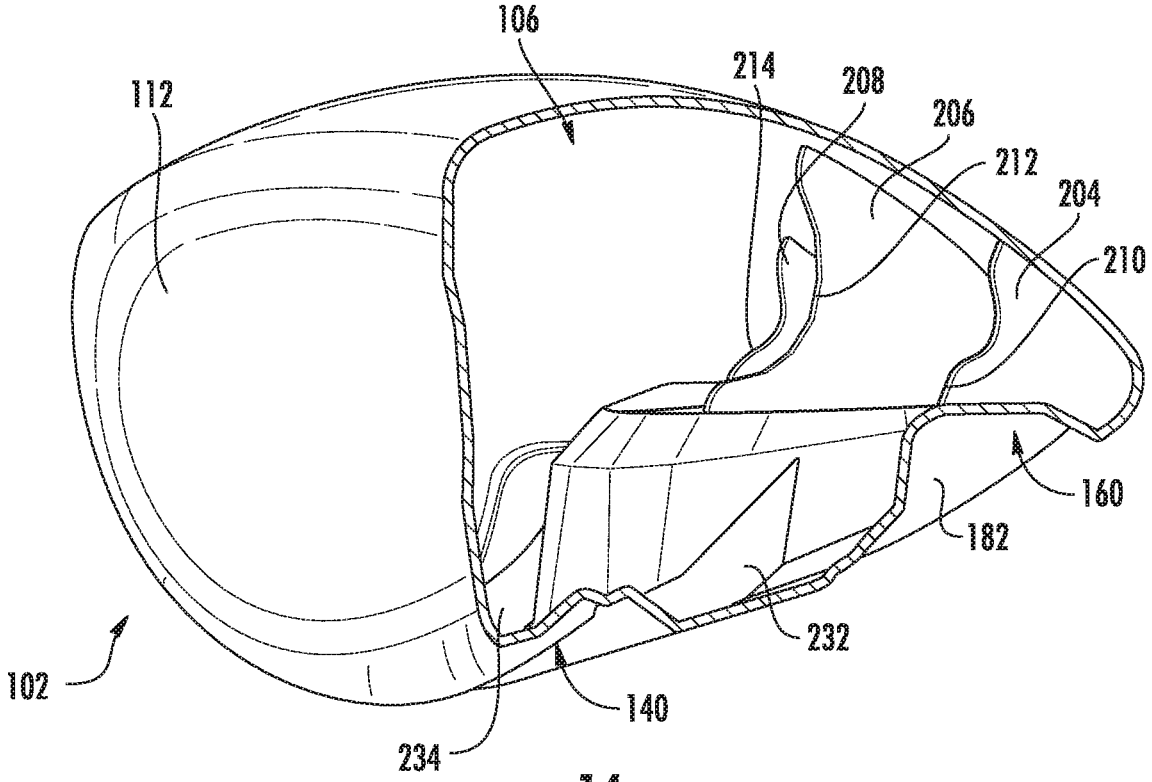
FIG. 14 is a front left perspective view of the club head of FIG. 1, with a portion removed to show internal detail.
Figure 15:
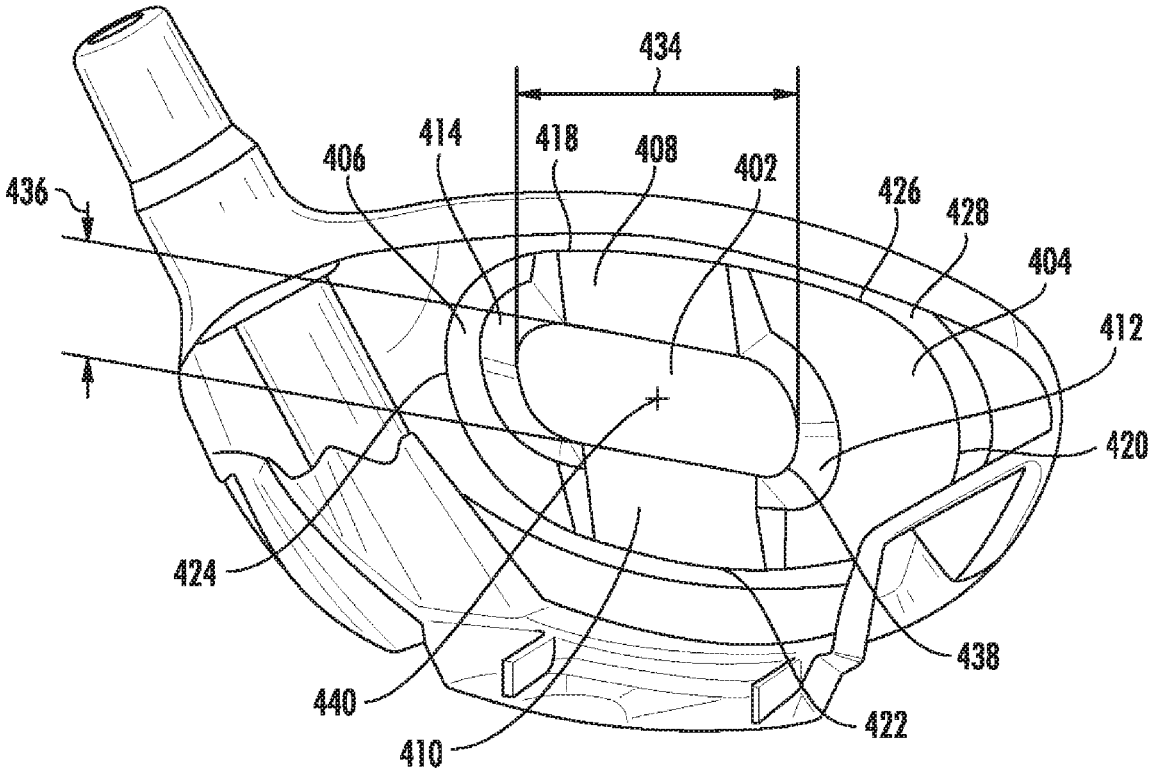
FIG. 15 is rear right perspective view of the golf club of FIG. 1, with a portion removed to show internal detail.

Another aspect to club head 102 of embodiments shown in FIGS. 1-17 is the face design as shown in FIG. 15. As the face 112 is the strikes the golf ball and sets the ball into motion. At impact the face 112 will flex and to help improve the velocity the golf ball leaves the striking face 110. The face 112 and channel 140 may work together to improve the velocity and performance of the golf club head 102. Thus, the better the face 112 and channel 140 complement each other the better the performance of the golf club head 102.

A face design may have a variable thickness to better handle the stresses caused from the golf ball impact while balancing the stiffness of the face. As discussed earlier, the face 112 may have a ball striking surface and an inner surface 111. The inner surface 111 may have multiple regions having different thicknesses.

As shown in FIG. 15, center region 402 may be positioned near the face center location 40, a toe region 404 positioned on the toe side 122, a heel region 406 positioned on the heel side 120, an upper region 408 positioned between the center region 402 and an upper edge 418, a lower region 410 positioned between the center region 402 and a lower edge 422, a toe transition region 412 positioned between the center region 402 and the toe region 404, and a heel transition region 414 positioned between the center region 402 and the heel region 406.

As discussed earlier, the body 108 and the face 112 may be formed separate and connected to form the golf club head 102 using an integral joining technique to form an interior cavity. The body 108 may have a flange 426 that forms a portion of the ball striking surface 110. The flange 426 and the face 112 may form a joint 428 defining an upper edge 418, a toe edge 420, a lower edge 422, and a heel edge 424 of the face 112.

As discussed above, the face 112 may have multiple thickness regions. For example, the center region 402 may have a first thickness, the toe region 404 may have a second thickness, the heel region 406 may have a third thickness, a upper region may have a fourth thickness, the lower region may have a fifth thickness, and the toe transition region may have a sixth thickness, and the heel transition region may have a seventh thickness. The center region 402 may have a thickness that is greater than the other regions, and the toe region 404 may have a thickness that is less than the other regions. Alternatively, the heel region 406 may have the same thickness as the toe region 404. Additionally, the upper edge 418 and the lower edge 422 may have a thickness greater than the thickness of the toe region 404 and the heel region 406.

The center region 402 may have a generally rectangular shape with rounded corners 432. The rectangular shape may be defined to encompass an area where most golfers tend to impact the striking face 110 with an impact centered within approximately 12 mm on the heel and toe side of the face center location 40 and a radius approximately the size of a golf ball as it compresses during impact. For example, a center region 402 of clubhead 102 of the embodiments shown in FIGS. 1-17 may have a width 434 of approximately 39 mm, or within a range of 34 to 42 mm or 30 to 45 mm, and a height 436 of approximately 17 mm, or within a range of 15 to 19 mm or 13 to 21 mm. The rounded corners may have a radius 438 of approximately 7.5 mm, or within a range of 5 to 10 mm.

The center region 402 may have a center point 440 positioned in a heel-to-toe direction at approximately the face center location 40 or within 2 mm on either side of the face center location 40. Additionally, the center region 402 may have a center point 440 positioned in a crown-to-sole direction where the center point 440 is located above the face center location 40 (towards the crown 116 of the golf club head). For example, the center point 440 of the center region 402 of the face 112 may be located approximately 3 mm above the face center location 40 or within a range of 1 to 4 mm above the face center location 40. The center region 402 may have a surface area of approximately 580 $mm^2$, or within a range of 480 to 620 $mm^2$. In addition, the surface area of the center region 402 compared to a total surface area defined within boundaries of the upper edge 418, toe edge 420, lower edge 422, and heel edge 424 may be approximately 21 percent of the total surface area, or within a range of 18 to 23 percent.

Because the center region 402 receives the majority of the impact stresses on the face 112, the center region's 402 corresponding thickness may be greater than the other regions. The center region 402 may have a constant thickness face thickness. For example, the center region may have a thickness of approximately 3.4 mm, or within a range of 3.2 to 3.6 mm throughout the entire center region 402.

As a means of reducing the weight as much as possible while also providing an effective response to the ball impact, the toe and heel regions 404, 406 may have a constant thickness similar to the center region 402. Because the face height is less at the toe and heel than at the center, the thickness may be reduced relative to the center region to provide the proper overall stiffness for the face along with balancing the impact stresses. The thickness of the toe region 404 may be the same as the thickness of the heel region 406. For example, in the embodiment shown in FIG. 15, the heel and toe regions 404, 406 have a thickness of approximately 2.5 mm, or within a range of 2.2 to 2.7 mm. Alternatively, the thickness of the toe region 404 may be different than the thickness of the heel region 406. The heel and toe regions 404, 406 may have surface areas of approximately 700 $mm^2$, or within a range of 650 to 750 $mm^2$.

The upper and lower regions 408, 410 may have a variable thickness, such as a ramped thickness that decreases as a function of the distance away from the center region 402 to the upper edge 418 and lower edge 422 respectively. The ramped thickness of the upper and lower regions 408, 410 may have a linear slope, or may a radial curvature, or the curvature may fit any polynomial. While the thickness of the upper and lower regions 408, 410 may not be constant, the upper and lower edges 418, 422 may have a constant thickness. The thickness of the upper and lower edges 418, 422 may be greater than the thickness on the toe and heel regions 404, 406. The upper region 408 may have a slope that is greater (reduces in thickness at a faster rate as the upper region 408 moves away from the center region 402) than the slope of the lower region 410. The surface areas of the upper and lower regions may be approximately 390 $mm^2$ and 440 $mm^2$ respectively.

The toe and heel transition regions 412, 414 may have a variable thickness, such as a ramped thickness that decreases as a function of the distance away from the center region 402 to the toe region 404 and the heel region 406 respectively. The ramped thickness of the toe and heel regions 412, 414 may have a linear slope, or may a radial curvature, or the curvature may fit any polynomial. The toe and heel transition regions may be formed with a large radius to avoid any stress concentrations that would be caused by sharp corners. The surface area of the toe and heel transition regions 412, 414 may be approximately 200 $mm^2$ and 180 $mm^2$ respectively, or may be in a range between 160 and 220 $mm^2$.

Figure 15A:
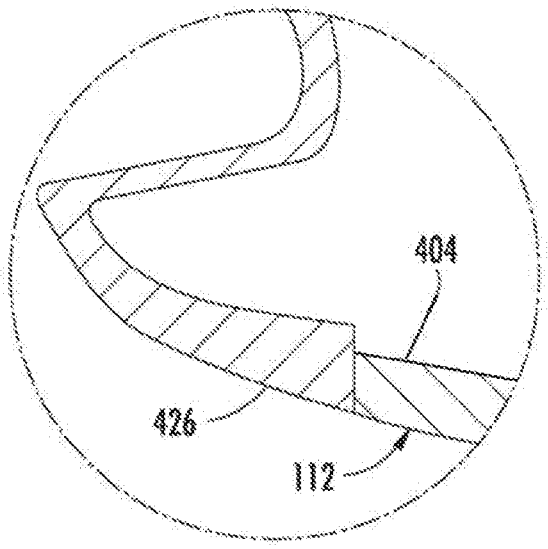
FIG. 15A is a magnified view of the cross-sectional view of the golf club of FIG. 1.

As shown in FIG. 15A, the flange 426 may have a thickness defined as the thickness at an edge closest to the joint 428. The flange 426 may have a constant thickness near the joint and may be approximately 2.7 mm, or within a range of 2.6 to 2.8 mm, or within a range of 2.5 to 2.9 mm. The flange 426 may have a thickness that is greater than the thickness of the toe and heel regions 404, 406.

Another aspect that may improve the response of the face 112 is the geometry of the transition 121 from the face 112 to the crown 116 as shown in FIG. 10. The size and shape of the transition 121 can help to increase the responsiveness of the face 112. The transition 121 is defined as beginning where the rate of the curvature of the face 112 changes direction and then blends into the crown 116. The transition 121 may be easily found from a CAD file. The transition 121 may have a circular cross-section or it may have a conical cross-section, or any cross-section having tangent transition to both the face 112 and the crown 116. The transition 121 may have a length 117 measured in the Y-Axis 16 direction, and a height measured 115 in the Z-Axis 18 direction. For example, the length 117 of the transition 121 may be larger than the height 115, and may have a ratio of the length 117 to the height 115 of approximately 1.25:1 or within a range of 1.1:1 to 1.5:1. Alternatively, the height 115 of the transition 121 may be larger than the length 117 and may have a ratio of the height 115 to the length 117 of approximately 1.25:1 or within a range of 1.1:1 to 1.5:1.

Face Design Fairway Wood/Hybrid

FIGS. 18-26 and 27-33 illustrate an additional embodiment of a golf club head 102 in the form of a fairway wood and a hybrid golf club head. The heads 102 of FIGS. 18-26 and 27-33 include many features similar to the head 102 of FIGS. 1-17, and such common features are identified with similar reference numbers. For example, FIGS. 18-26 and 27-33 illustrate a face 112 having a center region 402 positioned near the face center location 40, a toe region 404 positioned on the toe side 122, a heel region 406 positioned on the heel side 120, an upper region 408 positioned between the center region 402 and an upper edge 418, a lower region 410 positioned between the center region 402 and a lower edge 422, a toe transition region 412 positioned between the center region 402 and the toe region 404, and a heel transition region 414 positioned between the center region 402 and the heel region 406. Additionally, each region has a thickness profile like the embodiment shown in FIG. 15.

The center region 402 of the embodiments of FIGS. 18-26 and 27-33 may have a width 434 similar to the embodiment shown in FIG. 15, but the height 436 of the center region 402 may be approximately 15 mm, or within a range of 13 to 17 mm, or within a range of 11 to 19 mm. Additionally, a center point 440 of the center region 402 of the face 112 of embodiments of FIGS. 18-26 and 27-33 is positioned in a crown-to-sole direction where the center point 440 is located below the face center location 40 (towards the sole 116 of the golf club head). For example, the center point 440 of the center region 402 of the face 112 may be located approximately 2 mm above the face center location 40 or within a range of 1 to 4 mm below the face center location 40.

The regions of the face design of the embodiments of FIGS. 18-26 and 27-33 may have different thicknesses than the thicknesses of the embodiment of FIG. 15 due to the lower face height 56 and the use of a steel material instead for fairway woods and hybrids. For example, the center region 402 may have a constant thickness of approximately 2.25 mm, or within a range of 2.0 to 2.4 mm. Additionally, the toe and heel regions 404, 406 may have a constant thickness of approximately 1.95 mm, or within a range of 1.8 to 2.2 mm. The center region 402 may have a thickness greater than the toe and heel regions 404, 406 similar to the embodiments of FIG. 15. However, the upper edge and lower edge 418, 422 may have a thickness that is the same as the thickness as the toe and heel regions 404, 406.

While the thickness of the upper and lower regions 408, 410 may not be constant, the upper and lower edges 418, 422 may have a constant thickness. The thickness of the upper and lower edges 418, 422 may be the same than the thickness on the toe and heel regions 404, 406. The lower region 410 may have a slope that is greater (it reduces in thickness at a faster rate as it moves away from the center region 402) than the slope of the upper region 408.

Similar to the embodiment shown in FIG. 15A, the flange 426 may have a thickness defined as the thickness at an edge closest to the joint 428. The flange 426 may have a constant thickness near the joint and may be approximately 2.05 mm, or within a range of 1.95 to 2.15 mm. The flange 426 may have a thickness that is greater than the thickness of the toe and heel regions 404, 406.

Relationships Between Face and Channel

The relationships of the face design and how the face design relates to the may be expressed in a series of ratios. A ratio of the thickness of the center region 402 to the thickness of the toe region 404 may have a ratio in a range of 1.27:1 to 1.55:1. A ratio of the face thickness of the center region 402 to the thickness of the center portion 130 of the channel 140 may be within a range of 2.5:1 to 2.9:1. Additionally, a ratio of the face thickness of the toe region 404 to the thickness of the toe portion 132 may be within a range of 2.5:1 to 2.9:1.

Structural Ribs of Club Head

The ball striking heads 102 according to the present invention can include additional features that can influence the impact of a ball on the face 112, such as one or more structural ribs. Structural ribs can, for example, increase the stiffness of the striking head 102 or any portion thereof. Strengthening certain portions of the striking head 102 with structural ribs can affect the impact of a ball on the face 112 by focusing flexing to certain parts of the ball striking head 102 including the channel 140. For example, in some embodiments, greater ball speed can be achieved at impact, including at specific areas of the face 112, such as off-center areas. Structural ribs and the locations of such ribs can also affect the sound created by the impact of a ball on the face 112.

In other embodiments club 102 can include internal and/or external ribs. As depicted in at least in FIGS. 2 and 8, the cover 161 can include external ribs 180, 182. In one embodiment, as illustrated in FIG. 8, external ribs 180, 182 are generally arranged in an angled or V-shaped alignment, and converge towards one another with respect to the Y-axis 16 in a front 124 to rear 126 direction. In this configuration, the ribs 180, 182 may converge towards one another at a point beyond the rear 126 of the club. As shown in FIG. 8, the angle of the ribs 180, 182 from the Y-axis 16 may be approximately 10 degrees, or may be in the range of 0 degrees to 30 degrees. In other configurations, the ribs 180, 182 can angle away from one another or can be substantially straight in the Y-axis 16 direction. The external ribs 180, 182 may be substantially straight in the vertical plane or Z-axis 18 direction. In other embodiments, the ribs 180, 182 can be angled in the Z-axis 18 direction, and can be angled relative to each other as well.

Each of the ribs 180, 182 have front end portions 184, 186 toward the front 124 of the body 108 extending to the edge of the rib, and rear end portions 188, 190 toward the rear 126 of the body 108 extending to the edge of the rib. In one embodiment the front end portions 184, 186 of ribs 180, 182 can connect to the first wall 166 and the second wall 167 respectively, and the rear end portions 188, 190 can extend substantially to the rear 126 of the club. The external ribs 180, 182 also include upper portions 192, 194 extending to the edge of the rib and lower portions 196, 198 extending to the edge of the rib. The upper portions 192, 194 of ribs 180, 182 connect to the cover 161. The lower portions 196, 198 of ribs 180, 182 can define a portion of the bottom or sole 118 of the golf club. As shown in FIG. 2, the lower portions 196, 198 of ribs 180, 182 may be curved, generally forming a convex shape. In other embodiments the lower portions 180, 182 may have a concave curved shape, a substantially straight configuration, or any other shape. In another embodiment, external ribs 180, 182 may extend to the crown 116. In some such embodiments, the external ribs 180, 182 may intersect the cover 161 and connect to an internal surface of the crown 116. In other embodiments, external ribs 180, 182 may connect to an internal surface of the sole 118 and/or an internal surface of the rear edge 148 of the channel 140 or any other internal surface of the club.

The ribs 180, 182 may be located anywhere in the heel-to-toe direction and in the front-to-rear direction. For example, ribs 180, 182 may be equally or unequally spaced in the heel-toe direction from the center of gravity or from the face center. In one embodiment, the front end portion 184 of rib 180 may be located towards the heel 120 from the face center location 40 measured in the X-axis 14 direction approximately 15 mm, or may be in the range of 0 to 25 mm. The front end portion 186 of rib 182 may be located towards the toe 122 from the face center location 40 measured along the X-axis 14 approximately 33 mm, or may be in the range of 0 to 45 mm. In one embodiment, the front end portion 184 of rib 180 may be located towards the rear 126 from the striking face measured in the Y-axis 16 direction approximately 53 mm, or may be in the range of 20 to 70 mm. The front end portion 186 of rib 182 can be located towards the rear 126 from the striking face measured along the Y-axis 16 approximately 55 mm, or may be in the range of 20 to 70 mm.

Figure 9A:
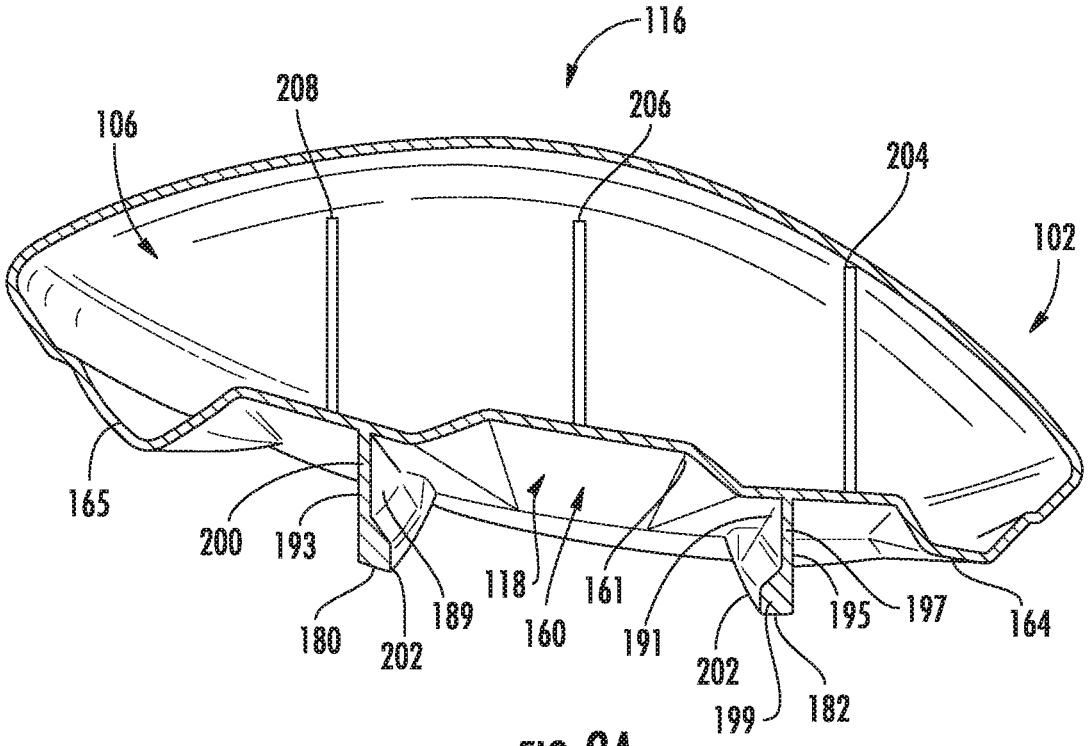
FIG. 9A is a view from the lower front perspective view of the club head of FIG. 1, with a portion removed to show internal detail.

Each rib 180, 182 also has an internal side 189, 191 and an external side 193, 195 and a width defined there between. The width of the ribs 180, 182 can affect the strength and weight of the golf club. As shown in FIG. 9A, the ribs 180, 182 can have a thinner width portion 200 throughout the majority, or center portion, of the rib. The thinner width portion 200 of the rib can be approximately 1 mm, or may be in the range of approximately 0.5 to 5.0 mm and can be substantially similar throughout the entire rib. The ribs 180, 182 can also include a thicker width portion 202. The thicker width portion 202 can be near the front end portions 184, 186, rear end portions 188, 190, upper portions 192, 194, or lower portions 196, 198. As depicted in FIG. 9A, the ribs 180, 182 include a thicker width portion 202 over part of the front end portions 184, 186, part of the rear end portions 188, 190, and the lower portions 196, 198. As shown in FIG. 9A, the thicker width portion 202 can be disposed substantially on the internal sides 189, 191 of the ribs 180, 182. In other embodiments the thicker width portion can be distributed equally or unequally on the internal sides 189, 191 and the external sides 193, 195, or substantially on the external sides 193, 195. The thickness of the thicker width portion can be approximately 3.0 mm, may be in the range of approximately 1.0 to 10.0 mm. The width of the thicker portion 202 can be approximately 2 to 3 times the width of the thinner portion 200.

Ribs 180, 182 may also be described as having a vertical portion 197 and a transverse portion 199 such that the portions 197 and 199 form a T-shaped or L-shaped cross-section. As shown in FIG. 9A, the transverse portion 199 can taper into the vertical portion 197, but in other embodiments the transverse portion may not taper into the vertical portion. The vertical portion 197 and the transverse portion can both have a height and a width. As described above the width of the vertical portion can be approximately 1 mm, or may be in the range of approximately 0.5 to 5.0 mm. The width of the transverse portion can be approximately 3.0 mm, or may be in the range of approximately 1.0 to 10.0 mm. The height of the transverse portion 199 can be approximately 1.0 mm, or may be in the range of approximately 0.5 to 5.0 mm. Any of the ribs described herein can include, or can be described as having, a vertical portion and at least one transverse portion. The transverse portion can be included on an upper portion, lower portion, front end portion, and/or rear end portion, or any other portion of the rib. As previously discussed the intersection of the vertical portion and the transverse portion can generally form a T-shaped or L-shaped cross-section.

Each rib 180, 182 also has a maximum height defined by the distance between the upper portions 192, 194 and the lower portions 196, 198 measured along the ribs 180, 182 in the Z-axis 18 direction. A maximum height of the ribs 180, 182 can be in the range of approximately 5 to 40 mm. Additionally, each rib 180, 182 also has a maximum length, defined by the distance between the front end portions 184, 186 and rear end portions 188, 190 measured along the ribs 180, 182 in the plane defined by the X-axis 14 and the Y-axis 16. The length of rib 180 can be approximately 54 mm, or may be in the range of approximately 20 to 70 mm; and the length of rib 182 can be approximately 53 mm, or may be in the range of approximately 20 to 70 mm. In another embodiment, the length of rib 180 can be approximately 48 mm, or may be in the range of approximately 20 to 70 mm; and the length of rib 182 can be approximately 50 mm, or may be in the range of approximately 20 to 70 mm. The ratio of the length of the ribs 180, 182 to the total head breadth 60 of the club in the front 124 to rear 126 direction can be approximately 1:2 (rib length/total head breadth) or approximately 0.75:2 to 1.25:2.

While only two external ribs 180, 182 are shown, any number of ribs can be included on the golf club. It is understood that the ribs may extend at different lengths, widths, heights, and angles and have different shapes to achieve different weight distribution and performance characteristics.

The external ribs 180, 182 may be formed of a single, integrally formed piece, e.g., by casting with the cover 161. Such an integral piece may further include other components of the body 108, such as the entire sole 118 (including the channel 140) or the entire club head body 108. In other embodiments the ribs 180, 182 can be connected to the cover 161 and/or sole 118 by welding or other integral joining technique to form a single piece.

As shown in at least FIG. 9A, the club may also include upper internal ribs 204, 206, 208 within the space 162 of the inner cavity 106. The ribs 204, 206, 208 may extend between the interior portions of the crown 116 and the cover 161, and in other embodiments can connect only to an interior portion of the crown 116 and/or the cover 161. In one embodiment, as illustrated in FIG. 9A, upper internal ribs 204, 206, 208 are generally parallel with one another and substantially aligned in a generally vertical plane or Z-axis 18 direction and are substantially perpendicular to the striking face 112. In other configurations, the upper internal ribs 204, 206, 208 can be angled with respect to X-axis 14, Y-axis 16, or Z-axis 18 directions and/or angled with respect to each other. The ribs 204, 206, 208 can be located anywhere in the heel-toe direction. For example, ribs 204, 206, 208 can be equally or unequally spaced in the heel-toe direction from the center of gravity or from the face center. In one embodiment, rib 204 can be located approximately 18 mm, or may be in the range of approximately 5 to 35 mm towards the heel 120 from the face center location 40 measured along the X-axis 14; rib 206 can be located approximately 16 mm, or may be in the range of approximately 0 to 30 mm towards the toe 122 from the face center location 40 measured along the X-axis 14; and rib 208 can be located approximately 38.5 mm, or may be in the range of approximately 20 to 50 mm towards the toe 122 from the face center location 40 measured along the X-axis 14. In another embodiment, rib 204 can be located approximately 15 mm, or may be in the range of approximately 0 to 30 mm towards the heel 120 from the face center location 40 measured along the X-axis 14; rib 206 may be located approximately 10 mm, or may be in the range of approximately 0 to 20 mm towards the toe 122 from the face center location 40 measured along the X-axis 14; and rib 208 can be located approximately 32 mm, or may be in the range of approximately 10 to 45 mm towards the toe 122 from the face center location 40 measured along the X-axis 14.

Each of the ribs 204, 206, 208 have front end portions 210, 212, 214 toward the front 124 of the body 108 extending to the edge of the rib, and rear end portions 216, 218 (not shown), 220 (not shown) toward the rear 126 of the body 108 extending to the edge of the rib. In one embodiment the front end portions 210, 212, 214 include a concave curved shape. In other embodiments, the front end portions 210, 212, 214 can have a convex curved shape, a straight shape, or any other shape.

The upper portions of ribs 204, 206, 208 can connect to the internal side of the crown 116, and the lower portions can connect to an internal side of the cover 161. In other embodiments the ribs may only be connected to the cover 161, or the crown 116, or from the crown 116 to the sole 118.

Each rib 204, 206, 208 also has first side oriented towards the heel 131 and a second side oriented towards the toe 132 and a width defined there between. The width of the ribs can affect the strength and weight of the golf club. As shown in 9A, the ribs 204, 206, 208 can have an approximately constant width which may be approximately 0.9 mm, or may be in the range of approximately 0.5 to 5.0 mm. This width may be substantially the same for each rib. In other embodiments, the width of each rib can vary. Additionally, for example, the ribs 204, 206, 208 may include a thinner width portion throughout the majority, or a center portion, of the rib. The ribs 204, 206, 208 may also include a thicker width portion. The thicker width portion may be near the front end portions 210, 212, 214, rear end portions 216 (not shown), 218 (not shown), 220 (not shown), upper portions or lower portions. The thickness of the thicker width portion can be approximately 2 to 3 times the width of the thinner portion.

Each of ribs 204, 206, 208 also has a maximum height defined by the maximum distance between the upper portions or lower portions measured along the rib in the Z-axis 18 direction. The maximum height of ribs 204, 206, 208 may be approximately in the range of approximately 25 to 35 mm, or in the range of approximately 15 to 50 mm. Additionally, each rib 204, 206, 208 also has a maximum length, measured along the rib in Y-axis 16 direction. The maximum length of rib 204 can be approximately 33 mm, or may be in the range of approximately 20 to 50 mm. The maximum length of rib 206 may be approximately 35 mm, or may be in the range of approximately 20 to 50 mm. The maximum length of rib 208 may be approximately 30 mm, or may be in the range of approximately 25 to 50 mm. As shown in FIG. 14 each or ribs 204, 206, 208 have similar same lengths, but in other embodiments each of the ribs may have different lengths. In one embodiment, the maximum length of rib 204 may be approximately 24 mm, or may be in the range of approximately 15 to 40 mm. The maximum length of rib 206 can be approximately 28 mm, or may be in the range of approximately 15 to 40 mm. The maximum length of rib 208 can be approximately 25 mm, or may be in the range of approximately 15 to 40 mm. In still other embodiments the length of ribs 204, 206, 208 may be longer or shorter, and for example, in some embodiments ribs 204, 206, 208 may connect to an internal side of the striking face 112.

While three upper internal ribs 204, 206, 208 are shown, any number of ribs can be included on the golf club. It is understood that the ribs may extend at different lengths, widths, heights, and angles and have different shapes to achieve different weight distribution and performance characteristics.

The upper internal ribs 204, 206, 208 may be formed of a single, integrally formed piece, e.g., by casting with the cover 161 and/or crown 116. Such an integral piece may further include other components of the body 108, such as the entire sole 118 (including the channel 140), the crown 116, or the entire club head body 108. In other embodiments the ribs 204, 206, 208 can be connected to the cover 161 and/or crown 116 by welding or other integral joining technique to form a single piece.

The combination of both the internal ribs 204, 206, and 208 along with the external ribs 180 and 182 may be positioned relative to each other such that at least one of the external ribs 180 and 182 and at least one of the internal ribs 204, 206, and 208 may be located where the at least one external rib and the at least one internal rib occupy the same location in a view defined by the plane defined by the X-axis 14 and Y-axis 16 (or intersect if extended perpendicular to the view) but may be separated by only the wall thickness between them. The external rib and internal rib then diverge at an angle. The angle between the external and internal rib can be an angle in the range of 4 to 10 degrees or may be in the range of 0 to 30 degrees. In other configurations, the at least one external rib and the at least one internal rib occupy the same point in a view defined by the plane defined by the X-axis 14 and Z-axis 18 (or intersect if extended perpendicular to the view) but are separated by only the wall thickness between them. The external rib and internal rib then diverge at an angle. The angle that the external and internal rib can be an angle in the range of 4 to 10 degrees or may be in the range of 0 to 30 degrees.

As shown in at least FIG. 14, the club can also include lower internal ribs 232, 234. The ribs can connect to the interior side of the sole 118, and can extend between interior portions of the first and second walls 166, 167 and the rear edge 148 of the channel 140. In other embodiments the ribs 232, 234 can connect only to the interior portion of first and second walls 166, 167 and/or the interior of the rear edge 148 of the channel 140, and in still other embodiments ribs 232, 234 can connect to the crown 116. In one embodiment, as illustrated in FIGS. 9 and 14, lower internal ribs 232, 234 are generally parallel with one another and aligned in a generally vertical plane or Z-axis 18 direction that is perpendicular to the striking face 112. In other configurations, the lower internal ribs 232, 234 may be angled with respect to X-axis 14, Y-axis 16, or Z-axis 18 directions and/or angled with respect to each other. The ribs 232, 234 may be located anywhere in the heel-toe direction. For example, ribs 232, 234 may be equally or unequally spaced in the heel-toe direction from the center of gravity or from the face center. In one embodiment, rib 232 may be located approximately 8 mm, or may be in the range of approximately 0 to 30 mm towards the heel 120 from the face center location 40 measured along the X-axis 14. Rib 234 may be located approximately 25 mm, or may be in the range of approximately 0 to 45 mm towards the toe 122 from the face center location 40 measured along the X-axis 14. In another embodiment, rib 232 can be located approximately 3 mm, or may be in the range of approximately 0 mm to 25 mm towards the heel 120 from the face center location 40 measured along the X-axis 14. Rib 234 may be located approximately 21 mm, or may be in the range of approximately 0 to 35 mm towards the toe 122 from the face center location 40 measured along the X-axis 14.

Each of the ribs 232, 234 have front end portions 236, 238 towards the front 124 of the body 108 extending to the edge of the rib which may connect to the interior of the rear edge 148 of the channel 140. Each of the ribs 232, 234 also has rear end portions 240, 242, respectively, towards the rear 126 of the body 108 extending to the edge of the rib which may connect to the first and second walls 166, 167. The lower internal ribs 232, 234 also include upper portions 244, 246 extending to the edge of the rib and lower portions 248, 250 extending to the edge of the rib. As shown in FIG. 11B the upper portions 244, 246 of ribs 232, 234 may be curved, generally forming a concave curved shape. In other embodiments the upper portions 244, 246 may have a convex curved shape, straight shape, or any other shape. The lower portions 248, 250 of the ribs may connect to an interior of the sole 118 of the golf club.

Each rib 232, 234 also has an internal side and an external side and a width defined there between. The width of the rib may affect the strength and weight of the golf club. The ribs 232, 234 may have a substantially constant rib width of approximately 1 mm, or may be in the range of approximately 0.5 to 5.0 mm, or may have a variable width. Additionally, in some embodiments, for example, the ribs 232, 234 may have a thinner width portion throughout the majority or a center portion of the rib and a thicker width portion. The thicker width portion may be near the front end portions 236, 238, rear end portions 240, 242, upper portions 244, 246, or lower portions 248, 250, or any other part of the rib. The thickness of the thicker width portion may be approximately 2 to 3 times the width of the thinner portion.

Each rib 232, 234 also has a maximum height defined as the maximum distance between the upper portions and the lower portions measured along the rib in the Z-axis 18 direction. The maximum height of rib 232 can be approximately 16 mm+/−2 mm or may be in the range of approximately 0 to 40 mm, and the maximum height of rib 234 may be approximately 20 mm+/−2 mm or may be in the range of approximately 0 to 40 mm. In another embodiment, the maximum height of rib 232 may be approximately 20 mm, or may be in the range of approximately 0 to 30 mm; and the maximum height of rib 234 can be approximately 21 mm, or may be in the range of approximately 0 to 30 mm. Additionally, each rib 232, 234 also has a maximum length defined as the maximum distance between the front end portions and rear end portions measured along the rib in the Y-axis 16 direction. The maximum length of rib 232 may be approximately 46 mm, or may be in the range of approximately 0 to 60 mm; and the maximum length of rib 234 may be approximately 46 mm, or may be in the range of approximately 0 to 60 mm. In another embodiment, the maximum length of rib 232 may be approximately 40 mm, or may be in the range of approximately 0 to 50 mm; and the maximum length of rib 234 may be approximately 39 mm, or may be in the range of approximately 0 to 50 mm.

While only two lower internal ribs 232, 234 are shown, any number of ribs may be included on the golf club. It is understood that the ribs may extend at different lengths, widths, heights, and angles and have different shapes to achieve different weight distribution and performance characteristics.

The lower internal ribs 232, 234 may be formed of a single, integrally formed piece, e.g., by casting with the sole 118. Such an integral piece may further include other components of the body 108, such as the entire sole 118 (including the channel 140) or the entire club head body 108. In other embodiments the ribs 232, 234 can be connected to the crown 116 and/or sole 118 by welding or other integral joining technique to form a single piece.

Additionally, the rear end portions 240, 242 of the internal ribs 232, 234 and the forward most portions 184, 186 of the external ribs 180, 182 may be positioned relative to each other by a dimension defined in a direction parallel to the X-axis 14 between 2 to 4 mm or may be in the range of 1 to 10 mm.

Internal Rib Configuration for Clubhead without Void

Figure 16:
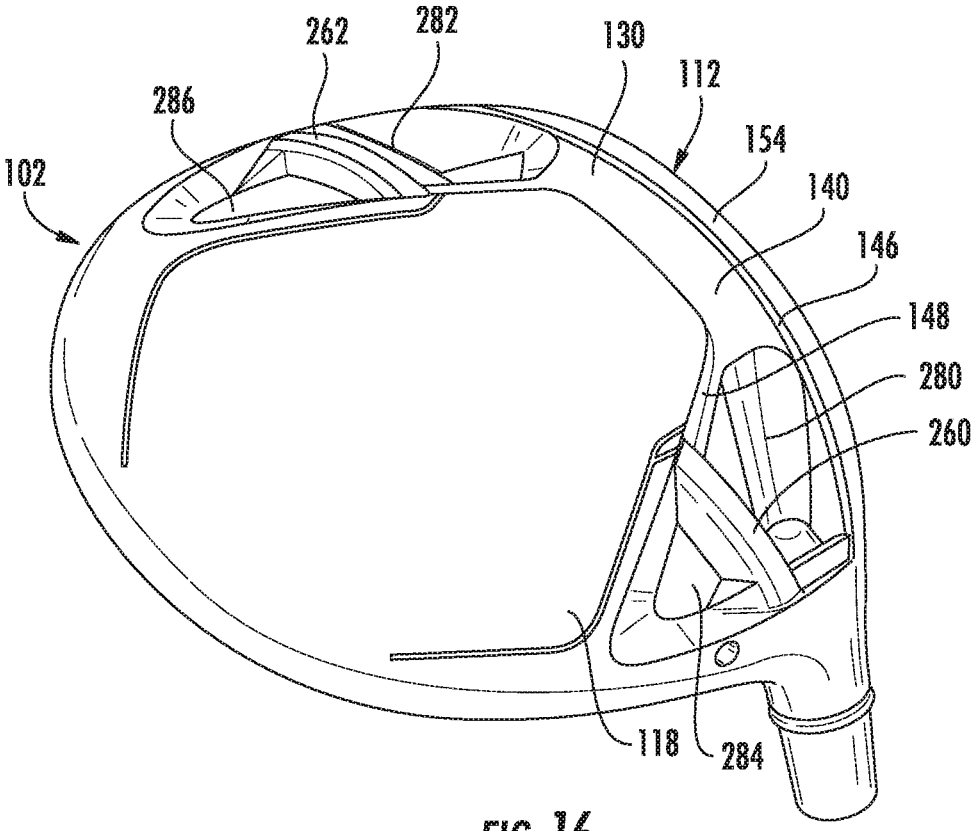
FIG. 16 is a bottom right rear perspective view of an another embodiment of a golf club head according to aspects of this disclosure, in the form of a golf driver.
Figure 16A:
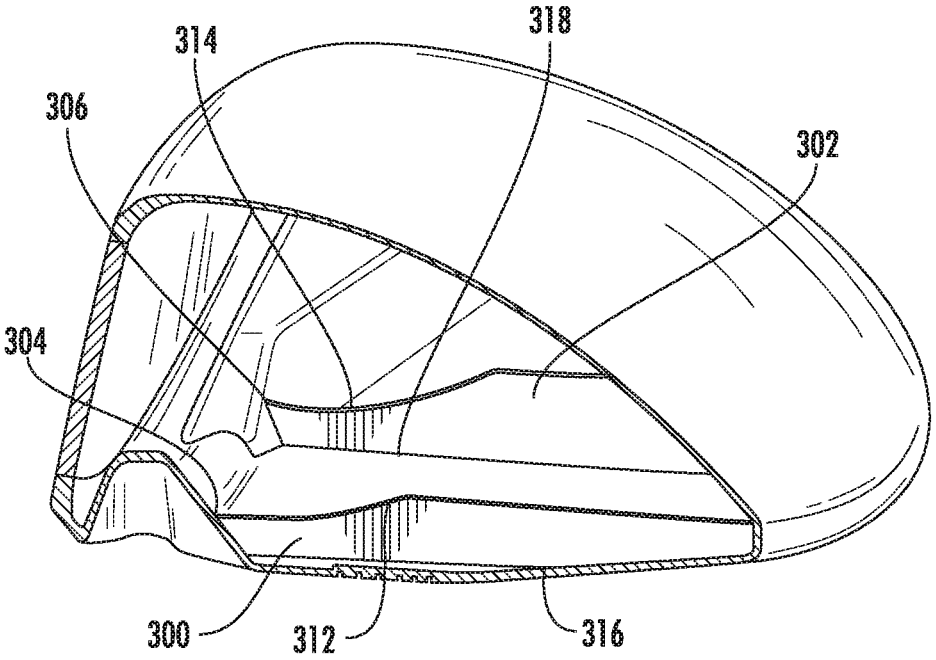
FIG. 16A is a side perspective view of the embodiment of FIG. 16 with a portion removed to show internal detail.

A golf club head 102 including channel 140 as described above, but without void 160 is shown in FIGS. 16-17. As shown in at least FIG. 17, the club 102 of FIG. 17 can also include ribs 300, 302. The ribs can connect to the interior side of the sole 118, and can extend between interior portions of the rear 126 of the body 108 and the rear edge 148 of the channel 140. In other embodiments, the ribs 300, 302 may not extend the entire distance between the interior portion of rear 126 of the body 108 and/or the interior of the rear edge 148 of the channel 140, and in still other embodiments ribs 300, 302 can connect to the crown 116. In one embodiment, as illustrated in FIG. 16A, ribs 300, 302 are generally parallel with one another and aligned in a generally vertical plane or Z-axis 18 direction that is perpendicular to the striking face 112. In other configurations, the ribs 300, 302 can be angled with respect to X-axis 14, Y-axis 16, or Z-axis 18 directions and/or angled with respect to each other. The ribs 300, 302 can be located anywhere in the heel-toe direction. For example, ribs 300, 302 can be equally or unequally spaced in the heel-toe direction from the center of gravity or from the face center. In one embodiment, rib 300 can be located approximately 8 mm+/−2 mm or may be in the range of approximately 0 to 30 mm towards the heel 120 from the face center location 40 measured along the X-axis 14; and rib 302 can be located approximately 25 mm+/−2 mm or may be in the range of approximately 0 to 45 mm towards the toe 122 from the face center location 40 measured along the X-axis 14. In another embodiment, rib 300 can be located approximately 2.5 mm+/−2 mm or may be in the range of approximately 0 to 25 mm towards the heel 120 from the face center location 40 measured along the X-axis 14; and rib 302 can be located approximately 21 mm+/−2 mm or may be in the range of approximately 0 to 35 mm towards the toe 122 from the face center location 40 measured along the X-axis 14.

Each of the ribs 300, 302 have front end portions 304, 306 towards the front 124 of the body 108 extending to the edge of the rib which can connect to the interior of the rear edge 148 of the channel 140. Each of the ribs 300, 302 also has rear end portions 308 (not shown), 310 (not shown), towards the rear 126 of the body 108 extending to the edge of the rib which can extend and/or connect to the rear 126 of the body 108. The ribs 300, 302 also include upper portions 312, 314 extending to the edge of the rib and lower portions 316, 318 extending to the edge of the rib. As shown in FIG. 16A, the upper portions 312, 314 of ribs 300, 302 can be curved, generally forming a concave curved shape. In other embodiments the upper portions 312, 314 can have a convex curved shape, straight shape, or any other shape. The lower portions 316, 318 of the ribs can connect to an interior of the sole 118 of the golf club.

Each rib 300, 302 also has first side and a second side and a rib width defined there between. The width of the rib can affect the strength and weight of the golf club. The ribs 300, 302 can have a substantially constant rib width of approximately 0.9 mm+/−0.2 mm or may be in the range of approximately 0.5 to 5.0 mm, or can have a variable rib width. Additionally, in some embodiments, for example, the ribs 300, 302 can have a thinner width portion throughout the majority or a center portion of the rib and a thicker width portion. The thicker width portion can be near the front end portions 304, 306, rear end portions 308, 310, upper portions 312, 314, or lower portions 316, 318, or any other part of the rib. The thickness of the thicker width portion can be approximately 2 to 3 times the width of the thinner portion.

Each rib 300, 302 may also have a maximum height measured along the rib in the Z-axis 18 direction. The maximum height of rib 300, 302 can be approximately may be in the range of approximately 0 to 60 mm, and may extend to the crown 116. Additionally, each rib 300, 302 may also have a maximum length, measured along the rib in the Y-axis 16 direction. The maximum length of ribs 300, 302 may be in the range of approximately 0 to 120 mm and can extend substantially to the rear 126 of the club.

While only two ribs 300, 302 are shown, any number of ribs can be included on the golf club. It is understood that the ribs may extend at different lengths, widths, heights, and angles and have different shapes to achieve different weight distribution and performance characteristics.

The ribs 300, 302 may be formed of a single, integrally formed piece, e.g., by casting with the sole 118. Such an integral piece may further include other components of the body 108, such as the entire sole 118 (including the channel 140) or the entire club head body 108. In other embodiments the ribs 300, 302 can be connected to the crown 116 and/or sole 118 by welding or other integral joining technique to form a single piece.

While internal and external ribs have generally been described in relation to the embodiment disclosed in FIGS. 1-15, it is understood that any rib configuration can apply to any other portion of any embodiment described.

Fairway Woods/Hybrid Club Heads-Structural Ribs

As described above with regards to the embodiments shown in FIGS. 1-15, the golf club head shown in FIGS. 18-26, and the golf club head shown in FIGS. 27-33, may include similar internal and external rib structures although the sizing and location of such structures can vary. The same reference numbers are used consistently in this specification and the drawings to refer to the same or similar parts.

Figure 18:
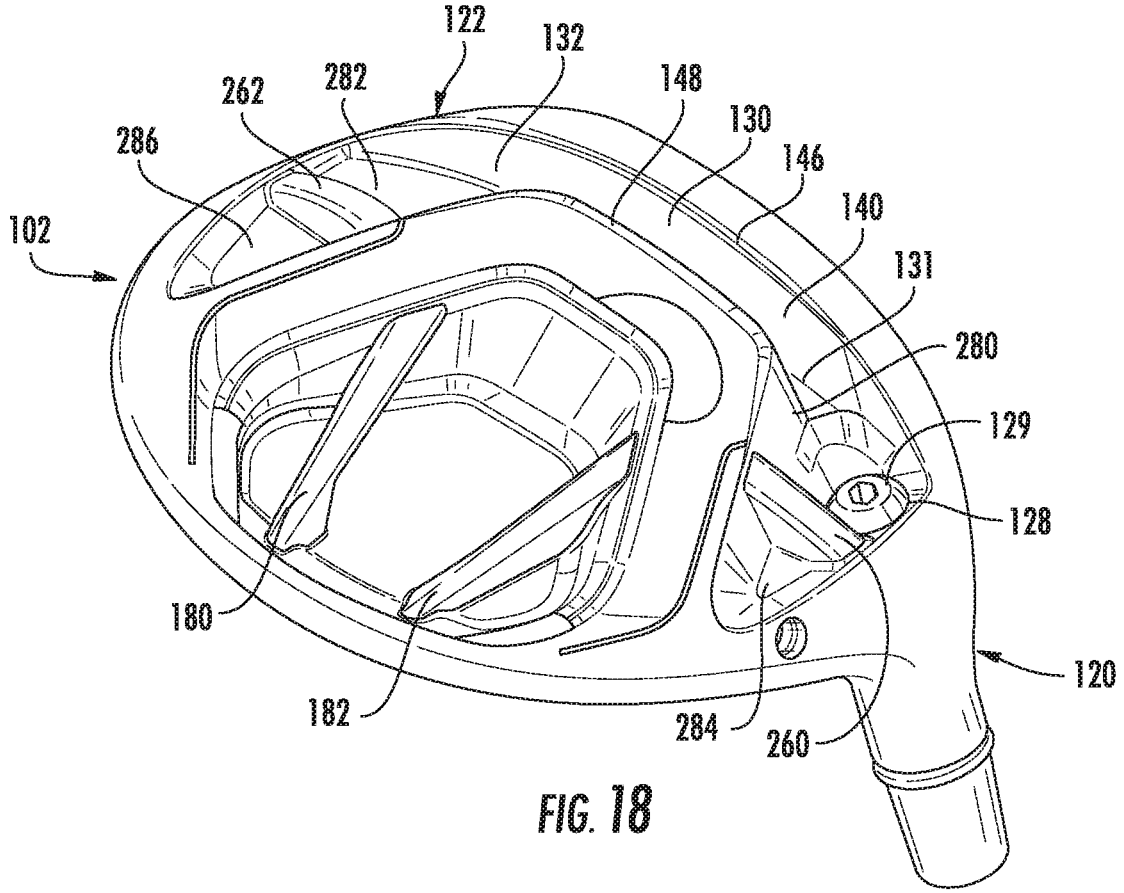
FIG. 18 is a bottom right rear perspective view of an another embodiment of a golf club head according to aspects of this disclosure, in the form of a golf fairway wood.
Figure 19:
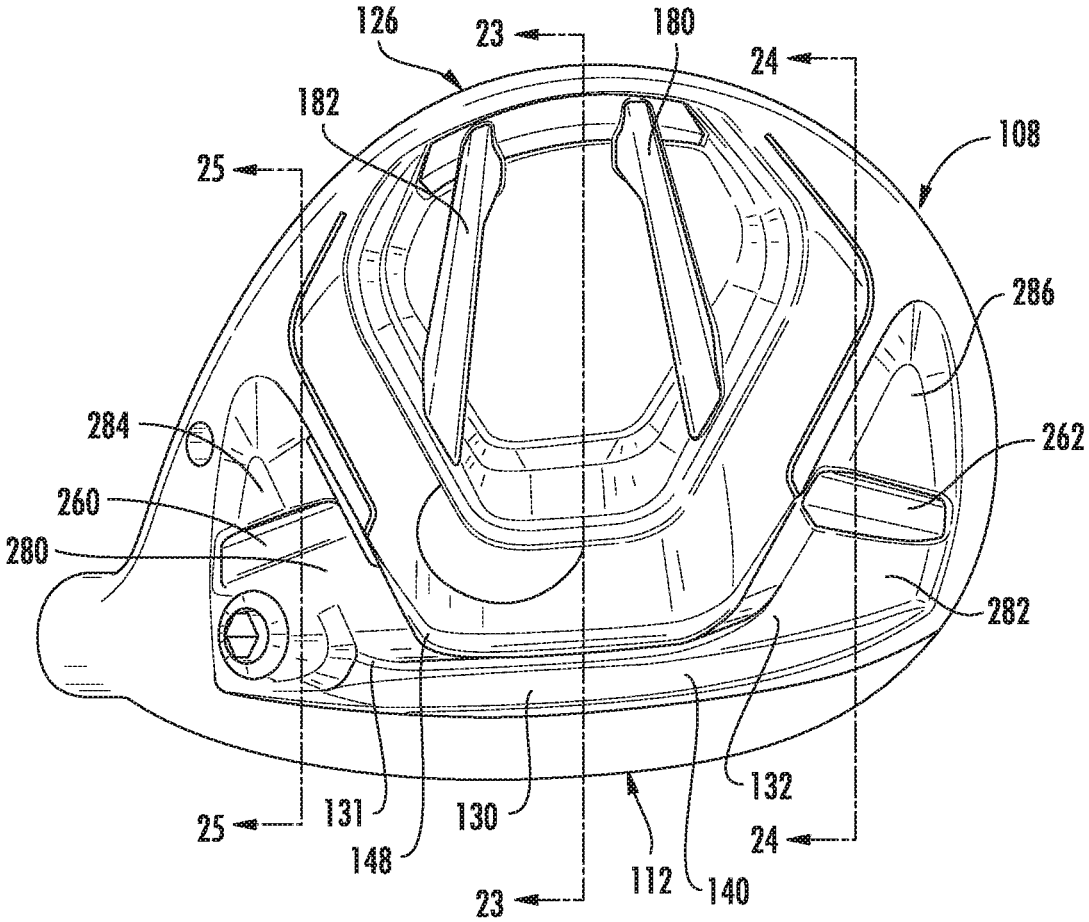
FIG. 19 is a bottom view of the golf club of FIG. 18.
Figure 20:
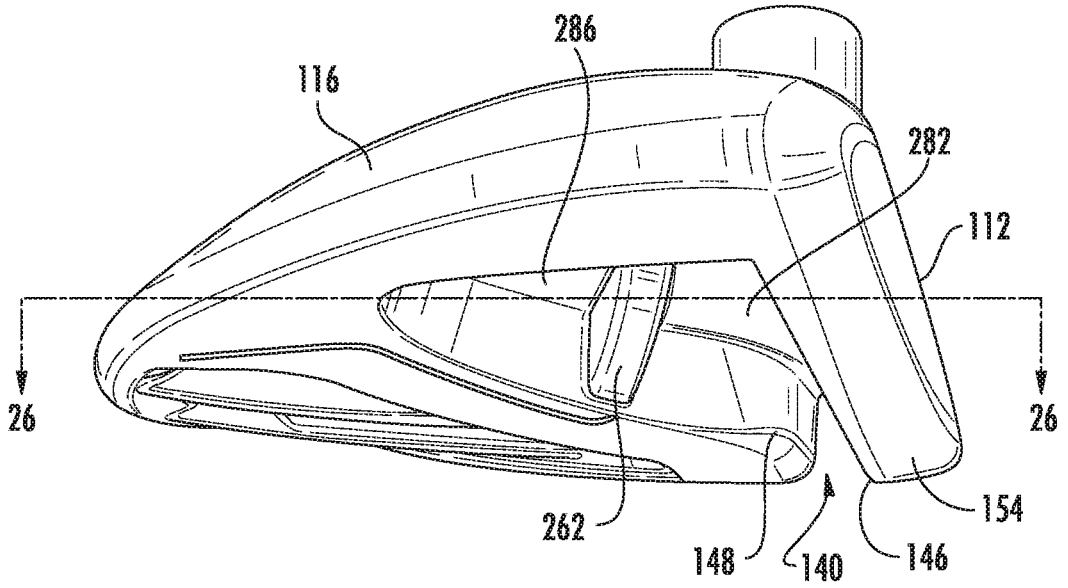
FIG. 20 is a side view of the club head of FIG. 18.
Figure 21:
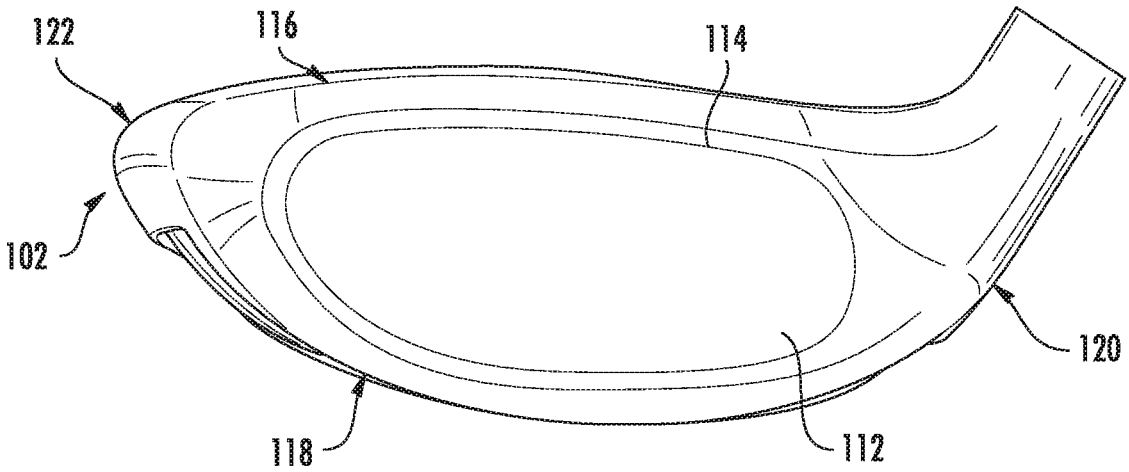
FIG. 21 is a front view of the club head of FIG. 18.
Figure 22:
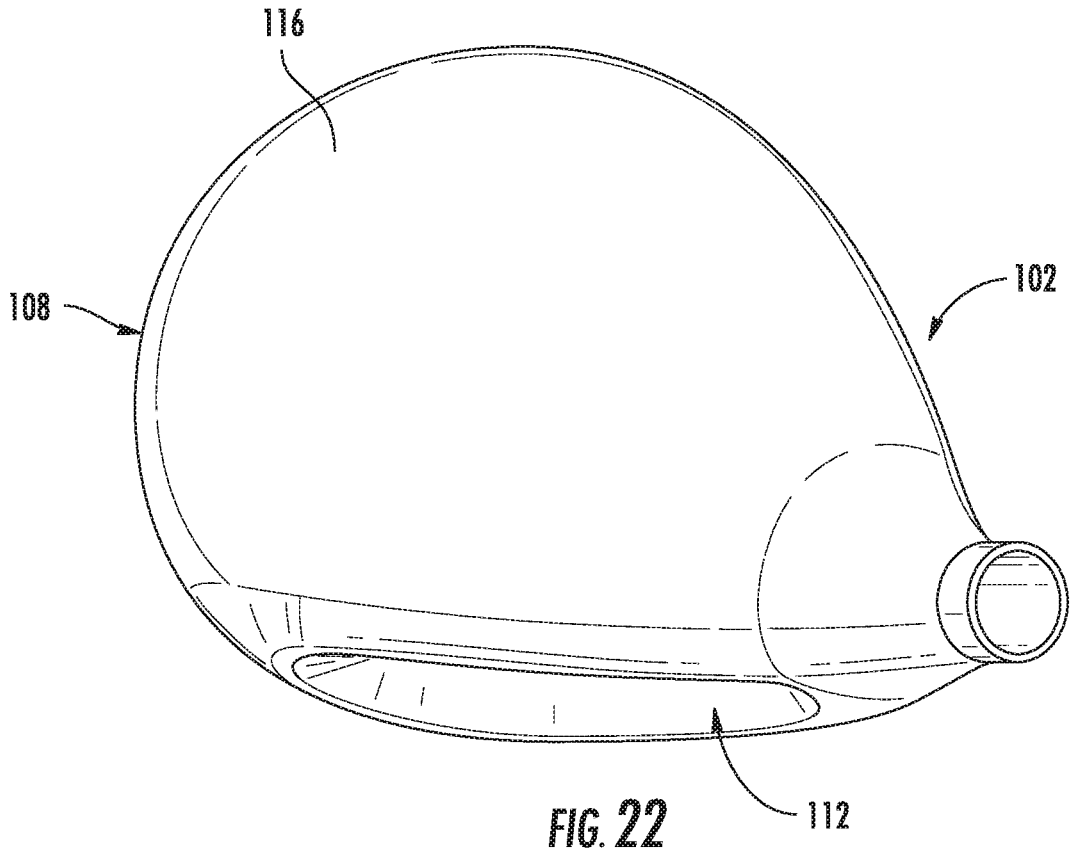
FIG. 22 is a top view of the club head of FIG. 18.
Figure 23:
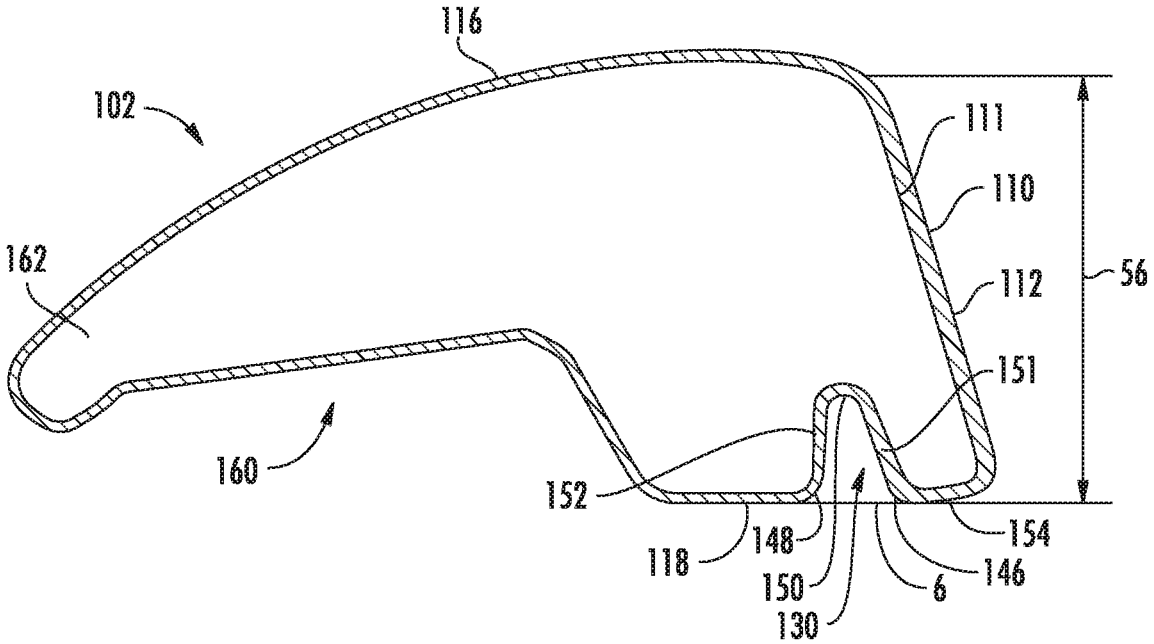
FIG. 23 is a cross-section view taken along line 23-23 of FIG. 19.
Figure 24:
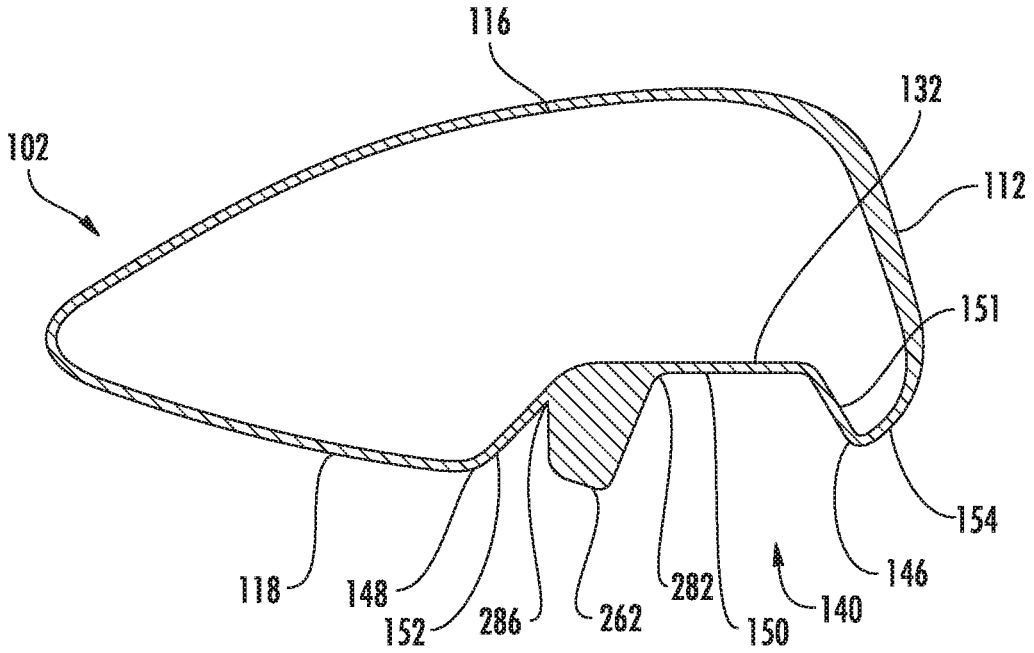
FIG. 24 is a cross-section view taken along line 24-24 of FIG. 19.
Figure 25:
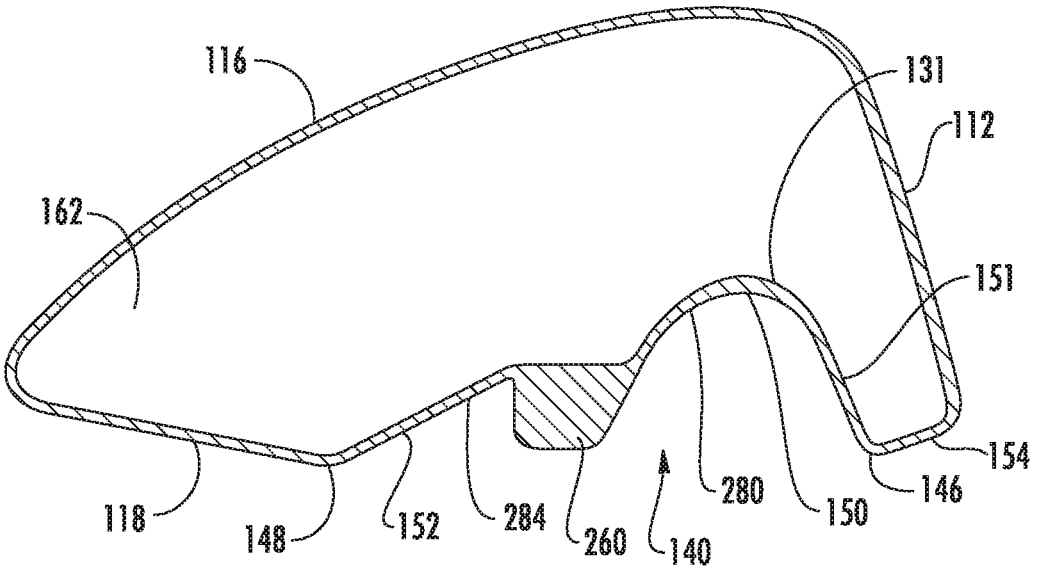
FIG. 25 is a cross-section view taken along line 25-25 of FIG. 19.
Figure 27:
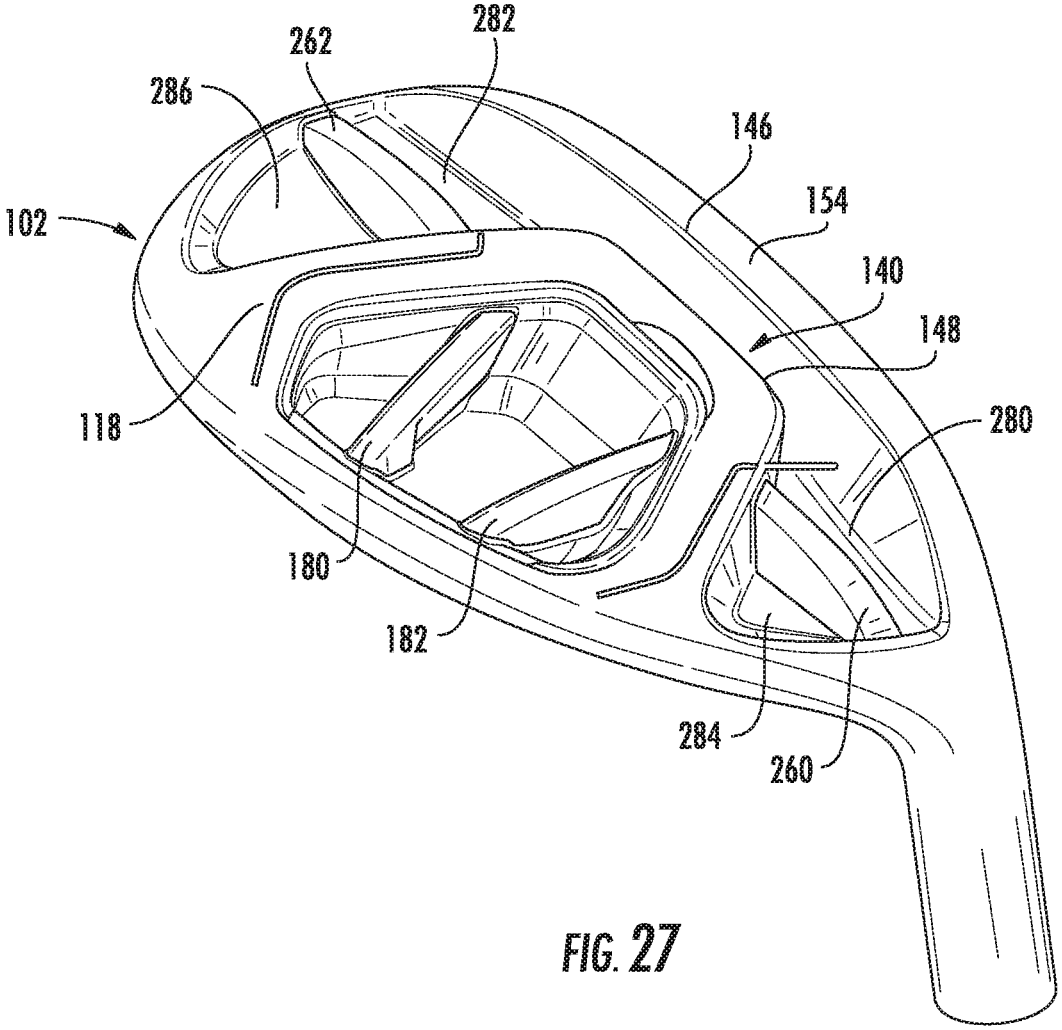
FIG. 27 is a bottom right rear perspective view of an another embodiment of a golf club head according to aspects of this disclosure, in the form of a golf hybrid.
Figure 28:
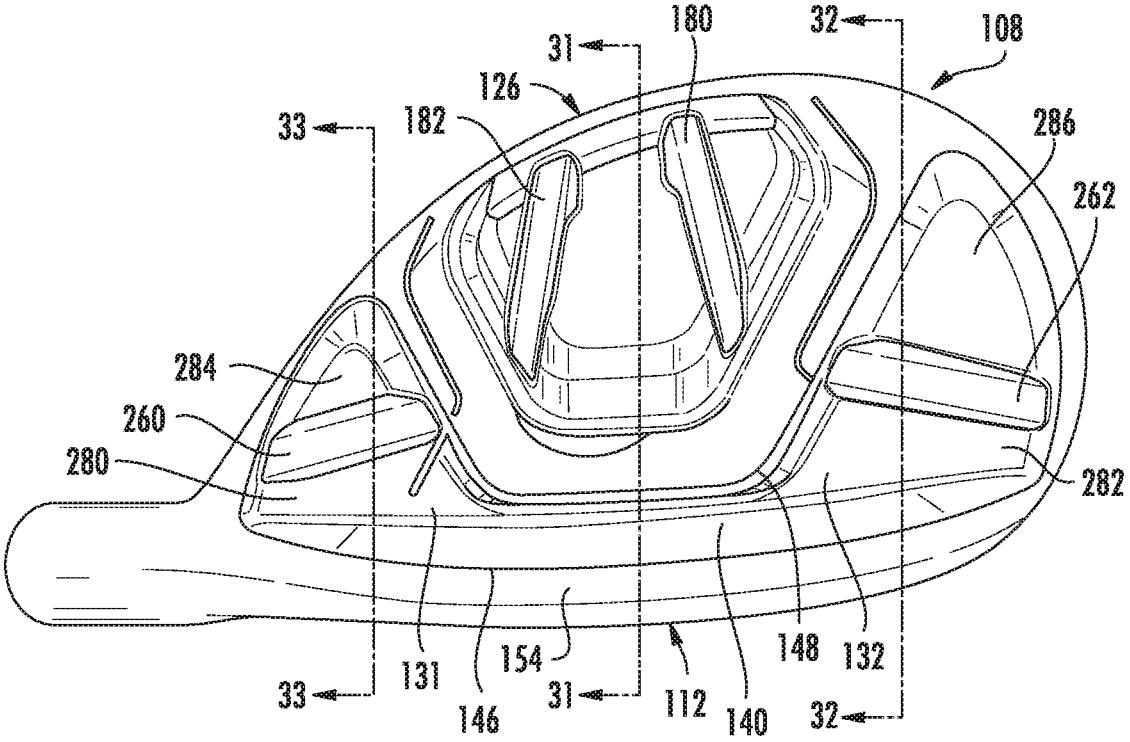
FIG. 28 is a bottom view of the golf club of FIG. 27.
Figure 29:
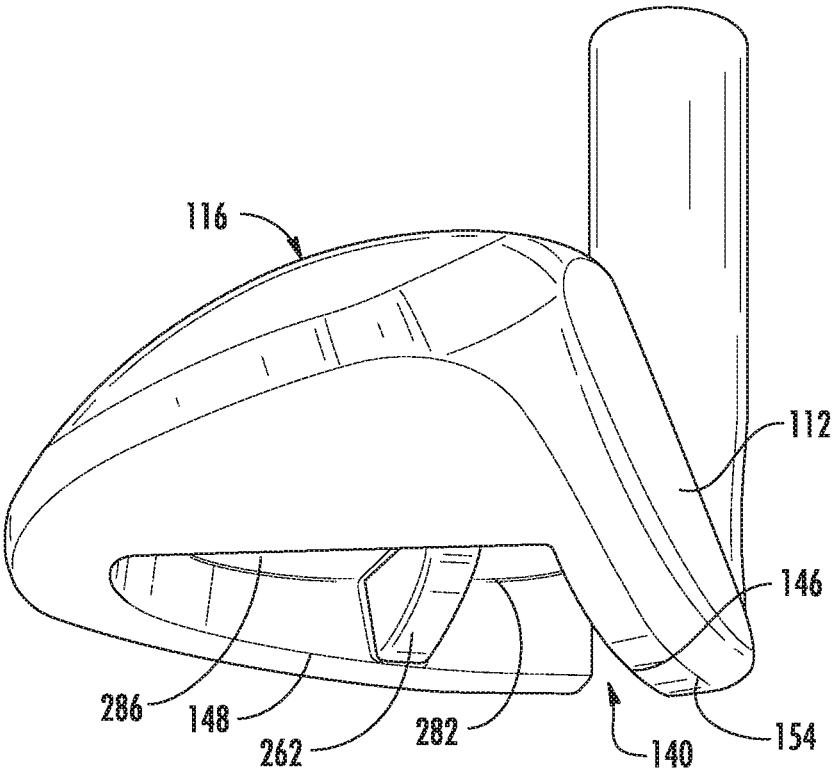
FIG. 29 is a side view of the club head of FIG. 27.
Figure 30:
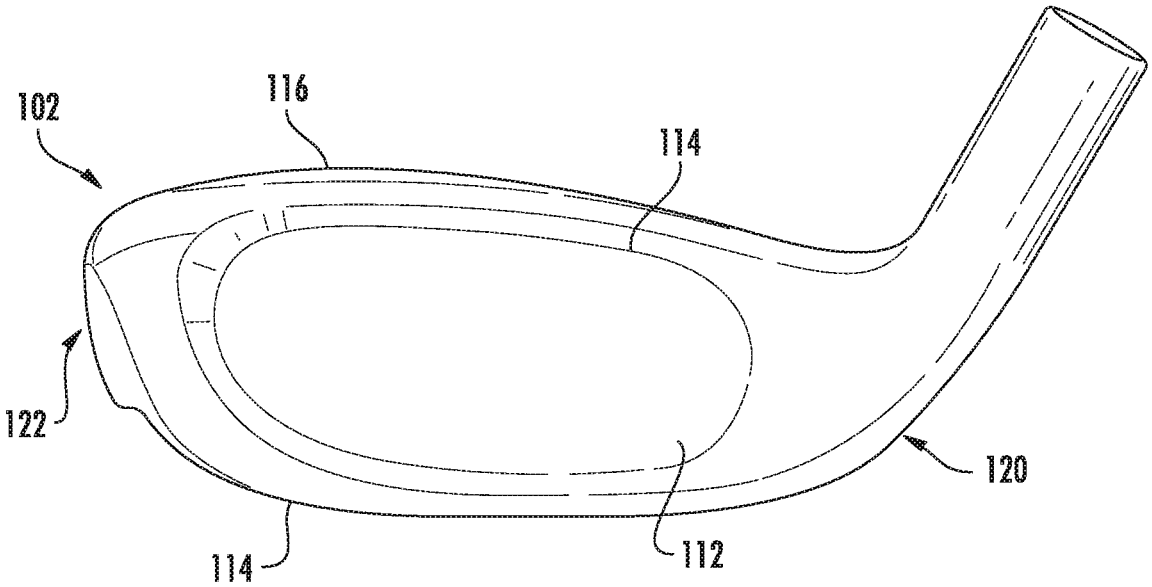
FIG. 30 is a front view of the club head of FIG. 27.
Figure 31:
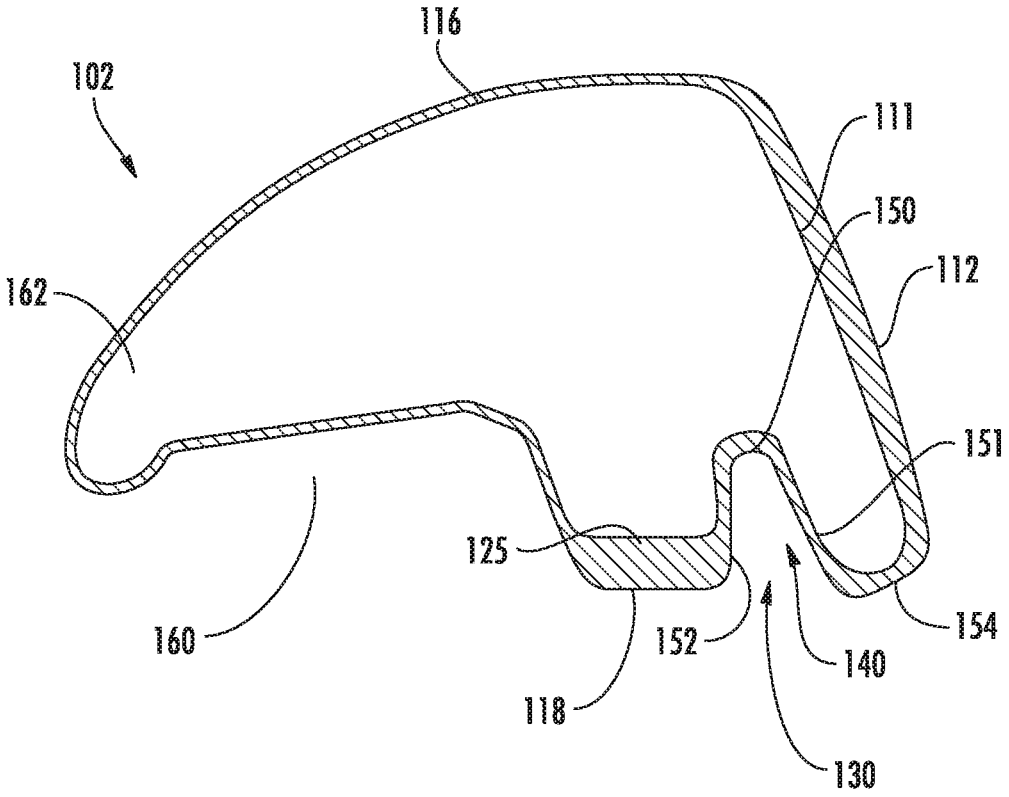
FIG. 31 is a cross-section view taken along line 31-31 of FIG. 28.
Figure 32:
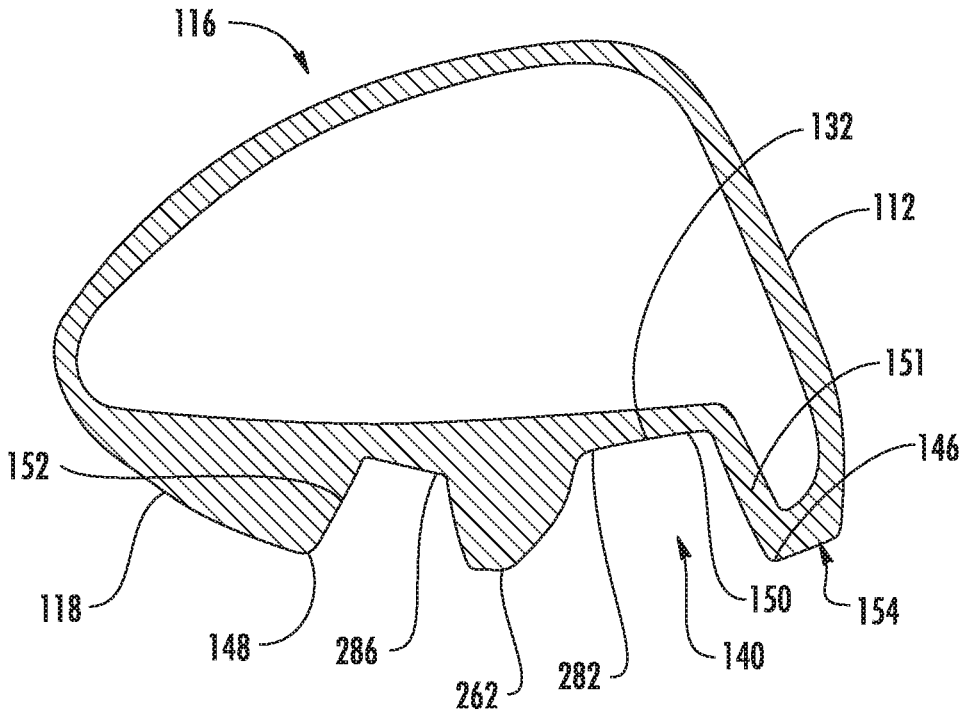
FIG. 32 is a cross-section view taken along line 32-32 of FIG. 28.
Figure 33:
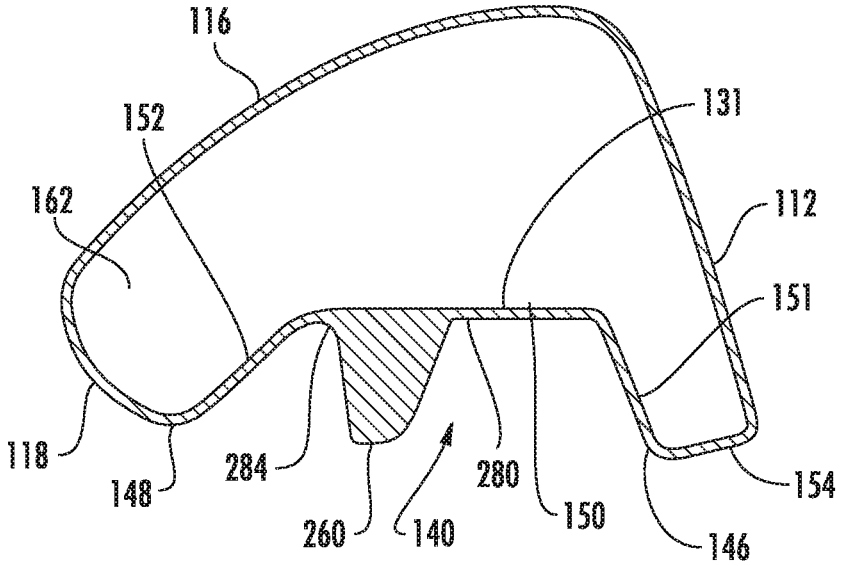
FIG. 33 is a cross-section view taken along line 33-33 of FIG. 28.

As depicted in fairway wood and hybrid embodiments shown in FIGS. 18-26 the cover 161 may include external ribs 180, 182. In one embodiment, as illustrated in FIGS. 18 and 27 external ribs 180, 182 are generally arranged in an angled or v-shaped alignment, converge towards one another with respect to the Y-axis 16 in a front 124 to rear 126 direction. In this configuration, the ribs 180, 182 converge towards one another at a point beyond the rear 126 of the club. As shown in FIG. 19, the angle of the ribs 180, 182 from the Y-axis 16 may be approximately 7 degrees, or may be in the range of 0 to 30 degrees, and approximately 11 degrees, or may be in the range of 0 to 30 degrees respectively. As shown in FIG. 28, the angle of the ribs 180, 182 from the Y-axis 16 can be approximately 13 degrees, or may be in the range of 0 to 30 degrees, and approximately 13 degrees, or may be in the range of 0 to 30 degrees respectively.

The ribs 180, 182 may be located anywhere in the heel-to-toe direction and in the front-rear direction. For example, ribs 180, 182 may be equally or unequally spaced in the heel-to-toe direction from the center of gravity or from the face center. In one embodiment, as shown in FIG. 18, the front end portion 184 of rib 180 can be located approximately 12 mm, or may be in the range of 0 to 25 mm, towards the heel 120 from the face center location 40 measured along the X-axis 14; and the front end portion 186 of rib 182 can be located approximately 27 mm, or may be in the range of 0 to 40 mm, towards the toe 122 from the face center location 40 measured along the X-axis 14. In another embodiment, as shown in FIG. 28 the front end portion 184 of rib 204 may be located approximately 10 mm, or may be in the range of 5 to 30 mm, towards the heel 120 from the face center location 40 measured along the X-axis 14; and the front end portion 186 of rib 182 may be located approximately 22 mm, or may be in the range of 5 to 40 mm, towards the toe 122 from the face center location 40 measured along the X-axis 14. In one embodiment, as shown in FIG. 18, the front end portion 184 of rib 180 can be located approximately 41 mm, or may be in the range of 20 to 70 mm, towards the rear 126 from the striking face measured in the Y-axis 16 direction; and the front end portion 186 of rib 182 can be located approximately 43 mm, or may be in the range of 20 to 70 mm, towards the rear 126 from the striking face measured along the Y-axis 16. In another embodiment, as shown in FIG. 27, the front end portion 184 of rib 180 may be located approximately 37 mm, or may be in the range of 20 to 70 mm, towards the rear 126 from the striking face measured in the Y-axis 16 direction; and the front end portion 186 of rib 182 can be located approximately 43 mm, or may be in the range of 20 to 70 mm, towards the rear 126 from the striking face measured along the Y-axis 16.

As depicted in embodiments shown in FIGS. 18-33, each rib 180, 182 also has an internal side 189, 191 and an external side 193, 195 and a width defined there between. The width of the ribs 180, 182 can affect the strength and weight of the golf club. The ribs 180, 182 may have a thinner width portion 200 throughout the majority, or center portion, of the rib. The thinner width portion 200 of the rib may be approximately 1.0 mm, or may be in the range of approximately 0.5 to 5.0 mm and may be substantially similar throughout the entire rib. The ribs 180, 182 may also include a thicker width portion 202. The thicker width portion 202 may be near the front end portions 184, 186, rear end portions 188, 190, upper portions 192, 194, or lower portions 196, 198. The ribs 180, 182 include a thicker width portion 202 over part of the front end portions 184, 186, part of the rear end portions 188, 190, and the lower portions 196, 198. The thicker width portion 202 may be disposed substantially on the internal sides 189, 191 of the ribs 180, 182. In other embodiments, the thicker width portion may be distributed equally or unequally on the internal sides 189, 191 and the external sides 193, 195, or substantially on the external sides 193, 195. The thickness of the thicker width portion can be approximately 3 mm, or may be in the range of approximately 1 to 10 mm. The width of the thicker portion 202 can be approximately 2 to 3 times the width of the thinner portion 200. The ribs 180, 182 may have a substantially similar width throughout the rib that can be approximately 2 mm, or may be in the range of approximately 0.5 to 5.0 mm and may be substantially similar throughout the entire rib.

Each rib 180, 182 also has a maximum height defined by the distance between the upper portions 192, 194 and the lower portions 196, 198 measured along the ribs 180, 182 in the Z-axis 18 direction. A maximum height of the ribs 180, 182 of FIGS. 18-26 may be in the range of approximately 5 to 30 mm. A maximum height of the ribs 180, 182 of FIGS. 27-33 may be in the range of approximately 5 to 30 mm. Additionally, each rib 180, 182 also has a maximum length, defined by the distance between the front end portions 184, 186 and rear end portions 188, 190 measured along the ribs 180, 182 in the plane defined by the X-axis 14 and the Y-axis 16. The length of the rib 180 of FIGS. 18-26 may be approximately 39 mm, or may be in the range of approximately 10 to 60 mm. The length of the rib 182 of FIGS. 18-26 may be approximately 43 mm, or may be in the range of approximately 10 to 60 mm. The length of the rib 180 of FIGS. 27-33 may be approximately 24 mm, or may be in the range of approximately 10 to 50 mm. The length of the rib 182 of FIGS. 27-33 may be approximately 27 mm, or may be in the range of approximately 10 to 50 mm.

Figure 26:
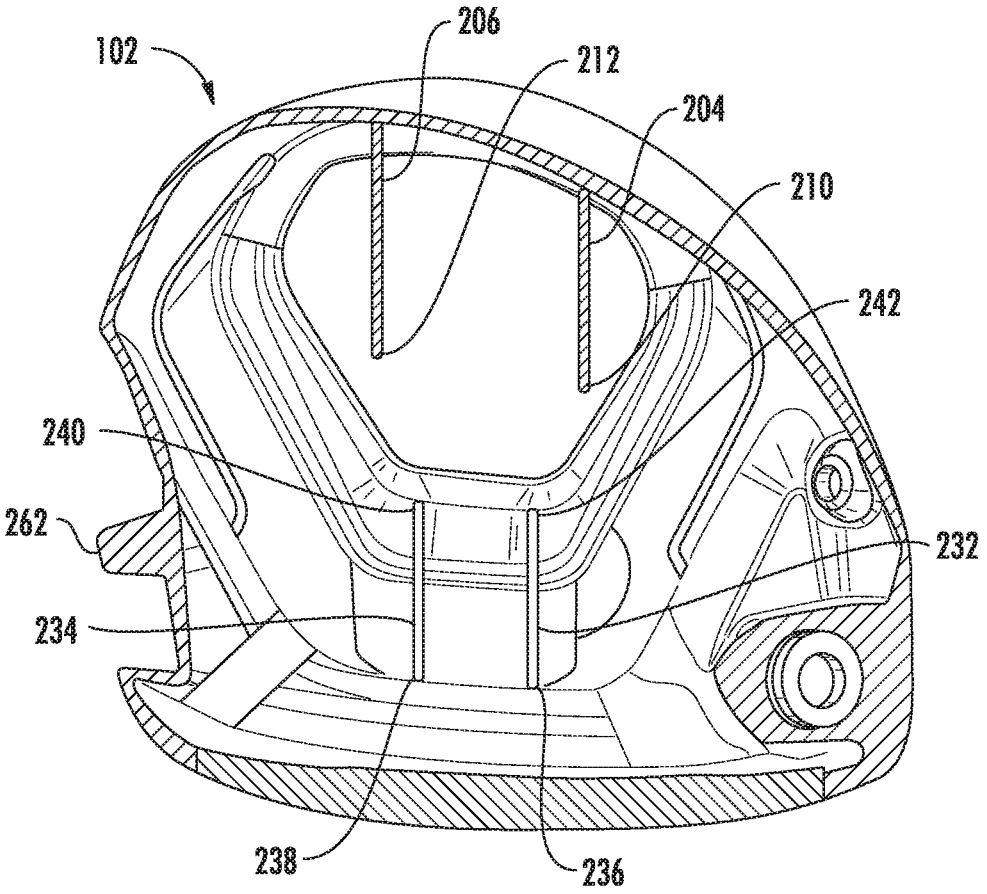
FIG. 26 is cross-section view taken along line 26-26 of FIG. 20.

Additionally, as shown in FIG. 26, the embodiment of FIGS. 18-26 may have similar internal ribs to the embodiments of FIGS. 1-17. Because of the smaller body for a fairway wood configuration, there may be fewer ribs than on a driver. For example, ribs 204 and 206 may have similar properties to the ribs 204, 206 of the embodiments of FIGS. 1-17, except having two ribs compared to three ribs. In addition, the fairway woods may have ribs 232, 234 similar to the driver embodiments where the ribs may taper to having a lower rib height near the front ends 236, 238 as compared to the rear ends 240, 242.

Another aspect of the rib structure for the embodiment shown in FIGS. 2 and 14 is its impact on the overall sound and feel of the golf club head. The internal and external rib structures 180, 182, 204, 206, 208, 232, and 234 in the club head 102 of the embodiment shown FIG. 2 can create a more rigid overall structure, which produces a higher pitch sound when the club head strikes a golf ball. For example, the rib structure can enable the first natural frequency of the golf club head to increase from approximately 2200 Hz to over 3400 Hz, while limiting the increase in weight to less than 10 grams. A golf club head having a first natural frequency lower than 3000 Hz can create a sound that is not pleasing to golfers.

The various structural dimensions, relationships, ratios, etc., described herein for various components of the club heads 102 in FIGS. 1-39C may be at least partially related to the materials of the club heads 102 and the properties of such materials, such as tensile strength, ductility, toughness, etc., in some embodiments. Accordingly, it is noted that the heads 102 in FIGS. 1-17 may be manufactured having some or all of the structural properties described herein, with a face 112 made from a Ti-6Al-4V alloy with a yield strength of approximately 1000 MPa, an ultimate tensile strength of approximately 1055 MPa, and an elastic modulus, E, of approximately 114 GPa and a density of 4.43 g/cc. and a body 108 made from a Ti-8Al-1Mo-1V alloy with a yield strength of approximately 760 MPa, an ultimate tensile strength of approximately 820 MPa, and an elastic modulus, E, of approximately 121 GPa and a density of 4.37 g/cc. Alternatively, the face may be made from a higher strength titanium alloy such as Ti-15V-3Al-3Cr-3Sn and Ti-20V-4V-1Al which can exhibit a higher yield strength and ultimate tensile strength while having a lower modulus of elasticity than Ti-6Al-4V alloy of approximately 100 GPa. Additionally, the face may be made from a higher strength titanium alloy, such as SP700, (Ti-4.5Al-3V-2Fe-2Mo) which can have a higher yield strength and ultimate tensile strength while having a similar modulus of elasticity of 115 GPa. It is also noted that the heads 102 in FIGS. 18-33 may be manufactured having some or all of the structural properties described herein, with a face 112 and a body 108 both made from 17-4PH stainless steel having an elastic modulus, E, of approximately 197 GPa, with the face 112 being heat treated to achieve a yield strength of approximately 1200 MPa and the body 108 being heat treated to achieve a yield strength of approximately 1140 MPa. In other embodiments, part or all of each head 102 may be made from different materials, and it is understood that changes in structure of the head 102 may be made to complement a change in materials and vice/versa. The specific embodiments of drivers, fairway woods, and hybrid club heads in the following tables utilize the materials described in this paragraph, and it is understood that these embodiments are examples, and that other structural embodiments may exist, including those described herein. Table 1 provides a summary of data as described above for club head channel dimensional relationships for the driver illustrated in FIGS. 1-17 and corresponding fairway and hybrids of FIGS. 18-33.

TABLE 1

Club Head Channel Dimensional Relationships for Drivers/Fairway Woods/Hybrids

| Club Head Characteristic/ Parameters | Driver FIGS. 1-16 | Driver FIG. 17 | Fairway Woods | Hybrids |
|---|---|---|---|---|
| Face Height | | | | |
| Height | 50-72 mm (58-62 mm) | 45-65 mm (53-57 mm) | 28-40 mm (35-37 mm) | 28-40 mm (34-35 mm) |
| Channel | | | | |
| Width (Center) | 8-12 mm (10 mm) | 8-12 mm (10 mm) | 8.5-9.5 mm (9.0 mm) | 7.5-8.5 mm (8.0 mm) |
| Depth (Center) | 2.0-4.0 mm (3.0 mm) | 2.0-4.0 mm (3.0 mm) | 8.5-9.5 mm (9.0 mm) | 7.5-8.5 mm (8.0 mm) |
| Channel Rearward Spacing | 8 mm | 8 mm | 7.0 mm | 8.0 mm |
| Channel Wall Thickness | | | | |
| Center | 1.0-1.4 mm (1.2 mm) | 1.0-1.4 mm (1.2 mm) | 1.5-1.7 mm (1.6 mm) | 1.5-1.7 mm (1.6 mm) |
| Heel | 0.8-1.0 mm (0.9 mm) | 0.8-1.0 mm (0.9 mm) | 0.85-1.05 mm (0.95 mm) | 0.9-1.1 mm (1.0 mm) |
| Toe | 0.8-1.0 mm (0.9 mm) | 0.8-1.0 mm (0.9 mm) | 0.85-1.05 mm (0.95 mm) | 0.9-1.1 mm (1.0 mm) |
| Ratios (expressed as X:1) | | | | |
| Face Width:Channel Length | 2.5-3.5 | 2.5-3.5 | 1.5-2.5 | 1.5-2.5 |
| Channel Width (Center):Channel Wall Thickness | 7.5-9.5 | 7.5-9.5 | 5.0-6.5 | 4.5-5.5 |
| Channel Width (Center):Channel Depth (Center) | 2.5-4.5 | 2.5-4.5 | 0.8-1.2 | 0.8-1.2 |
| Channel Depth (Center):Channel Wall Thickness | 2.0-3.0 | 2.0-3.0 | 5.0-6.5 | 4.5-5.5 |
| Channel Length:Channel Width (Center) | 3-4 | 3-4 | 4.0-4.5 | 4.5-5 |
| Face Height:Channel Width (Center) | 5-7 | 4.5-6.5 | 3.5-5 | 3.5-4.5 |
| Face Height:Channel Depth (Center) | 18-23 | 16-21 | 3.5-5 | 3.5-4.5 |
| Face Height:Channel Wall Thickness | 45-55 | 41-51 | 20-25 | 20-25 |
| Channel Spacing Ratios (expressed as X:1) | | | | |
| Face Height:Channel Spacing (Center) | 6.5-8.5 | 6-8 | 4.5-5.5 | 3.5-4.5 |
| Channel Spacing:Channel Width (Center) | 0.5-1.0 | 0.5-1.0 | 0.6-0.9 | 0.8-1.2 |
| Channel Spacing:Channel Depth (Center) | 2-3 | 2-3 | 0.6-0.9 | 0.8-1.2 |
| Channel Spacing:Wall Thickness (Center) | 6-7 | 6-7 | 4.0-4.5 | 4.75-5.25 |

It is understood that one or more different features of any of the embodiments described herein can be combined with one or more different features of a different embodiment described herein, in any desired combination. It is also understood that further benefits may be recognized as a result of such combinations.

Golf club heads 102 incorporating the body structures disclosed herein, e.g., channels, voids, ribs, etc., may be used as a ball striking device or a part thereof. For example, a golf club 100 as shown in FIG. 1 may be manufactured by attaching a shaft or handle 104 to a head that is provided, such as the heads 102, et seq., as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102 as described above may be provided. For example, a set of golf clubs may include one or more drivers, one or more fairway wood clubs, and/or one or more hybrid clubs having features as described herein. In other embodiments, different types of ball striking devices can be manufactured according to the principles described herein. Additionally, the head 102, golf club 100, or other ball striking device may be fitted or customized for a person, such as by attaching a shaft 104 thereto having a particular length, flexibility, etc., or by adjusting or interchanging an already attached shaft 104 as described above.

The ball striking devices and heads therefor having channels as described herein provide many benefits and advantages over existing products. For example, the flexing of the sole 118 at the channel 140 results in a smaller degree of deformation of the ball, which in turn can result in greater impact efficiency and greater ball speed at impact. As another example, the more gradual impact created by the flexing can result in greater energy and velocity transfer to the ball during impact. Still further, because the channel 140 extends toward the heel and toe edges 114 of the face 112, the head 102 can achieve increased ball speed on impacts that are away from the center or traditional "sweet spot" of the face 112. The greater flexibility of the channels 140 near the heel 120 and toe 122 achieves a more flexible impact response at those areas, which offsets the reduced flexibility due to decreased face height at those areas, further improving ball speed at impacts that are away from the center of the face 112. As an additional example, the features described herein may result in improved feel of the golf club 100 for the golfer, when striking the ball. Additionally, the configuration of the channel 140 may work in conjunction with other features (e.g. the ribs 204, 206, 208, 232, 234, and the access 128, etc.) to influence the overall flexibility and response of the channel 140, as well as the effect the channel 140 has on the response of the face 112. Further benefits and advantages are recognized by those skilled in the art.

The ball striking devices and heads therefore having a void structure as described herein also provide many benefits and advantages over existing products. The configuration of the void 160 provides the ability to distribute weight more towards the heel 120 and toe 122. This can increase the moment of inertia (MOI) approximately a vertical axis through the CG of the club head (MOIz-z). Additionally, certain configurations of the void can move the CG of the club head forward, which can reduce the degree and/or variation of spin on impacts on the face 112. The structures of the legs 164, 165, the cover 161, and the void 160 may also improve the sound characteristics of the head 102. It is further understood that fixed or removable weight members can be internally supported by the club head structure, e.g., in the legs 164, 165, in the interface area 168, within the void 160, etc.

Additional structures such as the internal and external ribs 180, 182, 204, 206, 208, 232, 234 as described herein also provide many benefits and advantages over existing products. For example, the configuration of the internal and external ribs provide for the desired amount of rigidity and flexing of the body. The resulting club head provides enhanced performance and sound characteristics.

The benefits of the channel, the void, and other body structures described herein can be combined together to achieve additional performance enhancement. Further benefits and advantages are recognized by those skilled in the art.

While the invention has been described with respect to specific examples including presently preferred modes of carrying out the invention, those skilled in the art will appreciate that there are numerous variations and permutations of the above described systems and methods.

What is claimed is:

1. A golf club head comprising:

a face having a striking surface configured for striking a ball, wherein the face has a bottom edge;

a body connected to the face and extending rearward from the face, the body having a crown, a sole, a heel, and a toe;

a channel extending across a portion of the sole in a heel to toe direction, wherein the channel is recessed from adjacent surfaces of the sole and has a depth of recession from the adjacent surfaces of the sole, and wherein the channel has a rear wall, a front wall, a front edge, a rear edge, and wherein the channel is elongated, extending between a first end located proximate to the golf club head heel and a second end proximate the golf club head toe;

wherein the channel has a boundary defined by the front edge and the rear edge that extends between the first end and the second end;

wherein the channel extends across the sole, adjacent to and along the bottom edge of the face;

a width defined between the front and rear edges of the channel and comprises a center portion extending across a center of the sole, a heel portion extending from a heel end of the center portion toward the heel, and a toe portion extending from a toe end of the center portion toward the toe; and wherein the width of the center portion of the channel is substantially constant; and and wherein the rear edge of the channel angles away from the front edge of the channel in the channel heel portion and the channel toe portion such that a channel heel portion width is greater than the channel center portion width and a channel toe portion width is greater than the channel center portion width;

a first rib positioned in the toe portion of the channel connected to the rear wall of the channel, wherein the first rib is free of connection to the front edge of the channel, and a second rib positioned in the heel portion of the channel connected to the rear wall of the channel, wherein the second rib is free of connection to the front edge of the channel, and wherein the first and second ribs extend generally parallel to the face, wherein the first rib and second rib are positioned aft of the rear edge of the center portion of the channel.

2. The golf club head of claim 1, wherein the first rib in the channel has a width in a range of 4 mm to 14 mm.

3. The golf club head of claim 1, wherein the first rib has a hollow portion.

4. The golf club head of claim 1, wherein the first rib further comprises an upper portion, a lower portion, a front portion, a rear portion, and a center portion, and wherein the rear portion has a height larger than the front portion.

5. The golf club head of claim 1, wherein the first rib is located in the toe portion of the channel and the second rib is located in the heel portion of the channel.

6. The golf club head of claim 1, wherein the rear portion of each rib has a first height and the front portion of each rib has a second height, wherein the first height is greater than the second height.

7. The golf club head of claim 1, wherein the first rib has a hollow portion.

8. The golf club head of claim 1, wherein each rib has a width between 4 mm and 14 mm.

9. The golf club head of claim 1, wherein each rib is free of connection to a front edge of the channel.

10. The golf club head of claim 1, wherein the front and rear edges of the channel are angled away from each other at the heel portion and the toe portion, such that the width of the channel at the heel and toe portions increases from the heel end of the center portion toward the heel and from the toe end of the center portion toward the toe, and wherein the depth of recession of the channel is greater at the heel and toe portions than at the center portion.

11. The golf club head of claim 1, wherein the upper portions of each rib forms a convex curved shape.

12. The golf club head of claim 1, wherein the first rib separates the channel toe portion into a channel toe portion forward portion and a channel toe portion rear portion;

wherein the second rib separates the channel heel portion into a channel heel portion forward portion and a channel heel portion rear portion.

* * * * *